US011408659B2

(12) United States Patent
Notaney et al.

(10) Patent No.: US 11,408,659 B2
(45) Date of Patent: Aug. 9, 2022

(54) DEVICES FOR PRODUCING CLEAR ICE PRODUCTS AND RELATED METHODS

(71) Applicant: Abstract Ice, Inc., Novato, CA (US)

(72) Inventors: Ashok Kumar Notaney, San Francisco, CA (US); Todd Stevenson, Novato, CA (US); Andrew Whalen, Windsor, CA (US); Larry Allen Mercier, Jr., Ann Arbor, MI (US); Nathan Ernst, Dexter, MI (US); Kristopher Schilling, Ann Arbor, MI (US); James Anthony Coller, Ann Arbor, MI (US); Jason Bazylewicz, Ypsilanti, MI (US); Parth Patel, Lambertville, MI (US); Bryce Edmund Peterson, Hayward, CA (US)

(73) Assignee: Abstract Ice, Inc., Novato, CA (US)

( * ) Notice: Subject to any disclaimer, the term of this patent is extended or adjusted under 35 U.S.C. 154(b) by 0 days.

(21) Appl. No.: 17/530,426

(22) Filed: Nov. 18, 2021

(65) Prior Publication Data

US 2022/0163249 A1 May 26, 2022

Related U.S. Application Data

(60) Provisional application No. 63/276,506, filed on Nov. 5, 2021, provisional application No. 63/116,453, filed on Nov. 20, 2020.

(51) Int. Cl.

| | |
|---|---|
| ***F25C 1/18*** | (2006.01) |
| ***F25C 1/24*** | (2018.01) |
| ***F25C 1/04*** | (2018.01) |

(52) U.S. Cl.

CPC ..... *F25C 1/18* (2013.01); *F25C 1/04* (2013.01); *F25C 1/24* (2013.01)

(58) Field of Classification Search

CPC ..... F25C 1/12; F25C 1/18; F25C 2400/14; F25C 1/22; F25C 1/25

See application file for complete search history.

(56) References Cited

U.S. PATENT DOCUMENTS

| | | | |
|---|---|---|---|
| 230,318 | A | 7/1880 | Miller |
| 1,380,933 | A | 6/1921 | Smith |
| 2,036,706 | A | 4/1936 | Ward |
| 2,221,847 | A | 11/1940 | Rodgers |
| 2,334,941 | A | 11/1943 | Linden |

(Continued)

FOREIGN PATENT DOCUMENTS

| | | | |
|---|---|---|---|
| CN | 101077094 | B | 11/2011 |
| CN | 106135628 | A | 11/2016 |

(Continued)

OTHER PUBLICATIONS

International Search Report for PCT/US2020/059014 dated Feb. 2, 2021, 3 pages.

(Continued)

*Primary Examiner* — Cassey D Bauer

(74) *Attorney, Agent, or Firm* — Aurora Consulting LLC; Kristen J. Hansen; Ashley Sloat

(57) ABSTRACT

A device for producing an elongate ingot of clear ice comprises a housing comprising at least one flume surface wall that defines at least one elongate trough; at least one fluid intake disposed to provide a flow of liquid into the at least one elongate trough; at least one drain disposed to drain liquid from at least one elongate trough; wherein the at least a portion of the at least one flume surface wall is in thermal communication with a cooling source; and wherein the at least one fluid intake and the at least one drain are adapted to provide a substantially constant flow of fluid to the at least (Continued)

one elongate trough during a freezing operation of the device. The cooling source can be an internal cooling cavity.

20 Claims, 41 Drawing Sheets

(56) References Cited

U.S. PATENT DOCUMENTS 2,677,249 A 5/1954 Mason
2,717,504 A 9/1955 Knerr
3,173,175 A 3/1965 Lemelson
3,226,944 A 1/1966 Connors
3,796,063 A 3/1974 Wulke et al.
3,812,686 A 5/1974 Tester
3,911,146 A 10/1975 Hara et al.
3,940,232 A 2/1976 Stock
3,952,539 A 4/1976 Hanson et al.
3,984,996 A 10/1976 Bright
4,112,921 A 9/1978 MacCracken
4,164,343 A 8/1979 Graebner
4,189,928 A 2/1980 Cerny
4,335,155 A 6/1982 Blake et al.
4,455,843 A 6/1984 Quarles
4,498,595 A 2/1985 Wilson
4,550,575 A 11/1985 Degaynor
4,590,774 A 5/1986 Povajnuk
4,601,174 A 7/1986 Wilson
4,620,422 A 11/1986 Hosokawa et al.
4,776,566 A 10/1988 Girdley
4,833,894 A 5/1989 Chesnut
4,834,340 A 5/1989 Girdley
4,852,359 A 8/1989 Manzotti
4,954,151 A 9/1990 Chang et al.
4,966,015 A 10/1990 Wessa
4,990,169 A * 2/1991 Broadbent ..... F25C 1/125 426/66
5,032,157 A 7/1991 Ruff
5,054,547 A 10/1991 Shipley
5,069,044 A 12/1991 Holum et al.
5,076,069 A 12/1991 Brown
5,127,236 A 7/1992 von Blanquet
5,167,132 A 12/1992 Meier
5,187,948 A 2/1993 Frohbieter
5,254,355 A 10/1993 Smith et al.
5,419,285 A 5/1995 Gurevich et al.
5,431,027 A 7/1995 Carpenter
5,555,747 A 9/1996 Conlon
5,618,463 A 4/1997 Rindler et al.
5,778,677 A 7/1998 Hung et al.
5,948,456 A 9/1999 Jones et al.
5,970,735 A 10/1999 Hobelsberger
6,089,035 A 7/2000 Mildengren
6,105,385 A * 8/2000 Kato ..... F25C 1/12 62/347
6,233,962 B1 5/2001 Scherer et al.
6,284,294 B1 9/2001 French et al.
6,357,720 B1 3/2002 Shapiro et al.
6,536,224 B2 3/2003 Frank et al.
6,705,090 B2 3/2004 Billman et al.
6,857,277 B2 2/2005 Somura
6,935,124 B2 8/2005 Takahashi et al.
7,021,081 B2 4/2006 Becker
7,082,782 B2 8/2006 Schlosser et al.
7,210,298 B2 5/2007 Lin
7,318,323 B2 1/2008 Tatsui et al.
7,340,913 B2 3/2008 Miller et al.
7,444,829 B2 11/2008 Mori et al.
7,448,863 B2 11/2008 Yang
7,540,161 B2 6/2009 Broadbent et al.
7,703,299 B2 4/2010 Schlosser et al.
7,832,219 B2 11/2010 Baranowski et al.
8,042,344 B2 10/2011 Morimoto et al.
8,783,046 B2 7/2014 Doyle et al.
8,882,489 B1 11/2014 Coomer
9,080,800 B2 7/2015 Culley
9,163,867 B2 10/2015 Culley
9,200,823 B2 12/2015 Boarman et al.
9,273,891 B2 3/2016 Boarman et al.
9,310,116 B2 4/2016 Culley et al.
9,459,034 B2 10/2016 Boarman et al.
9,470,448 B2 10/2016 Culley et al.
9,476,629 B2 10/2016 Boarman
9,518,770 B2 12/2016 Boarman et al.
9,568,228 B2 2/2017 Joung et al.
9,581,372 B2 2/2017 Lee et al.
9,651,290 B2 5/2017 Boarman et al.
9,677,808 B2 6/2017 Culley et al.
9,696,079 B2 7/2017 Boarman et al.
9,733,003 B2 8/2017 Hoti
9,803,908 B2 10/2017 Amo
9,874,387 B2 1/2018 Jobb
9,890,986 B2 2/2018 Boarman
9,989,292 B2 6/2018 Culley
9,995,519 B2 6/2018 Boarman et al.
9,995,520 B2 6/2018 Toma
9,995,521 B2 6/2018 Mogilevsky
10,006,688 B2 6/2018 Zuccolo et al.
10,047,996 B2 8/2018 Boarman et al.
10,066,861 B2 9/2018 Gooden et al.
10,151,519 B2 12/2018 Little et al.
10,184,710 B2 1/2019 Goerz
10,539,354 B2 1/2020 Shi et al.
10,544,974 B2 1/2020 Goldfarbmuren et al.
10,605,511 B2 3/2020 Bertolini et al.
10,605,534 B2 3/2020 Persson
10,724,779 B2 7/2020 Flores
10,746,452 B2 8/2020 Chen et al.
10,746,453 B2 8/2020 Tarr et al.
10,760,843 B2 9/2020 Schoonen
10,788,250 B2 9/2020 Junge et al.
10,801,768 B2 10/2020 Junge et al.
2001/0027654 A1 10/2001 Shapiro et al.
2003/0129282 A1 7/2003 Solorio et al.
2004/0025527 A1 2/2004 Takahashi et al.
2004/0099004 A1 5/2004 Somura
2004/0206250 A1 10/2004 Kondou et al.
2004/0258805 A1 12/2004 Halevy et al.
2006/0286254 A1 12/2006 Weisberg
2006/0288726 A1 12/2006 Mori et al.
2007/0048429 A1 3/2007 Griffiths et al.
2008/0075820 A1 3/2008 Fernandez
2008/0092574 A1 4/2008 Doberstein
2009/0152438 A1 6/2009 Chu
2009/0208611 A1 8/2009 Williams
2011/0300264 A1 12/2011 Neta et al.
2012/0192584 A1 8/2012 Fiaschi
2012/0277906 A1 11/2012 Fassberg et al.
2012/0324915 A1* 12/2012 Bortoletto ..... F25C 1/18 62/340
2012/0324916 A1 12/2012 Bortoletto et al.
2013/0061626 A1 3/2013 Son et al.
2013/0221031 A1 8/2013 Guido
2013/0232992 A1 9/2013 Bisceglie
2013/0340462 A1 12/2013 Bush et al.
2014/0151928 A1 6/2014 Zhen et al.
2014/0165598 A1 6/2014 Boarman et al.
2014/0165602 A1 6/2014 Boarman
2014/0165618 A1 6/2014 Culley et al.
2014/0165619 A1 6/2014 Culley
2014/0165620 A1 6/2014 Culley
2014/0216072 A1 8/2014 Matsumoto
2015/0021458 A1 1/2015 Zorovich et al.
2015/0027142 A1 1/2015 Little et al.
2015/0040587 A1 2/2015 Zisholtz et al.
2015/0107275 A1 4/2015 Papalia
2016/0131406 A1 5/2016 Schoonen
2016/0201966 A1 7/2016 Nelson
2017/0038112 A1 2/2017 Papalia
2017/0042181 A1 2/2017 Fiaschi
2017/0082338 A1 3/2017 Wobrock et al.
2017/0122637 A1 5/2017 Mor
2018/0017303 A1 1/2018 Hsu
2018/0252454 A1 9/2018 Christensen et al.
2018/0306479 A1 10/2018 Vazquez

(56) References Cited

U.S. PATENT DOCUMENTS

| | | | | |
|---|---|---|---|---|
| 2019/0011158 | A1 | 1/2019 | Sul et al. | |
| 2019/0093933 | A1 | 3/2019 | Little et al. | |
| 2020/0025426 | A1 | 1/2020 | Wilkins et al. | |
| 2020/0041186 | A1* | 2/2020 | Junge | F25C 1/18 |
| 2020/0158402 | A1 | 5/2020 | Kim et al. | |

FOREIGN PATENT DOCUMENTS

| | | | | | |
|---|---|---|---|---|---|
| CN | 106949685 | | * | 7/2017 | F25C 1/04 |
| CN | 208606446 | U | | 3/2019 | |
| CN | 208804924 | U | | 4/2019 | |
| DE | 202004002823 | U1 | | 4/2004 | |
| EP | 0364686 | B1 | | 4/1990 | |
| FR | 2330977 | A1 | | 6/1977 | |
| JP | 01006664 | A | | 1/1989 | |
| JP | 03067973 | A | | 3/1991 | |
| JP | 03170759 | A | | 7/1991 | |
| JP | 2883315 | B2 | | 4/1999 | |
| JP | 3340185 | B2 | | 11/2002 | |
| JP | 2003279208 | A | | 10/2003 | |
| JP | 2016054654 | A | | 4/2016 | |
| JP | 2015154764 | A | | 10/2019 | |
| KR | 200317463 | Y1 | | 6/2003 | |
| KR | 20120064026 | A | | 6/2012 | |
| KR | 20120111710 | A | | 10/2012 | |
| KR | 101225651 | B1 | | 1/2013 | |
| KR | 20170052100 | A | | 5/2017 | |
| WO | 1990011481 | A2 | | 10/1990 | |
| WO | 2008061179 | A2 | | 5/2008 | |
| WO | 2014174314 | A2 | | 10/2014 | |
| WO | 2014178710 | A1 | | 11/2014 | |
| WO | 2017216294 | A1 | | 12/2017 | |
| WO | 2021092108 | A1 | | 5/2021 | |

OTHER PUBLICATIONS

Written Opinion from the International Searching Authority for PCT/US2020/059014 dated Feb. 2, 2021, 10 pages.

International Search Report and Written Opinion from the International Searching Authority for PCT/US2021/059988 dated Mar. 16, 2022, 15 pages.

* cited by examiner

Constant Varied

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -2 | |
| 2 | 8 | 8 | | | 100 | -2.1 | |
| 3 | 6 | 14 | | | 100 | -2.2 | |
| 4 | 6 | 20 | | | 100 | -2.3 | |
| 5 | 5 | 25 | | | 100 | -2.4 | |
| 6 | 5 | 30 | | | 100 | -2.5 | |
| 7 | 5 | 35 | | | 100 | -2.6 | |
| 8 | 5 | 40 | | | 100 | -2.7 | |
| 9 | 5 | 45 | | | 100 | -2.8 | |
| 10 | 5 | 50 | | | 100 | -2.9 | |
| 11 | 5 | 55 | | | 100 | -3 | |
| 12 | 5 | 60 | | | 100 | -3.1 | |
| 13 | 5 | 65 | | | 100 | -3.2 | |
| 14 | 5 | 70 | | | 100 | -3.3 | |
| 15 | 5 | 75 | | | 100 | -3.4 | |
| 16 | 5 | 80 | | | 100 | -3.5 | |
| 17 | 5 | 85 | | | 100 | -3.6 | |
| 18 | 5 | 90 | | | 100 | -3.7 | 0 |
| 19 | 5 | 95 | | | 100 | -3.8 | |
| 20 | 5 | 100 | | | 100 | -3.9 | |
| 21 | 5 | 105 | | | 100 | -4 | |
| 22 | 5 | 110 | | | 100 | -4.1 | |
| 23 | 5 | 115 | | | 100 | -4.2 | |
| 24 | 5 | 120 | | | 100 | -4.3 | |
| 25 | 5 | 125 | | | 100 | -4.4 | |
| 26 | 5 | 130 | | | 100 | -4.5 | |
| 27 | 5 | 135 | | | 100 | -4.6 | |
| 28 | 5 | 140 | | | 100 | -4.7 | |
| 29 | 5 | 145 | | | 100 | -4.8 | |
| 30 | 5 | 150 | | | 100 | -4.9 | |
| 31 | 5 | 155 | | | 100 | -5 | |
| 32 | 5 | 160 | | | 100 | -5.1 | |
| 33 | 5 | 165 | | | 100 | -5.2 | |
| 34 | 5 | 170 | | | 100 | -5.3 | |
| 35 | 5 | 175 | | | 100 | -5.4 | |
| 36 | 5 | 180 | | | 100 | -5.5 | |
| 37 | 5 | 185 | | | 100 | -5.6 | |
| 38 | 5 | 190 | | | 100 | -5.7 | |
| 39 | 5 | 195 | | | 100 | -5.8 | |
| 40 | 5 | 200 | | | 100 | -5.9 | |
| 41 | 5 | 205 | | | 100 | -6 | |
| 42 | 5 | 210 | | | 100 | -6.1 | |
| 43 | 5 | 215 | | | 100 | -6.2 | |
| 44 | 5 | 220 | | | 100 | -6.3 | |
| 45 | 5 | 225 | | | 100 | -6.4 | |
| 46 | 5 | 230 | | | 100 | -6.5 | |
| 47 | 5 | 235 | | | 100 | -6.6 | |
| 48 | 5 | 240 | | | 100 | -6.7 | |

FIG. 17A

Varied Constant

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -7 | |
| 2 | 8 | 8 | | | 98 | -7 | |
| 3 | 6 | 14 | | | 96 | -7 | |
| 4 | 6 | 20 | | | 94 | -7 | |
| 5 | 5 | 25 | | | 92 | -7 | |
| 6 | 5 | 30 | | | 90 | -7 | |
| 7 | 5 | 35 | | | 88 | -7 | |
| 8 | 5 | 40 | | | 86 | -7 | |
| 9 | 5 | 45 | | | 84 | -7 | |
| 10 | 5 | 50 | | | 82 | -7 | |
| 11 | 5 | 55 | | | 80 | -7 | |
| 12 | 5 | 60 | | | 78 | -7 | |
| 13 | 5 | 65 | | | 76 | -7 | |
| 14 | 5 | 70 | | | 74 | -7 | |
| 15 | 5 | 75 | | | 72 | -7 | |
| 16 | 5 | 80 | | | 70 | -7 | |
| 17 | 5 | 85 | | | 68 | -7 | |
| 18 | 5 | 90 | | | 66 | -7 | |
| 19 | 5 | 95 | | | 64 | -7 | |
| 20 | 5 | 100 | | | 62 | -7 | |
| 21 | 5 | 105 | | | 60 | -7 | |
| 22 | 5 | 110 | | | 58 | -7 | |
| 23 | 5 | 115 | | | 56 | -7 | |
| 24 | 5 | 120 | | | 54 | -7 | 0 |
| 25 | 5 | 125 | | | 52 | -7 | |
| 26 | 5 | 130 | | | 50 | -7 | |
| 27 | 5 | 135 | | | 48 | -7 | |
| 28 | 5 | 140 | | | 46 | -7 | |
| 29 | 5 | 145 | | | 44 | -7 | |
| 30 | 5 | 150 | | | 42 | -7 | |
| 31 | 5 | 155 | | | 40 | -7 | |
| 32 | 5 | 160 | | | 38 | -7 | |
| 33 | 5 | 165 | | | 36 | -7 | |
| 34 | 5 | 170 | | | 34 | -7 | |
| 35 | 5 | 175 | | | 32 | -7 | |
| 36 | 5 | 180 | | | 30 | -7 | |
| 37 | 5 | 185 | | | 28 | -7 | |
| 38 | 5 | 190 | | | 26 | -7 | |
| 39 | 5 | 195 | | | 24 | -7 | |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 14 | -7 | |
| 45 | 5 | 225 | | | 12 | -7 | |
| 46 | 5 | 230 | | | 10 | -7 | |
| 47 | 5 | 235 | | | 8 | -7 | |
| 48 | 5 | 240 | | | 6 | -7 | |

FIG. 18A

Varied Varied

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -2 | |
| 2 | 8 | 8 | | | 98 | -2.1 | |
| 3 | 6 | 14 | | | 96 | -2.2 | |
| 4 | 6 | 20 | | | 94 | -2.3 | |
| 5 | 5 | 25 | | | 92 | -2.4 | |
| 6 | 5 | 30 | | | 90 | -2.5 | |
| 7 | 5 | 35 | | | 88 | -2.6 | |
| 8 | 5 | 40 | | | 86 | -2.7 | |
| 9 | 5 | 45 | | | 84 | -2.8 | |
| 10 | 5 | 50 | | | 82 | -2.9 | |
| 11 | 5 | 55 | | | 80 | -3 | |
| 12 | 5 | 60 | | | 78 | -3.1 | |
| 13 | 5 | 65 | | | 76 | -3.2 | |
| 14 | 5 | 70 | | | 74 | -3.3 | |
| 15 | 5 | 75 | | | 72 | -3.4 | |
| 16 | 5 | 80 | | | 70 | -3.5 | |
| 17 | 5 | 85 | | | 68 | -3.6 | |
| 18 | 5 | 90 | | | 66 | -3.7 | |
| 19 | 5 | 95 | | | 64 | -3.8 | |
| 20 | 5 | 100 | | | 62 | -3.9 | |
| 21 | 5 | 105 | | | 60 | -4 | |
| 22 | 5 | 110 | | | 58 | -4.1 | |
| 23 | 5 | 115 | | | 56 | -4.2 | |
| 24 | 5 | 120 | | | 54 | -4.3 | 0 |
| 25 | 5 | 125 | | | 52 | -4.4 | |
| 26 | 5 | 130 | | | 50 | -4.5 | |
| 27 | 5 | 135 | | | 48 | -4.6 | |
| 28 | 5 | 140 | | | 46 | -4.7 | |
| 29 | 5 | 145 | | | 44 | -4.8 | |
| 30 | 5 | 150 | | | 42 | -4.9 | |
| 31 | 5 | 155 | | | 40 | -5 | |
| 32 | 5 | 160 | | | 38 | -5.1 | |
| 33 | 5 | 165 | | | 36 | -5.2 | |
| 34 | 5 | 170 | | | 34 | -5.3 | |
| 35 | 5 | 175 | | | 32 | -5.4 | |
| 36 | 5 | 180 | | | 30 | -5.5 | |
| 37 | 5 | 185 | | | 28 | -5.6 | |
| 38 | 5 | 190 | | | 26 | -5.7 | |
| 39 | 5 | 195 | | | 24 | -5.8 | |
| 40 | 5 | 200 | | | 22 | -5.9 | |
| 41 | 5 | 205 | | | 20 | -6 | |
| 42 | 5 | 210 | | | 18 | -6.1 | |
| 43 | 5 | 215 | | | 16 | -6.2 | |
| 44 | 5 | 220 | | | 14 | -6.3 | |
| 45 | 5 | 225 | | | 12 | -6.4 | |
| 46 | 5 | 230 | | | 10 | -6.5 | |
| 47 | 5 | 235 | | | 8 | -6.6 | |
| 48 | 5 | 240 | | | 6 | -6.7 | |

FIG. 19A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | Initial cool down |
| 2 | 8 | 8 | | | 98 | -2 | |
| 3 | 6 | 14 | | | 96 | -2.2 | |
| 4 | 6 | 20 | | | 94 | -2.4 | |
| 5 | 5 | 25 | | | 92 | -2.6 | |
| 6 | 5 | 30 | | | 90 | -2.8 | |
| 7 | 5 | 35 | | | 88 | -3 | |
| 8 | 5 | 40 | | | 86 | -3.2 | |
| 9 | 5 | 45 | | | 84 | -3.4 | |
| 10 | 5 | 50 | | | 82 | -3.6 | |
| 11 | 5 | 55 | | | 80 | -3.8 | |
| 12 | 5 | 60 | | | 78 | -4 | |
| 13 | 5 | 65 | | | 76 | -4.2 | |
| 14 | 5 | 70 | | | 74 | -4.4 | |
| 15 | 5 | 75 | | | 72 | -4.6 | |
| 16 | 5 | 80 | | | 70 | -4.8 | |
| 17 | 5 | 85 | | | 68 | -5 | |
| 18 | 5 | 90 | | | 66 | -5.2 | |
| 19 | 5 | 95 | | | 64 | -5.4 | |
| 20 | 5 | 100 | | | 62 | -5.6 | |
| 21 | 5 | 105 | | | 60 | -5.8 | |
| 22 | 5 | 110 | | | 58 | -6 | |
| 23 | 5 | 115 | | | 56 | -6.2 | |
| 24 | 5 | 120 | | | 54 | -6.4 | 0 |
| 25 | 5 | 125 | | | 52 | -6.6 | |
| 26 | 5 | 130 | | | 50 | -6.8 | |
| 27 | 5 | 135 | | | 48 | -7 | |
| 28 | 5 | 140 | | | 46 | -7 | |
| 29 | 5 | 145 | | | 44 | -7 | |
| 30 | 5 | 150 | | | 42 | -7 | |
| 31 | 5 | 155 | | | 40 | -7 | |
| 32 | 5 | 160 | | | 38 | -7 | |
| 33 | 5 | 165 | | | 36 | -7 | |
| 34 | 5 | 170 | | | 34 | -7 | |
| 35 | 5 | 175 | | | 32 | -7 | |
| 36 | 5 | 180 | | | 30 | -7 | |
| 37 | 5 | 185 | | | 28 | -7 | End plateau |
| 38 | 5 | 190 | | | 26 | -7 | |
| 39 | 5 | 195 | | | 24 | -7 | |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 14 | -7 | |
| 45 | 5 | 225 | | | 12 | -7 | |
| 46 | 5 | 230 | | | 10 | -7 | |
| 47 | 5 | 235 | | | 8 | -7 | |

FIG. 20A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | Initial cool down |
| 2 | 8 | 8 | | | 98 | -2 | |
| 3 | 6 | 14 | | | 96 | -2.2 | |
| 4 | 6 | 20 | | | 94 | -2.4 | |
| 5 | 5 | 25 | | | 92 | -2.6 | |
| 6 | 5 | 30 | | | 90 | -2.8 | |
| 7 | 5 | 35 | | | 88 | -3 | |
| 8 | 5 | 40 | | | 86 | -3.2 | |
| 9 | 5 | 45 | | | 84 | -3.4 | |
| 10 | 5 | 50 | | | 82 | -3.6 | |
| 11 | 5 | 55 | | | 80 | -3.8 | |
| 12 | 5 | 60 | | | 78 | -4 | |
| 13 | 5 | 65 | | | 76 | -4.2 | |
| 14 | 5 | 70 | | | 74 | -4.4 | |
| 15 | 5 | 75 | | | 72 | -4.6 | |
| 16 | 5 | 80 | | | 70 | -4.8 | |
| 17 | 5 | 85 | | | 68 | -5 | |
| 18 | 5 | 90 | | | 66 | -5.2 | |
| 19 | 5 | 95 | | | 64 | -5.4 | |
| 20 | 5 | 100 | | | 62 | -5.6 | |
| 21 | 5 | 105 | | | 60 | -5.8 | |
| 22 | 5 | 110 | | | 58 | -6 | |
| 23 | 5 | 115 | | | 56 | -6.2 | |
| 24 | 5 | 120 | | | 54 | -6.4 | 0 |
| 25 | 5 | 125 | | | 52 | -6.6 | |
| 26 | 5 | 130 | | | 50 | -6.8 | |
| 27 | 5 | 135 | | | 48 | -7 | |
| 28 | 5 | 140 | | | 46 | -7 | |
| 29 | 5 | 145 | | | 44 | -7 | |
| 30 | 5 | 150 | | | 42 | -7 | |
| 31 | 5 | 155 | | | 40 | -7 | |
| 32 | 5 | 160 | | | 38 | -7 | |
| 33 | 5 | 165 | | | 36 | -7 | |
| 34 | 5 | 170 | | | 34 | -7 | |
| 35 | 5 | 175 | | | 32 | -7 | End plateau |
| 36 | 5 | 180 | | | 30 | -7 | |
| 37 | 5 | 185 | | | 28 | -7 | |
| 38 | 5 | 190 | | | 26 | -7 | |
| 39 | 5 | 195 | | | 24 | -7 | |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 0 | 0 | |
| 45 | 5 | 225 | | | 0 | 0 | |
| 46 | 5 | 230 | | | 0 | 10 | Annealing |
| 47 | 5 | 235 | | | 0 | 10 | |
| 48 | 5 | 240 | | | 0 | 10 | |

FIG. 21A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | Initial cool down |
| 2 | 8 | 8 | | | 98 | -2 | |
| 3 | 6 | 14 | | | 96 | -2.2 | |
| 4 | 6 | 20 | | | 94 | -2.4 | |
| 5 | 5 | 25 | | | 92 | -2.6 | |
| 6 | 5 | 30 | | | 90 | -2.8 | |
| 7 | 5 | 35 | | | 88 | -3 | |
| 8 | 5 | 40 | | | 86 | -3.2 | |
| 9 | 5 | 45 | | | 84 | -3.4 | |
| 10 | 5 | 50 | | | 82 | -3.6 | |
| 11 | 5 | 55 | | | 80 | -3.8 | |
| 12 | 5 | 60 | | | 78 | -4 | |
| 13 | 5 | 65 | | | 76 | -4 | |
| 14 | 5 | 70 | | | 74 | -4 | |
| 15 | 5 | 75 | | | 72 | -4 | |
| 16 | 5 | 80 | | | 70 | -4 | Mid plateau |
| 17 | 5 | 85 | | | 68 | -4 | |
| 18 | 5 | 90 | | | 66 | -4 | |
| 19 | 5 | 95 | | | 64 | -4 | |
| 20 | 5 | 100 | | | 62 | -4 | |
| 21 | 5 | 105 | | | 60 | -4.2 | |
| 22 | 5 | 110 | | | 58 | -4.4 | |
| 23 | 5 | 115 | | | 56 | -4.6 | |
| 24 | 5 | 120 | | | 54 | -4.8 | 0 |
| 25 | 5 | 125 | | | 52 | -5 | |
| 26 | 5 | 130 | | | 50 | -5.2 | |
| 27 | 5 | 135 | | | 48 | -5.4 | |
| 28 | 5 | 140 | | | 46 | -5.6 | |
| 29 | 5 | 145 | | | 44 | -5.8 | |
| 30 | 5 | 150 | | | 42 | -6 | |
| 31 | 5 | 155 | | | 40 | -6.2 | |
| 32 | 5 | 160 | | | 38 | -6.4 | |
| 33 | 5 | 165 | | | 36 | -6.6 | |
| 34 | 5 | 170 | | | 34 | -6.8 | |
| 35 | 5 | 175 | | | 32 | -7 | |
| 36 | 5 | 180 | | | 30 | -7 | |
| 37 | 5 | 185 | | | 28 | -7 | |
| 38 | 5 | 190 | | | 26 | -7 | |
| 39 | 5 | 195 | | | 24 | -7 | End plateau |
| 40 | 5 | 200 | | | 22 | -7 | |
| 41 | 5 | 205 | | | 20 | -7 | |
| 42 | 5 | 210 | | | 18 | -7 | |
| 43 | 5 | 215 | | | 16 | -7 | |
| 44 | 5 | 220 | | | 0 | 0 | |
| 45 | 5 | 225 | | | 0 | 0 | |
| 46 | 5 | 230 | | | 0 | 10 | Annealing |
| 47 | 5 | 235 | | | 0 | 10 | |
| 48 | 5 | 240 | | | 0 | 10 | |

FIG. 22A

Shifts from outer to inner over time

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | 90 | 10 | 100 | -10 | Initial cool down |
| 2 | 8 | 8 | 88 | 12 | 98 | -2 | |
| 3 | 6 | 14 | 86 | 14 | 96 | -2.2 | |
| 4 | 6 | 20 | 84 | 16 | 94 | -2.4 | |
| 5 | 5 | 25 | 82 | 18 | 92 | -2.6 | |
| 6 | 5 | 30 | 80 | 20 | 90 | -2.8 | |
| 7 | 5 | 35 | 78 | 22 | 88 | -3 | |
| 8 | 5 | 40 | 76 | 24 | 86 | -3.2 | |
| 9 | 5 | 45 | 74 | 26 | 84 | -3.4 | |
| 10 | 5 | 50 | 72 | 28 | 82 | -3.6 | |
| 11 | 5 | 55 | 70 | 30 | 80 | -3.8 | |
| 12 | 5 | 60 | 68 | 32 | 78 | -4 | |
| 13 | 5 | 65 | 66 | 34 | 76 | -4 | |
| 14 | 5 | 70 | 64 | 36 | 74 | -4 | |
| 15 | 5 | 75 | 62 | 38 | 72 | -4 | |
| 16 | 5 | 80 | 60 | 40 | 70 | -4 | Mid plateau |
| 17 | 5 | 85 | 58 | 42 | 68 | -4 | |
| 18 | 5 | 90 | 56 | 44 | 66 | -4 | |
| 19 | 5 | 95 | 54 | 46 | 64 | -4 | |
| 20 | 5 | 100 | 52 | 48 | 62 | -4 | |
| 21 | 5 | 105 | 50 | 50 | 60 | -4.2 | |
| 22 | 5 | 110 | 48 | 52 | 58 | -4.4 | |
| 23 | 5 | 115 | 46 | 54 | 56 | -4.6 | |
| 24 | 5 | 120 | 44 | 56 | 54 | -4.8 | 0 |
| 25 | 5 | 125 | 42 | 58 | 52 | -5 | |
| 26 | 5 | 130 | 40 | 60 | 50 | -5.2 | |
| 27 | 5 | 135 | 38 | 62 | 48 | -5.4 | |
| 28 | 5 | 140 | 36 | 64 | 46 | -5.6 | |
| 29 | 5 | 145 | 34 | 66 | 44 | -5.8 | |
| 30 | 5 | 150 | 32 | 68 | 42 | -6 | |
| 31 | 5 | 155 | 30 | 70 | 40 | -6.2 | |
| 32 | 5 | 160 | 28 | 72 | 38 | -6.4 | |
| 33 | 5 | 165 | 26 | 74 | 36 | -6.6 | |
| 34 | 5 | 170 | 24 | 76 | 34 | -6.8 | |
| 35 | 5 | 175 | 22 | 78 | 32 | -7 | |
| 36 | 5 | 180 | 20 | 80 | 30 | -7 | |
| 37 | 5 | 185 | 18 | 82 | 28 | -7 | |
| 38 | 5 | 190 | 16 | 84 | 26 | -7 | |
| 39 | 5 | 195 | 14 | 86 | 24 | -7 | End plateau |
| 40 | 5 | 200 | 12 | 88 | 22 | -7 | |
| 41 | 5 | 205 | 10 | 90 | 20 | -7 | |
| 42 | 5 | 210 | 8 | 92 | 18 | -7 | |
| 43 | 5 | 215 | 6 | 94 | 16 | -7 | |
| 44 | 5 | 220 | 4 | 96 | 0 | 0 | |
| 45 | 5 | 225 | 2 | 98 | 0 | 0 | |
| 46 | 5 | 230 | 0 | 100 | 0 | 10 | Annealing |
| 47 | 5 | 235 | | | 0 | 10 | |
| 48 | 5 | 240 | | | 0 | 10 | |

FIG. 23A

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | | | 100 | -10 | |
| 2 | 8 | 8 | | | 97 | -2 | |
| 3 | 6 | 14 | | | 94 | -2.2 | |
| 4 | 6 | 20 | | | 91 | -2.4 | |
| 5 | 5 | 25 | | | 88 | -2.6 | |
| 6 | 5 | 30 | | | 85 | -2.8 | |
| 7 | 5 | 35 | | | 82 | -3 | |
| 8 | 5 | 40 | | | 79 | -3.2 | |
| 9 | 5 | 45 | | | 76 | -3.4 | |
| 10 | 5 | 50 | | | 73 | -3.6 | |
| 11 | 5 | 55 | | | 70 | -3.8 | |
| 12 | 5 | 60 | | | 67 | -4 | |
| 13 | 5 | 65 | | | 64 | -4 | |
| 14 | 5 | 70 | | | 61 | -4 | |
| 15 | 5 | 75 | | | 58 | -4 | |
| 16 | 5 | 80 | | | 55 | -4 | |
| 17 | 5 | 85 | | | 52 | -4 | |
| 18 | 5 | 90 | | | 49 | -4 | |
| 19 | 5 | 95 | | | 46 | -4 | |
| 20 | 5 | 100 | | | 43 | -4 | |
| 21 | 5 | 105 | | | 40 | -4.2 | |
| 22 | 5 | 110 | | | 37 | -4.4 | |
| 23 | 5 | 115 | | | 34 | -4.6 | |
| 24 | 5 | 120 | | | 31 | -4.8 | 0 |
| 25 | 5 | 125 | | | 28 | -5 | |
| 26 | 5 | 130 | | | 25 | -5.2 | |
| 27 | 5 | 135 | | | 22 | -5.4 | |
| 28 | 5 | 140 | | | -30 | -5.6 | |
| 29 | 5 | 145 | | | -28 | -5.8 | |
| 30 | 5 | 150 | | | -26 | -6 | |
| 31 | 5 | 155 | | | -24 | -6.2 | |
| 32 | 5 | 160 | | | -22 | -6.4 | |
| 33 | 5 | 165 | | | -20 | -6.6 | |
| 34 | 5 | 170 | | | -18 | -6.8 | |
| 35 | 5 | 175 | | | -16 | -7 | |
| 36 | 5 | 180 | | | -14 | -7 | |
| 37 | 5 | 185 | | | -12 | -7 | |
| 38 | 5 | 190 | | | -10 | -7 | |
| 39 | 5 | 195 | | | -8 | -7 | |
| 40 | 5 | 200 | | | -6 | -7 | |
| 41 | 5 | 205 | | | -4 | -7 | |
| 42 | 5 | 210 | | | -2 | -7 | |
| 43 | 5 | 215 | | | 0 | -7 | |
| 44 | 5 | 220 | | | 0 | 0 | |
| 45 | 5 | 225 | | | 0 | 0 | |
| 46 | 5 | 230 | | | 0 | 10 | |
| 47 | 5 | 235 | | | 0 | 10 | |
| 48 | 5 | 240 | | | 0 | 10 | |

Initial cool down

Mid plateau

Flow reversal

End plateau

Annealing

FIG. 24A

Shifts from outer to inner over time

| Step # | Time Step (min) | Total Time (min) | Flow Outer (%) | Flow Inner (%) | Flow (%) | Temp (°C) | Inclusion Utensil Retraction |
|---|---|---|---|---|---|---|---|
| 1 | 0 | 0 | 90 | 10 | 100 | -10 | Initial cool down |
| 2 | 8 | 8 | 88 | 12 | 97 | -2 | |
| 3 | 6 | 14 | 86 | 14 | 94 | -2.2 | |
| 4 | 6 | 20 | 84 | 16 | 91 | -2.4 | |
| 5 | 5 | 25 | 82 | 18 | 88 | -2.6 | |
| 6 | 5 | 30 | 80 | 20 | 85 | -2.8 | |
| 7 | 5 | 35 | 78 | 22 | 82 | -3 | |
| 8 | 5 | 40 | 76 | 24 | 79 | -3.2 | |
| 9 | 5 | 45 | 74 | 26 | 76 | -3.4 | |
| 10 | 5 | 50 | 72 | 28 | 73 | -3.6 | |
| 11 | 5 | 55 | 70 | 30 | 70 | -3.8 | |
| 12 | 5 | 60 | 68 | 32 | 67 | -4 | |
| 13 | 5 | 65 | 66 | 34 | 64 | -4 | |
| 14 | 5 | 70 | 64 | 36 | 61 | -4 | |
| 15 | 5 | 75 | 62 | 38 | 58 | -4 | |
| 16 | 5 | 80 | 60 | 40 | 55 | -4 | Mid plateau |
| 17 | 5 | 85 | 58 | 42 | 52 | -4 | |
| 18 | 5 | 90 | 56 | 44 | 49 | -4 | |
| 19 | 5 | 95 | 54 | 46 | 46 | -4 | |
| 20 | 5 | 100 | 52 | 48 | 43 | -4 | |
| 21 | 5 | 105 | 50 | 50 | 40 | -4.2 | |
| 22 | 5 | 110 | 50 | 50 | 37 | -4.4 | |
| 23 | 5 | 115 | 50 | 50 | 34 | -4.6 | |
| 24 | 5 | 120 | 50 | 50 | 31 | -4.8 | 0 |
| 25 | 5 | 125 | 50 | 50 | 28 | -5 | |
| 26 | 5 | 130 | 50 | 50 | 25 | -5.2 | |
| 27 | 5 | 135 | 0 | 100 | -33 | -5.4 | |
| 28 | 5 | 140 | 0 | 100 | -30 | -5.6 | |
| 29 | 5 | 145 | 0 | 100 | -28 | -5.8 | |
| 30 | 5 | 150 | 0 | 100 | -26 | -6 | |
| 31 | 5 | 155 | 0 | 100 | -24 | -6.2 | |
| 32 | 5 | 160 | 0 | 100 | -22 | -6.4 | |
| 33 | 5 | 165 | 0 | 100 | -20 | -6.6 | |
| 34 | 5 | 170 | 0 | 100 | -18 | -6.8 | |
| 35 | 5 | 175 | 0 | 100 | -16 | -7 | |
| 36 | 5 | 180 | 0 | 100 | -14 | -7 | |
| 37 | 5 | 185 | 0 | 100 | -12 | -7 | |
| 38 | 5 | 190 | 0 | 100 | -10 | -7 | |
| 39 | 5 | 195 | 0 | 100 | -8 | -7 | End plateau |
| 40 | 5 | 200 | 0 | 100 | -6 | -7 | |
| 41 | 5 | 205 | 0 | 100 | -4 | -7 | |
| 42 | 5 | 210 | 0 | 100 | -2 | -7 | |
| 43 | 5 | 215 | 0 | 100 | 0 | -7 | |
| 44 | 5 | 220 | 0 | 100 | 0 | 0 | |
| 45 | 5 | 225 | 0 | 100 | 0 | 0 | |
| 46 | 5 | 230 | 0 | 100 | 0 | 10 | Annealing |
| 47 | 5 | 235 | 0 | 100 | 0 | 10 | |
| 48 | 5 | 240 | 0 | 100 | 0 | 10 | |

Flow reversal

FIG. 25A

FIG. 26

| | 3" Round shape w/vertical sides | | 3" Round shape with 8.5-degree sides | | 3" Round shape with 3.16-degree sides | | 3" round shape with 2-degree sides | | 3" round shape with 1-degree sides | |
|---|---|---|---|---|---|---|---|---|---|---|
| Height from bottom (mm) | W | t | W | t | W | t | W | t | W | t |
| 0.0 | 0.00 | 0 | 0.00 | 0 | 0.00 | 0 | 0.00 | 0 | 0.00 | 0 |
| 5.0 | 18.87 | 1,189 | 18.87 | 1,189 | 18.87 | 1,189 | 18.87 | 1,189 | 18.87 | 1,189 |
| 10.0 | 25.73 | 2,211 | 25.73 | 2,211 | 25.73 | 2,211 | 25.73 | 2,211 | 25.73 | 2,211 |
| 15.0 | 30.30 | 3,066 | 30.30 | 3,066 | 30.30 | 3,066 | 30.30 | 3,066 | 30.30 | 3,066 |
| 20.0 | 33.53 | 3,754 | 33.53 | 3,754 | 33.53 | 3,754 | 33.53 | 3,754 | 33.53 | 3,754 |
| 25.0 | 35.78 | 4,275 | 35.78 | 4,275 | 35.78 | 4,275 | 35.78 | 4,275 | 35.78 | 4,275 |
| 30.0 | 37.23 | 4,629 | 37.23 | 4,629 | 37.23 | 4,629 | 37.23 | 4,629 | 37.23 | 4,629 |
| 35.0 | 37.97 | 4,816 | 37.97 | 4,816 | 37.97 | 4,816 | 37.97 | 4,816 | 37.97 | 4,816 |
| 37.0 | 38.08 | 4,844 | 38.08 | 4,844 | 38.08 | 4,844 | 38.08 | 4,844 | 38.08 | 4,844 |
| 38.1 | 38.10 | 4,848 | 38.72 | 5,007 | 38.14 | 4,860 | 38.12 | 4,854 | 38.10 | 4,849 |
| 40.0 | 38.10 | 4,848 | 39.46 | 5,201 | 38.25 | 4,887 | 38.19 | 4,871 | 38.14 | 4,858 |
| 45.0 | 38.10 | 4,848 | 40.21 | 5,400 | 38.53 | 4,957 | 38.36 | 4,916 | 38.22 | 4,880 |
| 50.0 | 38.10 | 4,848 | 40.95 | 5,601 | 38.80 | 5,029 | 38.54 | 4,961 | 38.31 | 4,902 |
| 55.0 | 38.10 | 4,848 | 41.70 | 5,807 | 39.08 | 5,101 | 38.71 | 5,006 | 38.40 | 4,925 |
| 60.0 | 38.10 | 4,848 | 42.44 | 6,016 | 39.35 | 5,173 | 38.89 | 5,051 | 38.49 | 4,947 |
| 65.0 | 38.10 | 4,848 | 43.19 | 6,229 | 39.63 | 5,246 | 39.06 | 5,096 | 38.57 | 4,969 |
| 70.0 | 38.10 | 4,848 | 43.93 | 6,446 | 39.91 | 5,319 | 39.24 | 5,142 | 38.66 | 4,992 |
| 75.0 | 38.10 | 4,848 | 44.68 | 6,666 | 40.18 | 5,393 | 39.41 | 5,188 | 38.75 | 5,015 |
| 80.0 | 38.10 | 4,848 | 45.42 | 6,890 | 40.46 | 5,467 | 39.59 | 5,234 | 38.83 | 5,037 |
| 85.0 | 38.10 | 4,848 | 46.16 | 7,118 | 40.73 | 5,542 | 39.76 | 5,280 | 38.92 | 5,060 |
| | | | | | | | | | | |
| slope | | 0 | | 0.15 | | 0.06 | | 0.03 | | 0.02 |
| angle (radians) | | 0 | | 0.15 | | 0.06 | | 0.03 | | 0.02 |
| angle (degrees) | | 0 | | 8.47 | | 3.16 | | 2.00 | | 1.00 |
| Time increment for 5mm height | | 0 | | 228 | | 75 | | 46 | | 23 |

FIG. 27

| Time (seconds) | Time (minutes) | Starting stress (MPa) | Starting ice thickness (mm) | Cold plate temp (°C) | Growth rate of ice (mm/s) | Internal stress (MPa) | Stress halving time (seconds) |
|---|---|---|---|---|---|---|---|
| 0 | 0 | 0 | 0.500000 | -2.1 | 0.031516 | 1 | 129.7 |
| 129.7 | 2 | 0.5 | 4.586092 | -3.2 | 0.005154 | 1 | 148.4 |
| 278.1 | 5 | 0.5 | 5.351032 | -4.2 | 0.005890 | 1 | 170.1 |
| 448.1 | 7 | 0.5 | 6.352718 | -5.3 | 0.006201 | 1 | 195.1 |
| 643.2 | 11 | 0.5 | 7.562608 | -6.3 | 0.006251 | 1 | 224.1 |
| 867.3 | 14 | 0.5 | 8.963199 | -7.4 | 0.006153 | 1 | 257.6 |
| 1124.9 | 19 | 0.5 | 10.548236 | -8.4 | 0.005976 | 1 | 296.5 |
| 1421.4 | 24 | 0.5 | 12.319851 | -9.5 | 0.005756 | 1 | 341.6 |
| 1763.0 | 29 | 0.5 | 14.286101 | -10.5 | 0.005515 | 1 | 394.1 |
| 2157.0 | 36 | 0.5 | 16.459422 | -11.6 | 0.005266 | 1 | 455.1 |
| 2612.1 | 44 | 0.5 | 18.855779 | -12.6 | 0.005014 | 1 | 526.2 |
| 3138.3 | 52 | 0.5 | 21.494246 | -13.7 | 0.004765 | 1 | 609.1 |
| 3747.5 | 62 | 0.5 | 24.396858 | -14.7 | 0.004521 | 1 | 705.9 |
| 4453.4 | 74 | 0.5 | 27.588640 | -15.8 | 0.004284 | 1 | 819.2 |
| 5272.5 | 88 | 0.5 | 31.097740 | -16.8 | 0.004054 | 1 | 951.7 |
| 6224.2 | 104 | 0.5 | 34.955653 | -17.9 | 0.003832 | 1 | 1107.0 |
| 7331.2 | 122 | 0.5 | 39.197516 | -18.9 | 0.003618 | 1 | 1289.3 |
| 8620.6 | 144 | 0.5 | 43.862469 | -20.0 | 0.003413 | 1 | 1503.6 |
| 10124.1 | 169 | 0.5 | 48.994070 | -21.1 | 0.003216 | 1 | 1755.7 |
| 11879.8 | 198 | 0.5 | 54.640783 | -22.1 | 0.003028 | 1 | 2052.7 |
| 13932.5 | 232 | 0.5 | 60.856530 | -23.2 | 0.002848 | 1 | 2403.1 |
| 16335.6 | 272 | 0.5 | 67.701321 | -24.2 | 0.002677 | 1 | 2817.1 |
| 19152.7 | 319 | 0.5 | 75.241964 | -25.3 | 0.002513 | 1 | 3306.9 |
| 22459.7 | 374 | 0.5 | 83.552871 | -26.3 | 0.002357 | 1 | 3887.2 |
| 26346.9 | 439 | 0.5 | 92.716968 | -27.4 | 0.002209 | 1 | 4575.7 |
| 30922.6 | 515 | 0.5 | 102.826727 | -28.4 | 0.002069 | 1 | 5393.6 |
| 36316.2 | 605 | 0.5 | 113.985322 | -29.5 | 0.001935 | 1 | 6366.8 |
| 42683.1 | 711 | 0.5 | 126.307953 | -30.5 | 0.001809 | 1 | 7526.5 |
| 50209.6 | 837 | 0.5 | 139.923333 | -31.6 | 0.001689 | 1 | 8910.3 |

FIG. 28

| | | | | | Ice-water surface area | | | | | | | |
|---|---|---|---|---|---|---|---|---|---|---|---|---|
| Time (seconds) | Time (minutes) | Starting stress | Starting ice thickness (mm) | Cold plate temp (°C) | Base Wall Length | Side Wall length | Total perimeter | total surface area (mm^2) | log-mean area (mm^2) | Heat flow, Q (J/s) | Growth rate of ice (mm/s) | Internal stress (MPa) |
| 0 | 0 | 0 | 0.50 | -2.1 | 118 | 50.8 | 220.75 | 403,709 | 404,263 | 4,255 | 0.031559 | 1 |
| 129.7 | 2 | 0.5 | 4.59 | -3.2 | 105 | 50.7 | 215.79 | 394,644 | 399,709 | 687 | 0.005214 | 1 |
| 278.1 | 5 | 0.5 | 5.37 | -4.2 | 103 | 50.6 | 214.86 | 392,930 | 398,844 | 782 | 0.005962 | 1 |
| 448.1 | 7 | 0.5 | 6.38 | -5.3 | 100 | 50.6 | 213.63 | 390,683 | 397,708 | 820 | 0.006286 | 1 |
| 643.2 | 11 | 0.5 | 7.61 | -6.3 | 96 | 50.6 | 212.14 | 387,966 | 396,332 | 823 | 0.006349 | 1 |
| 867.3 | 14 | 0.5 | 9.03 | -7.4 | 91 | 50.5 | 210.42 | 384,814 | 394,731 | 805 | 0.006266 | 1 |
| 1124.9 | 19 | 0.5 | 10.64 | -8.4 | 86 | 50.5 | 208.46 | 381,238 | 392,910 | 777 | 0.006104 | 1 |
| 1421.4 | 24 | 0.5 | 12.45 | -9.5 | 81 | 50.4 | 206.27 | 377,229 | 390,861 | 743 | 0.005900 | 1 |
| 1763.0 | 29 | 0.5 | 14.47 | -10.5 | 74 | 50.3 | 203.83 | 372,764 | 388,570 | 707 | 0.005677 | 1 |
| 2157.0 | 36 | 0.5 | 16.70 | -11.6 | 67 | 50.2 | 201.12 | 367,808 | 386,017 | 669 | 0.005445 | 1 |
| 2612.1 | 44 | 0.5 | 19.18 | -12.6 | 59 | 50.2 | 198.12 | 362,318 | 383,175 | 631 | 0.005212 | 1 |
| 3138.3 | 52 | 0.5 | 21.93 | -13.7 | 51 | 50.1 | 194.79 | 356,241 | 380,012 | 593 | 0.004983 | 1 |
| 3747.5 | 62 | 0.5 | 24.96 | -14.7 | 41 | 50.0 | 191.12 | 349,516 | 376,490 | 556 | 0.004760 | 1 |
| 4453.4 | 74 | 0.5 | 28.32 | -15.8 | 31 | 49.8 | 187.05 | 342,072 | 372,564 | 519 | 0.004545 | 1 |
| 5272.5 | 88 | 0.5 | 32.04 | -16.8 | 19 | 49.7 | 182.54 | 333,823 | 368,180 | 484 | 0.004339 | 1 |
| 6224.2 | 104 | 0.5 | 36.17 | -17.9 | 6 | 49.6 | 177.53 | 324,675 | 363,274 | 449 | 0.004143 | 1 |
| 7331.2 | 122 | 0.5 | 40.76 | -18.9 | 0 | 0.0 | 81.52 | 149,084 | 256,008 | 298 | 0.005975 | 1 |

DEVICES FOR PRODUCING CLEAR ICE PRODUCTS AND RELATED METHODS

CROSS-REFERENCE TO RELATED APPLICATIONS

This application claims the priority benefit of U.S. Provisional Application No. 63/276,506, filed on Nov. 5, 2021, and the priority benefit of U.S. Provisional Application No. 63/116,453, filed on Nov. 20, 2020, the disclosures of which are herein incorporated by reference in their entireties.

INCORPORATION BY REFERENCE

All publications and patent applications mentioned in this specification are herein incorporated by reference in their entirety, as if each individual publication or patent application was specifically and individually indicated to be incorporated by reference in its entirety.

TECHNICAL FIELD

This disclosure relates generally to the field of ice manufacturing, and more specifically to the field of clear ice manufacturing. Described herein are devices and methods for producing clear ice.

BACKGROUND

From the end of the prohibition era to modern day, craft cocktails are a mainstay in most restaurants and bars. To enhance the overall experience, some restaurants and bars add garnishes and/or specialty ice to the cocktails. Currently, these restaurants and bars buy large blocks of ice that are then cut down in-house to the appropriate size for each drink. Some companies in the space claim to produce clear ice using directional freezing, but the clarity of the ice and scalability of the technology are questionable with many techniques often requiring the use of dangerous saws to cut down larger blocks of ice. Further, issues with standard ice machines include cracking, trapped air bubbles, and water impurities resulting in ice that lacks the desired appeal and appearance.

Ice can crack under a variety of circumstances experienced during or after a freezing process. Sometimes, during the freezing process, when the exterior of the ice freezes first and then further cools during subsequent freezing, interior tension in the ice is created. This interior tension causes cracking of the ice when it exceeds a certain threshold (e.g., about 1 MPa). Unclear ice may result from super cooling. Water crystallizes around nucleation sites. The ice then grows from this point forming a near perfect lattice structure, given the proper environment. For example, some ice machines slightly super cool the water before freezing. This causes smaller, faster crystallization, which can lead to uneven pressure and greater cloudiness. Lastly, impurities in the water used for freezing can create unclear ice. While impurities play a role in the imperfections in ice, they often aren't the main culprit. Filtered water has on average 30 ppm impurities In other cases, some ice machines create cloudy ice because the water contains dissolved air, whereas clear ice contains almost none. During the freezing process, as water turns to ice, and the remaining water reaches saturation level for dissolved gases, the dissolved gas comes out of solution. The gas bubbles stick to the ice-water interface due to surface adhesion. If these gas bubbles do not get released, they become frozen into the ice, resulting in optical imperfections which affect the straight passage of light (i.e., "cloudiness").

Furthermore, many extant clear ice machines produce large and unwieldly blocks that are far too large for convenient use in a cocktail as a comestible. In addition to the long freezing times usually required to produce them, often around 24 to 72 hours, these large blocks must be cut down to a size useful as a comestible. Much time and effort then, is expended to produce even a simple and solid shape of clear ice for use in a cocktail.

Taken together, improper ice freezing techniques and equipment result in less-than-ideal ice for the booming craft cocktail industry. Thus, there is a need for new and useful devices and methods for creating clear ice.

SUMMARY

There is a need for new and useful device and method for producing clear ice specifically for use in beverages. In some embodiments, the disclosure herein provides for a device for making clear ice comprising: at least one housing comprising at least two flume surface walls that define at least two elongate troughs arranged parallel to each other; at least one fluid intake disposed to provide a flow of fluid into the at least two elongate troughs; at least one drain disposed to drain fluid from the at least two elongate troughs; wherein the at least a portion of each of the at least two flume surface walls is in thermal communication with a cooling source; wherein the at least one fluid intake and the at least one drain are configured to provide a substantially constant flow of fluid to the at least two elongate troughs during a freezing operation of the device; wherein the fluid intake comprises a fluid intake manifold that defines a single intake manifold cavity that is fluidly connected to the at least two elongate troughs through a fluid entry portal corresponding to each elongate trough; and wherein the drain comprises a drain manifold that defines a single drain manifold cavity that is fluidly connected to the at least two elongate throughs through a fluid exit portal corresponding to each elongate trough. In some embodiments, the cooling source is selected from the group consisting of: an internal cooling cavity defined by the housing, an evaporator, a cold plate, and a condenser.

In some embodiments, the disclosure herein includes for a device for making clear ice comprising: at least one housing comprising at least one flume surface wall that defines at least one elongate trough; at least one fluid intake disposed to provide a flow of fluid into the at least one elongate trough; at least one drain disposed to drain fluid from the at least one elongate trough; wherein the at least a portion of the at least one flume surface wall is in thermal communication with a cooling source; and wherein the at least one fluid intake and the at least one drain are configured to provide a substantially constant flow of fluid to the at least one elongate trough during a freezing operation of the device. In some embodiments, the cooling source is selected from the group consisting of: an internal cooling cavity defined by the housing, an evaporator, a cold plate, and a condenser.

In some embodiments, three flume surface walls of the housing define one elongate trough such that a cross-section of the elongate trough has a tapered U-shape defined by at least one of the two side flume surface walls having an interior angle greater than or equal to about 0 degrees and less than or equal to about 15 degrees from upright and a semicircular base flume surface wall. In other embodiments, three flume surface walls of the housing define one elongate trough such that a cross-section of the elongate trough has a tapered bracket shape defined by at least one of the two side flume surface walls having an interior angle greater than or equal to about 0 degrees and less than or equal to about 15 degrees from upright to a flat base flume surface wall. In some embodiments, the elongate trough has a total depth divided into an ice-forming zone and a fluid overflow zone, and wherein a surface area of the flume surface wall at least coextensive with the fluid overflow zone comprises a thermally insulating material.

In some embodiments, the housing comprises at least two flume surface walls that define two or more elongate troughs, and wherein the fluid intake comprises a fluid intake manifold that defines a single intake manifold cavity that is fluidly connected to the two or more elongate troughs through a fluid entry portal corresponding to each elongate trough. In further embodiments, the fluid intake manifold further comprises an intake flow divider insert having a porosity of about 10% open area to about 50% open area within the intake manifold cavity, the intake manifold cavity is shaped as a rectangular prism, and the intake flow divider insert is coupled to opposite corners of the intake manifold cavity, thereby dividing the intake manifold cavity into a first and second triangular prism, wherein at least one fluid inlet pipe is in fluid communication to the first triangular prism, and wherein the corresponding fluid entry portals are in fluid communication to the second triangular prism. In additional embodiments, at least one of the fluid entry portals comprises a porous flow straightener insert.

In some embodiments, the housing comprises at least two flume surface walls that define two or more elongate troughs, and wherein the drain comprises a drain manifold that defines a single drain manifold cavity that is fluidly connected to the two or more elongate throughs through a fluid exit portal corresponding to each elongate trough. In further embodiments, the drain manifold further comprises a drain flow divider insert having a porosity of about 10% open area to about 50% open area within the drain manifold cavity, the drain manifold cavity is shaped as a rectangular prism, and the drain flow divider insert forms an arcuate shape and is coupled to adjacent corners of the drain manifold cavity, thereby dividing the drain manifold cavity into a first and second portion wherein at least one drainage pipe is in fluid communication to the first portion, and wherein the corresponding fluid exit portals are in fluid communication to the second portion. In additional embodiments, at least one of the fluid exit portals comprises a porous flow straightener insert.

In some embodiments, the substantially constant flow of fluid is provided at a velocity of at least about 0.09 m/s (about 0.3 ft/s) through the at least one elongate trough. In further embodiments, the device further comprises at least one lid configured to enclose at least one elongate trough when removably coupled to the housing. In additional embodiments, the device further comprises one or more retractable inclusion holders configured to be disposed within a cavity defined by the at least one elongate trough.

In some embodiments, the disclosure herein provides for a method for manufacturing clear ice comprising: providing a device for making clear ice comprising: a housing comprising at least one flume surface wall that defines at least one elongate trough; at least one fluid intake disposed to provide a flow of fluid into the at least one elongate trough; at least one drain disposed to drain fluid from at least one elongate trough; wherein the at least a portion of the at least one flume surface wall is in thermal communication with a cooling source; and wherein the at least one fluid intake and the at least one drain are configured to provide a substantially constant flow of fluid to the at least one elongate trough during a freezing operation of the device; providing a substantially constant flow of fluid down the at least one elongate trough via the fluid intake and the drain; and cooling the at least one flume surface wall to a temperature of less than or equal to about 0 degrees Celsius at the at least one flume surface wall. In some embodiments of the method, the cooling source is selected from the group consisting of: an internal cooling cavity defined by the housing, an evaporator, a cold plate, and a condenser. In further embodiments, the clear ice machine further comprises: at least one or more retractable inclusion holders configured to be disposed within at least one elongate trough; and the method further comprises: securing an item with at least one inclusion holder such that the item is positioned within a cavity defined by the at least one elongate trough; and retracting the one or more retractable inclusion holders after a sufficient accumulation of ice within the elongate trough such that the item remains at least partially embedded in the accumulation of ice upon retraction of the one or more inclusion holders. In additional embodiments of the method, the substantially constant flow of fluid down the at least one elongate trough has a velocity of at least about 0.09 m/s (about 0.3 ft/s) through the at least one elongate trough.

In many embodiments, the disclosure herein includes for a device for making clear ice comprising: at least one housing comprising at least one flume surface wall that defines at least one elongate trough; at least one fluid intake disposed to provide a flow of fluid into the at least one elongate trough; at least one drain disposed to drain fluid from at least one elongate trough; wherein the at least a portion of the at least one flume surface wall is in thermal communication with a cooling source; and wherein the at least one fluid intake and the at least one drain are configured to provide a substantially constant flow of fluid to the at least one elongate trough during a freezing operation of the device. In some embodiments, the cooling source is at least one internal cooling cavity defined by the housing, and wherein the device further comprises at least one coolant intake connected to the at least one internal cooling cavity and at least one coolant outtake connected to the at least one internal cooling cavity. In other embodiments, the cooling source is selected from the group consisting of: an evaporator, cold plate, and a condenser.

In certain embodiments, three flume surface walls of the housing define one elongate trough such that a cross-section of the elongate trough has a U-shape defined by two parallel side flume surface walls and a semicircular base flume surface wall. In other embodiments, three flume surface walls of the housing define one elongate trough such that a cross-section of the elongate trough has a tapered U-shape defined by at least one of the two side flume surface walls having an interior angle greater than about 0 degrees and less than or equal to about 15 degrees from upright and a semicircular base flume surface wall.

In further embodiments, three flume surface walls of the housing define one elongate trough such that a cross-section of the elongate trough has a U-shape defined by two parallel side flume surface walls and a semi-elliptical base flume surface wall. In other embodiments, three flume surface walls of the housing define one elongate trough such that a cross-section of the elongate trough has a tapered U-shape defined by at least one of the two side flume surface walls having an interior angle greater than about 0 degrees and less than or equal to about 15 degrees from upright and a semi-elliptical base flume surface wall.

In additional embodiments, three flume surface walls of the housing define one elongate trough such that a cross-section of the elongate trough has a bracket shape defined by two parallel side flume surface walls orthogonal to a flat base flume surface wall. In other embodiments, three flume surface walls of the housing define one elongate trough such that a cross-section of the elongate trough has a tapered bracket shape defined by at least one of the two side flume surface walls having an interior angle greater than about 0 degrees and less than or equal to about 15 degrees from upright to a flat base flume surface wall.

In some embodiments, the elongate trough has a length of about 45.72 cm to about 3.66 m (about 18 inches to about 12 feet). In other embodiments, the elongate trough has a length of about 2.44 m to about 2.13 m (about 3 feet to about 7 feet). In further embodiments, the elongate trough has a length of about 2.03 m (about 80 inches). In some embodiments, the elongate trough has a depth of about 3.81 cm to about 12.70 cm (about 1.5 to about 5 inches). In other embodiments, the elongate trough has a depth of about 8.89 cm (about 3.5 inches). In some embodiments, the elongate trough has a total depth divided into an ice-forming zone and a fluid overflow zone. In other embodiments, the elongate trough has a total depth of about 12.70 cm (about 5 inches) divided into an ice-forming zone of about 8.89 cm (about 3.5 inches) and a fluid overflow zone of about 3.81 cm (about 1.5 inches.) In further embodiments, a surface area of the flume surface wall at least coextensive with the fluid overflow zone comprises a thermally insulating material. In additional embodiments, the thermally insulating material comprises high density polyethylene. In some embodiments, the elongate trough has a width of about 2.54 cm to about 12.70 cm (about 1 to about 5 inches.) In other embodiments, the elongate trough has a width of about 7.62 cm (about 3 inches.) In some embodiments, the housing defines two or more elongate troughs positioned parallel to one another. In further embodiments, the two or more elongate troughs are positioned anti-parallel to one another.

In some embodiments, the fluid intake comprises a fluid intake manifold that defines a single intake manifold cavity that is fluidly connected to the two or more elongate troughs through a fluid entry portal corresponding to each elongate trough. In further embodiments, the fluid intake manifold further comprises an intake flow divider insert having a porosity of about 10% open area to about 50% open area within the intake manifold cavity. In additional embodiments, the intake manifold cavity is shaped as a rectangular prism and wherein the intake flow divider insert is coupled to opposite corners of the intake manifold cavity, thereby dividing the intake manifold cavity into a first and second triangular prism, wherein at least one fluid inlet pipe is in fluid communication to the first triangular prism, and wherein the corresponding fluid entry portals are in fluid communication to the second triangular prism. In some embodiments, at least one of the fluid entry portals comprises a porous flow straightener insert.

In some embodiments, the drain comprises a drain manifold that defines a single drain manifold cavity that is fluidly connected to the two or more elongate throughs through a fluid exit portal corresponding to each elongate trough. In other embodiments, the drain manifold further comprises a drain flow divider insert having a porosity of about 10% open area to about 50% open area within the drain manifold. In additional embodiments, the drain manifold cavity is shaped as a rectangular prism, and wherein the drain flow divider insert forms an arcuate shape and is coupled to adjacent corners of the drain manifold cavity, thereby dividing the drain manifold cavity into a first and second portion wherein at least one drainage pipe is in fluid communication to the first portion, and wherein the corresponding fluid exit portals are in fluid communication to the second portion. In some embodiments, at least one of the fluid exit portals comprises a porous flow straightener insert.

In some embodiments, the substantially constant flow of fluid is provided at a velocity of at least about 0.09 m/s (about 0.3 ft/s) through the at least one elongate trough. In other embodiments, the substantially constant flow of fluid is provided at a velocity of at least about 0.21 m/s (about 0.7 ft/s) through the at least one elongate trough.

In some embodiments, the device further comprises at least one lid configured to enclose at least one elongate trough when removably coupled to the housing. In other embodiments, the device further comprises one or more inclusion holders configured to be disposed within a cavity defined by the at least one elongate trough. In some embodiments, the one or more inclusion holders are retractable. In additional embodiments, the one or more inclusion holders are coupled to at least one lid configured to enclose at least one elongate trough when removably coupled to the housing.

In many embodiments, the disclosure herein includes for a method for manufacturing clear ice comprising: providing a device for making clear ice comprising: a housing comprising at least one flume surface wall that defines at least one elongate trough; at least one fluid intake disposed to provide a flow of fluid into the at least one elongate trough; at least one drain disposed to drain fluid from at least one elongate trough; wherein the at least a portion of the at least one flume surface wall is in thermal communication with a cooling source; and wherein the at least one fluid intake and the at least one drain are configured to provide a substantially constant flow of fluid to the at least one elongate trough during a freezing operation of the device; providing a substantially constant flow of fluid down the at least one elongate trough via the fluid intake and the drain; and cooling the at least one flume surface wall to a temperature of less than or equal to about 0 degrees Celcius at the at least one flume surface wall. In some embodiments, the cooling source of the device is at least one internal cooling cavity defined by the housing, and wherein the device further comprises at least one coolant intake valve connected to the at least one internal cooling cavity and at least one coolant outtake valve connected to the at least one internal cooling cavity. In other embodiments, the cooling source is selected from the group consisting of: an evaporator, cold plate, and a condenser.

In some embodiments, the clear ice machine of the method further comprises: at least one or more retractable inclusion holders configured to be disposed within at least one elongate trough; and the method further comprises: securing an item with at least one inclusion holder such that the item is positioned within a cavity defined by the at least one elongate trough. In further embodiments, the method further comprises retracting the one or more retractable inclusion holders after a sufficient accumulation of ice within the elongate trough such that the item remains at least partially embedded in the accumulation of ice upon retraction of the one or more inclusion holders.

In some embodiments of the method, the substantially constant flow of fluid down the at least one elongate trough has a velocity of at least about 0.09 m/s (about 0.3 ft/s) through the at least one elongate trough. In other embodiments, the substantially constant flow of fluid has a velocity of at least about 0.21 m/s (about 0.7 ft/s) through the at least one elongate trough.

In many embodiments, the disclosure herein includes for a device for introducing inclusions into clear ice comprising: a rigid substrate; at least one inclusion holder connected to the substrate adapted to secure an item in a predetermined position, wherein the inclusions holder comprises retraction mechanism and at least one of a skewer, hook, or clamp; and wherein the retraction mechanism is configured to disengage the item from an inclusion holder and retract the inclusion holder.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

FIGS. 17A-17B illustrate one embodiment for a method of making clear ice.

FIGS. 18A-18B illustrate one embodiment for a method of making clear ice.

FIGS. 19A-19B illustrate one embodiment for a method of making clear ice.

FIGS. 20A-20B illustrate one embodiment for a method of making clear ice.

FIGS. 21A-21B illustrate one embodiment for a method of making clear ice.

FIGS. 22A-22B illustrate one embodiment for a method of making clear ice.

FIGS. 23A-23B illustrate one embodiment for a method of making clear ice.

FIGS. 24A-24B illustrate one embodiment for a method of making clear ice.

FIGS. 25A-25B illustrate one embodiment for a method of making clear ice FIG. 26 depicts results from a first computational model of one aspect of the disclosure.

FIG. 27 depicts results from a second computational model of one aspect of the disclosure.

FIG. 28 depicts results from a third computational model of one aspect of the disclosure.

Figure 1A:
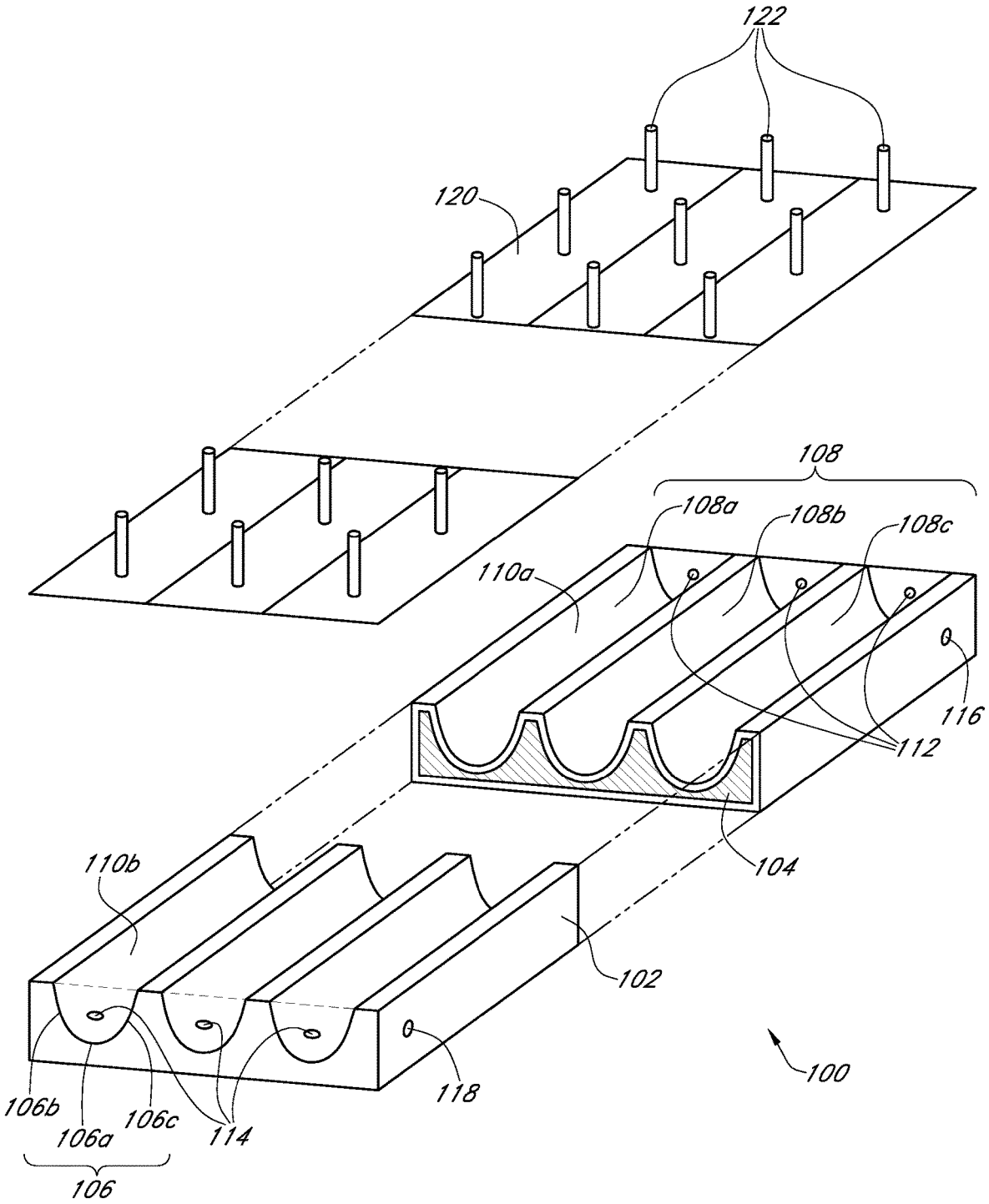
FIG. 1A illustrates an exploded view of one embodiment of a device for making clear ice with a cutout to depict interior features.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

It is an object of the present disclosure to describe devices, systems, and methods for creating clear ice. For example, the devices, systems and methods described herein may be configured to produce clear ice in a variety of shapes that are ready for use in beverages.

Disclosed herein are devices and methods for making clear ice. In particular, the disclosure herein provides for devices and methods allowing for the expedited production of clear ice having an improved quality over preexisting apparatuses and methods. In many embodiments, the devices and methods disclosed herein are adapted for the freezing of water into clear ice; however, one of skill in the art will appreciate how these devices and methods can be adapted to allow for the freezing of other liquids (e.g., ethanol, etc.) in situations where the removal of air bubbles and dissolved impurities is desired. As used herein, the terms "fluid" and "liquid" will be used interchangeably to refer to the material being flowed through the device and being frozen into comestibles. Because water is the chosen fluid to be frozen in many embodiments, the term "water" will be frequently used also; however, this use of the term "water" should not be considered limiting for the reasons stated herein. For similar reasons, the use of the term "ice" to refer to the chosen liquid when frozen should also not be considered limiting either.

In some embodiments, the ice created by the systems and devices described herein may have one or more of the following characteristics: clear, relatively free of impurities, relatively free of gas bubbles, relatively free of dissolved gasses, and/or cracking, may or may not have inclusions (e.g., flowers, liquor, food, etc.), etc. Such characteristics shall not be viewed as limiting in any way.

In some embodiments, water or liquid used to make the clear ice may be deaerated (e.g., gas sweeps, via vacuum, etc.), degassed, purified (e.g., sediment filtered, activated carbon block filtered, granular activated carbon filtered, reverse osmosis filtered, distilled, passed over an ion exchange column, treated with ultraviolet light, ultrafiltered, activated alumina filtered, ionized, etc.), or otherwise treated before being used to make clear ice. The water or liquid may be from a private well, a municipality, groundwater source, reservoir, etc.

Systems and Devices

The device functions to produce clear ice. The device is used for the production of clear ice in any situations where transparent ice is desired, such as for consumption in cocktails and other beverages but can additionally or alternatively be used for any suitable applications where a liquid material is frozen. Described broadly for many embodiments, the device generally provides at least one elongate trough or flume in thermal communication with one or more reservoirs or lines of circulating coolant or one or more cooling apparatuses (e.g., cooling plate, element, etc.). A flow of fluid (e.g., water) is provided down at least a portion of the length of the elongate trough during a freezing operation of the device. Clear ice forms on the surface walls of the trough, growing in thickness and filling up to a certain height in the elongate trough, according to various predetermined parameters described herein. In many embodiments, the speed of water (as either laminar or turbulent flow) through the elongate trough can be critical for the formation of clear ice by driving out air bubbles from the ice forming surface. In some embodiments, the device provides a flow of water having a velocity of at least about 0.09 m/s (about 0.3 ft/s) throughout the length of the elongate trough 108. In other embodiments, the velocity of the water is at least about 0.15 m/s (about 0.5 ft/s). In still other embodiments, the velocity of the water is at least about 0.21 m/s (about 0.7 ft/s). Once an ingot of ice has been generated within the at least one elongate trough, the freezing operation can be stopped, allowing for the collection of the ice ingot. The generated ice ingot can be subsequently modified to produce a variety of aesthetically pleasing comestibles. As used herein, the terms "elongate trough" and "flume" are considered synonymous and can be used interchangeably throughout.

In many embodiments, the devices and methods presented herein allow for the generation of clear ice at a rate superior to existing techniques. In some embodiments, the devices and methods herein can generate clear ice at a speed of at least about 7 mm/hr measured as linear height of accumulated clear ice on any given point of a surface wall of a trough per unit time. In another embodiment, the devices and methods herein can generate clear ice on a given point at a speed of at least about 24 mm/hr. Furthermore, in the devices and methods described herein, ice grows in multiple directions, thereby effectively halving the thickness of ice through which heat must flow to generate new ice. This provides a dramatic advantage in speed over preexisting technologies that can only grow ice in a single direction. For example, a Clinebell CB3002XD produces ice in one direction at a speed of about 3.0 mm/hr while a CFBI PIM0206 produces ice in one direction at about 6.4 mm/hr. With some embodiments of the devices and methods described herein achieving a total ice formation rate of about 1.27 cm to about 2.54 cm per hour, the disclosure herein can more than double the rate of clear ice formation over these other devices.

As shown in FIG. 1, the device 100 in many embodiments comprises a housing 102 that encloses at least one internal cooling cavity 104. The housing additionally comprises one or more flume surface walls 106*a*, 106*b*, and 106*c* that define an elongate trough 108 (or in some embodiments, a plurality of elongate troughs 108*a*, 108*b*, and 108*c*), each elongate trough 108 having a first end 110*a* and a second end 110*b*. During a freezing operation of the device 100, clear ice is formed within the at least one elongate trough 108. Across various embodiments, the housing 102 can define any number of elongate troughs 108 greater than or equal to one, and each elongate trough 108 can be shaped by any number of corresponding flume surface walls 106. In some embodiments, the device 100 comprises six elongate troughs 108. In certain embodiments, a plurality of elongate troughs 108 and/or internal cooling cavities 104 can be defined by one housing 102. In other embodiments, each elongate trough 108 and/or internal cooling cavity 104 can be defined by a separate housing 102. In these embodiments, the plurality of housings 102 (and therefore, plurality of elongate troughs 108 and/or cooling cavities 104) can be arranged within the device 100 by various structural supports (not shown). In various embodiments, various subsections of the housing can be composed of various materials. For example, some subsections (e.g., flume surface walls 106*a*, 106*b*, 106*c*) can comprise thermally conductive materials, while others (e.g., structural supports and external support walls (not shown)) can comprise thermally insulating materials. In some embodiments featuring a plurality of elongate troughs 108, the elongate troughs 108 can be arranged parallel to each other. In other embodiments, the elongate troughs 108 can be arranged anti-parallel to each other (e.g., see FIG. 8 below).

In embodiments wherein each elongate trough 108 has a continuous arcuate shape, the elongate trough can be considered to be defined by a singular flume surface wall 106. However, in many embodiments, an elongate trough 108 can be defined by three flume surface walls 106: two side flume surface walls 106*b* and 106*c* and one base flume surface wall 106*a*. The particular shape and contour of the one or more flume surface walls 106 of each elongate trough 108 define a cross-sectional shape or profile for that elongate trough 108. Various cross-sectional shapes are presented herein. In various embodiments wherein the housing 102 defines more than one elongate trough 108, each elongate trough 108 can have the same cross-sectional profile or a different cross-sectional profile than another elongate trough of the same device 100. In certain embodiments, a single elongate trough 108 can be shaped such that its cross-sectional shape changes over the length of the elongate trough 108. In some of these embodiments, having such a variable shape could assist with the removal of the produced ingot of ice from the device 100. As described herein, the cross-sectional shape of an elongate trough 108 of the device 100 can greatly influence the clarity and therefore the quality of the produced clear ice in many embodiments.

Furthermore, in some embodiments, the flume surface walls 106 of an elongate trough 108 comprise a single, uniform material. In some embodiments, the flume surface walls 106 comprise aluminum, stainless steel, copper, or another thermally conductive material or thermally conductive metal or alloy. In additional embodiments, the flume surface walls 106 comprise material that is food-safe or otherwise known to be non-toxic when used in the production of comestibles. In other embodiments, various subsections of the flume surface walls 106 can comprise a material different from other subsections of the flume surface walls 106 of the same elongate trough 108. For example, in some embodiments, portions of the flume surface walls 106 outside the intended area of ice formation (i.e., outside the ice-forming zone and within the fluid overflow zone, see FIGS. 2 and 5 below) can comprise a thermally insulating material such as high-density polyethylene (HDPE) while the portions of the flume surface walls 106 comprise a thermally conductive material such as aluminum, stainless steel or copper.

Figure 1B:
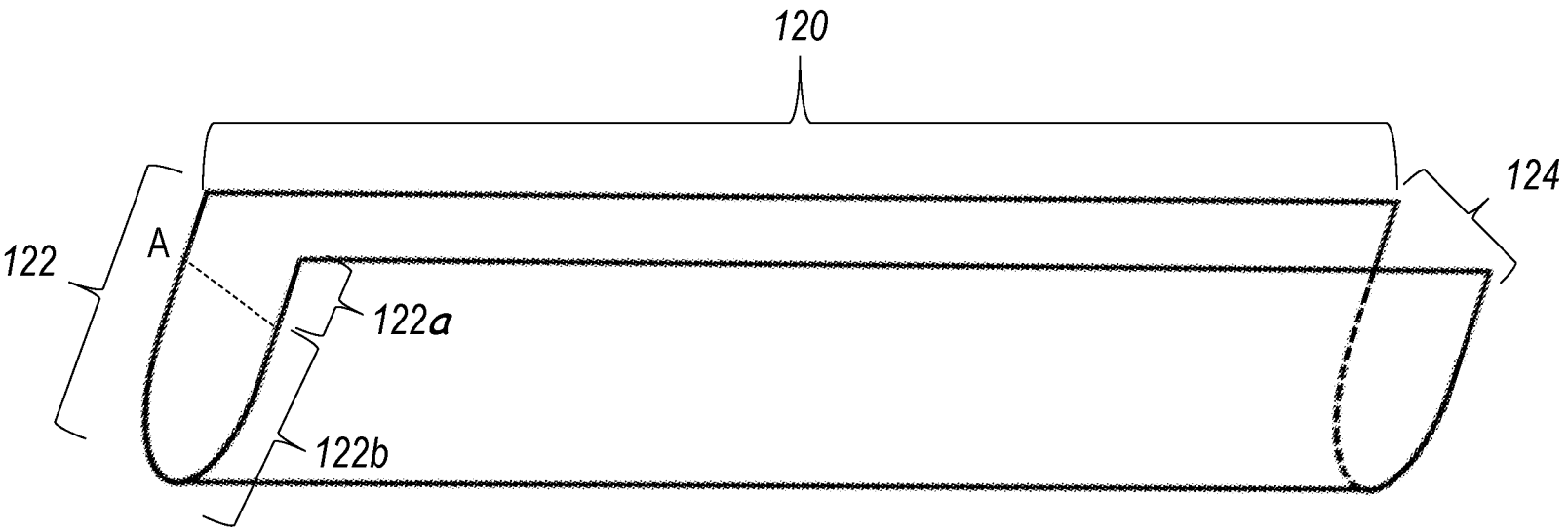
FIG. 1B illustrates the general dimensions of an elongate trough for a device for making clear ice.

FIG. 1B depicts the various dimensions for a generic elongate trough 108. An elongate trough can have a length 120, a depth or height 122, and a width 124. As used herein, the terms "depth" and "height" 122 in reference to an elongate trough 108 will be considered synonymous and will be used interchangeably. In some embodiments, an elongate trough 108 can have a depth 122 measured from its lowest point to the highest point of one of its surface walls 106 ranging from about 2.54 cm to about 25.40 cm (about 1 to about 10 inches). In other embodiments, an elongate trough 108 can have a depth 122 of about 3.81 cm to about 12.70 cm (about 1.5 inches to about 5 inches). In further embodiments, an elongate trough 108 can have a depth 122 of about 5.08 cm to about 12.70 cm (about 2 inches to about 5 inches). In some embodiments, the at least one elongate trough 108 has a depth of about 8.89 cm (about 3.5 inches). In some embodiments, the depth 122 of an elongate trough 108 can be divided by Line A into an ice-forming zone 122*b* and a fluid overflow zone 122*a* (also see FIGS. 2 and 5 below). In these embodiments, a total depth 122 of the elongate trough 108 can be subdivided between these zones in various proportions without deviating from the scope of this disclosure. For example, in some embodiments, an elongate trough 108 can have a total depth 122 of about 12.70 cm (about 5 inches) divided into an ice-forming zone 122*b* of about 8.89 cm (about 3.5 inches) and a fluid overflow zone 122*a* of about 3.81 cm (about 1.5 inches).

In additional embodiments, an elongate trough 108 can have a minimum width 124 measured from between the two closest points of opposite side surface walls 106 of about 2.54 cm to about 30.48 cm (about 1 inch to about 12 inches). In some embodiments, an elongate trough 108 can have a minimum width 124 of about 2.54 cm to about 25.4 cm (1 inch to about 10 inches). In other embodiments, an elongate trough 108 can have a minimum width 124 of about 2.54 cm to about 12.70 cm (about 1 inch to about 5 inches). In certain embodiments, the at least one elongate trough 108 can have a minimum width 124 of about 7.62 cm (about 3 inches).

In some embodiments, the at least one elongate trough 108 can have a length 120 of at least about 45.72 cm (about 18 inches). In other embodiments, the at least one elongate trough 108 can have a length 120 of at least about 91.44 cm (about 3 feet). In still further embodiments, the at least one elongate trough 108 can have a length 120 of about 1.22 m to about 3.66 m (about 4 to about 12 feet). In other embodiments, the at least one elongate trough 108 can have a length 120 of about 1.22 m to about 2.44 m (about 4 feet to about 8 feet). In other embodiments, the at least one elongate trough 108 can have a length 120 of about 91.44 cm to about 2.13 m (about 3 feet to about 7 feet). In further embodiments, the at least one elongate trough 108 can have a length 120 of about 1.83 m (about 6 feet). In certain embodiments, the at least one elongate trough 108 can have a length 120 of about 2.03 m (about 80 inches). In some embodiments, the at least one elongate trough 108 can have a length 120 of about 45.72 cm to about 3.66 m (about 18 inches to about 12 feet). In various embodiments wherein the housing 102 defines a plurality of elongate troughs 108, each trough can have the same or different length than another elongate trough 108 of the device 100.

Returning to FIG. 1A, the at least one elongate trough 108 is defined in such a manner by the housing 102 to allow for the flow of water (or another liquid, in various embodiments) down at least a portion of the length of an elongate trough 108 from at least one fluid intake 112 to at least one drain 114. In some embodiments, a first end 110*a* of an elongate trough 108 can be understood to mean an end nearest a fluid intake 112, and a second end 110*b* of an elongate trough 108 can be understood to mean an end nearest a drain 114. In these embodiments, it can be understood that fluid (e.g., water) flows down an elongate trough 108 from the fluid intake 112 to the drain 114, i.e., from the first end 110*a* to the second end 110*b*. As illustrated in the embodiment of FIG. 1, each elongate trough 108 can be fed by a single fluid intake 112 and drained by a single drain 114; however, different numbers, arrangements and placements of these valves are possible without deviating from the scope of this disclosure (e.g., FIGS. 11A-11C). Because ice forms and grows upon at least a portion of the flume surface walls 106 during a freezing operation of the device 100, the one or more fluid intake 112 and drain 114 can be positioned to allow for the free passage of water over the growing ice ingot (i.e., in the fluid overflow zone 122*a*) regardless of the ingot's height or at least up to a predetermined height of ice (i.e., in the ice-forming zone 122*b*).

In some embodiments, the at least one fluid intake 112 and at least one drain 114 are configured to provide a flow of water such that the entire volume defined within the elongate trough 108 is filled with moving water except for the portion occupied by the growing mass of clear ice during a freezing operation of the device 100. In some embodiments, the at least one fluid intake 112 and drain 114 provide fluid (e.g., water) having a velocity of at least about 0.09 m/s (about 0.3 ft/s) throughout the length of the elongate trough 108. In other embodiments, the velocity of the water is at least about 0.15 m/s (about 0.5 ft/s). In still other embodiments, the velocity of the water is at least about 0.21 m/s (about 0.7 ft/s). In other embodiments, the at least one fluid intake 112 and at least one drain 114 are adapted to provide a flow of water such that the entire volume defined within the ice-forming zone 112*b* and a portion of the fluid overflow zone 112*a* is filled with moving water except for the portion occupied by the growing mass of clear ice during a freezing operation of the device 100.

The at least one fluid intake 112 and/or drain 114 are fluidly connected to a fluid supply such as a water supply (not shown) and any other additional equipment appreciated by those of skill in the art to allow for a substantially continuous flow of fluid to the at least one elongate trough 108 during a freezing operation of the device 100. In some embodiments, the fluid supply provides a substantially continuous stream of new fluid to the device throughout the entire freezing operation; in other embodiments, the fluid supply can recirculate at least a portion of a starting volume of fluid throughout the freezing operation. In certain embodiments, de-aerated water can be supplied or recirculated to the device 100 from the fluid supply.

In many embodiments, an appropriate velocity of fluid into the at least one elongate trough 108 can be critical for the formation of clear ice as opposed to cloudy or opaque ice. In various circumstances, quickly freezing a volume of still or slow-moving water can trap air bubbles and impurities within the ice, resulting in a hazy appearance. However, in addition to other advantages of the device 100 described herein, the device's 100 flow of water can mitigate the trapping of air bubbles within the ice during the freezing process, even at high rates of freezing. In some embodiments, the flow of water can also be turbulent flow. Therefore, the device 100 as disclosed herein is capable of producing a solid ingot of clear ice of sufficient quality faster than other known methods.

In some embodiments, the flow rate of fluid remains constant over the whole duration of a freezing operation of the device 100. In other embodiments, the flow rate of the fluid varies over a freezing operation of the device 100. In some embodiments, periods of flow reversal may occur in which the fluid intake 112 becomes the fluid drain 114, and the fluid drain 114 becomes the fluid intake 112.

At least one internal cooling cavity 104, defined by housing 102, is in thermal communication with the flume surface walls 106 across many embodiments, thereby establishing the heat transfer necessary for the formation of clear ice in the at least one elongate trough 108. In some embodiments, the at least one internal cooling cavity 104 is a singular internal cooling cavity 104. In other embodiments, the at least one internal cooling cavity 104 is a plurality of cooling cavities that are in thermal communication with various subsets of flume surface walls 106 and/or portions of flume surface walls 106. In some embodiments for an elongate trough 108 having a base flume surface wall 106*a* and two side flume surface walls 106*b* and 106*c*, each flume surface wall 106*a*, 106*b*, and 106*c* are each in thermal communication with a unique internal cooling cavity 104 defined by the housing 102. Across various embodiments, the at least one internal cooling cavity 104 can include various structures and architectural features within in order to facilitate an even flow and distribution of coolant within it. In some embodiments, these structures can include but are not limited to mesh grates.

During a freezing operation of the device 100, the at least one internal cooling cavity 104 can be at least partially filled by a circulating coolant sufficient to lower the temperature of at least a portion of one or more flume surface walls 106 to about 0° C. or colder. In another embodiment, the at least one internal cooling cavity 104 can be at least partially filled by a circulating coolant sufficient to lower the temperature of at least a portion of one or more flume surface walls 106 to about −45° C. In still other embodiments, the at least one internal cooling cavity 104 can be at least partially filled by a circulating coolant sufficient to lower the temperature of at least a portion of one or more flume surface walls 106 to about 0° C. to about −20° C. In further embodiments, the at least one internal cooling cavity 104 can be at least partially filled by a circulating coolant sufficient to lower the temperature of at least a portion of one or more flume surface walls 106 to about −2° C. to about −20° C. In still further embodiments, the at least one internal cooling cavity 104 can be at least partially filled by a circulating coolant sufficient to lower the temperature of at least a portion of one or more flume surface walls 106 to about −2° C. to about −35° C. In some embodiments, the internal cooling cavity 106 and its contained circulating coolant are adapted to hold at least a portion of one or more flume surface walls 106 to a constant temperature during a freezing operation of the device 100. In other embodiments, the internal cooling cavity 106 and its contained circulating coolant are adapted to provide a variable temperature to at least a portion of one or more flume surface walls 106 during a freezing operation of the device 100 that changes according a predetermined temperature schedule.

In many embodiments, the volume of the at least one internal cooling cavity 104 can be minimized and/or insulated from portions of the housing 102 that are not flume surface walls 106 in order to minimize the amount of coolant needed to sufficiently cool the flume surface walls 106 for the generation of ice. As one of skill in the art will appreciate, the one or more cooling cavities may be replaced with other cooling apparatuses (e.g., cooling plate, cooling elements, etc.), without departing from the scope of the present disclosure.

One of skill in the art will appreciate that a variety of coolants can be used including, but not limited to, propylene glycol, ethylene glycol, and brine. For the circulation of coolant, the at least one internal coolant cavity 104 is fluidly connected to a coolant circulation system (not shown) via at least one coolant intake 116 and at least one coolant outtake 118. As illustrated in the embodiment of FIG. 1, the singular internal cooling cavity 104 is fed by a singular coolant intake 116 and drained by a singular coolant outtake 118; however, different numbers, arrangements and placements of these features are possible without deviating from the scope of this disclosure. In particular, embodiments wherein the housing encloses a plurality of internal cooling cavities 104 can comprise various numbers, arrangements, placements, and fluid connectivities of internal cooling cavities 104, coolant intakes 116, and coolant outtakes valves 118, without deviating from the scope of this disclosure. One of skill in the art will appreciate that the coolant circulation system can comprise any number of pumps, compressors, evaporators, etc. that are needed to provide a sufficient circulation of coolant for the features of the disclosure as described herein.

The embodiment of the device 100 of FIG. 1A has at least one internal cooling cavity 104; however, the at least one internal cooling cavity 104 can be replaced by other cooling sources, such as cold plates, condensers, evaporators, etc. in alternative embodiments. For example, evaporator pipes (not shown) could be efficiently snaked in contact with and directly behind the flume surface walls 106 to allow heat transfer between the flume surface walls 106 and the evaporator pipes. In this manner, it can be considered that device 100 is arranged such that at least a portion of the at least one flume surface wall 106 is in thermal communication with a cooling source, and wherein the at least one cooling cavity 104 of FIG. 1A is one embodiment of such a cooling source. In alternate embodiments, the evaporator pipes of the above example can be considered cooling cavities defined by the housing.

In various embodiments, the device 100, optionally, further comprises a lid 120 that comprises a substrate that removably couples or attaches to the housing 102 to enclose and thermally insulate the at least one elongate trough 108. As illustrated in the embodiment of FIG. 1, a singular lid 120 can be adapted to enclose all of the elongate troughs 108*a*, 108*b*, and 108*c*. In alternative embodiments, a plurality of lids 120 can be adapted to cover each elongate trough individually or in distinct subsets. In further embodiments, the lid 120 can comprise one or more inclusion holders 122, such as small skewers, clips, or clamps, positioned on the substrate of the lid such that the holders can secure an item (e.g., a piece of fruit or other edible good, a flower, etc.) within an elongate trough 108 when the lid 120 is fitted to the housing 102 of the device 100. In some embodiments, the inclusion holders 122 are retractable such that they can disengage the item and be retracted when sufficient ice has formed within the elongate trough to secure the item within the growing ice ingot in a predetermined position as arranged for by the positioning of the inclusion holder 122. In various embodiments, the inclusion holders can be retracted by mechanical means (e.g., automatically or manually actuated) or manually (e.g., by hand). In some embodiments, the inclusion holders can be retracted by mechanical means when a predetermined duration of time has expired during a freezing operation of the device. Alternatively, or additionally, one or more side surface walls 106, inclusion holders 122, or other components of device 100 may be sensorized such that a progress of ice formation may be monitored for removal of the inclusion holders. Further, in some embodiments, the inclusion holders can be retracted by mechanical means when the ice formed in the trough 106 reaches a predetermined volume during a freezing operation of the device.

In other embodiments, the lid 120 as described above can be adapted to fit onto other clear ice makers including but not limited to a Clinebell Equipment CB300X2D or a Clinebell Equipment CI-4. Such an adapted lid 120 in these embodiments would provide similar ease of introduction of inclusions to clear ice generated by these alternate devices.

In still further embodiments, the inclusion holders 122 can be adapted to position an item within an elongate trough 108 without the use of a lid 120. In these embodiments, the inclusion holders 122 can be suspended over uncovered elongate troughs 108 by a scaffold or frame, or they can be integrated in a position on a top edge of the housing 102 itself.

Figure 2:
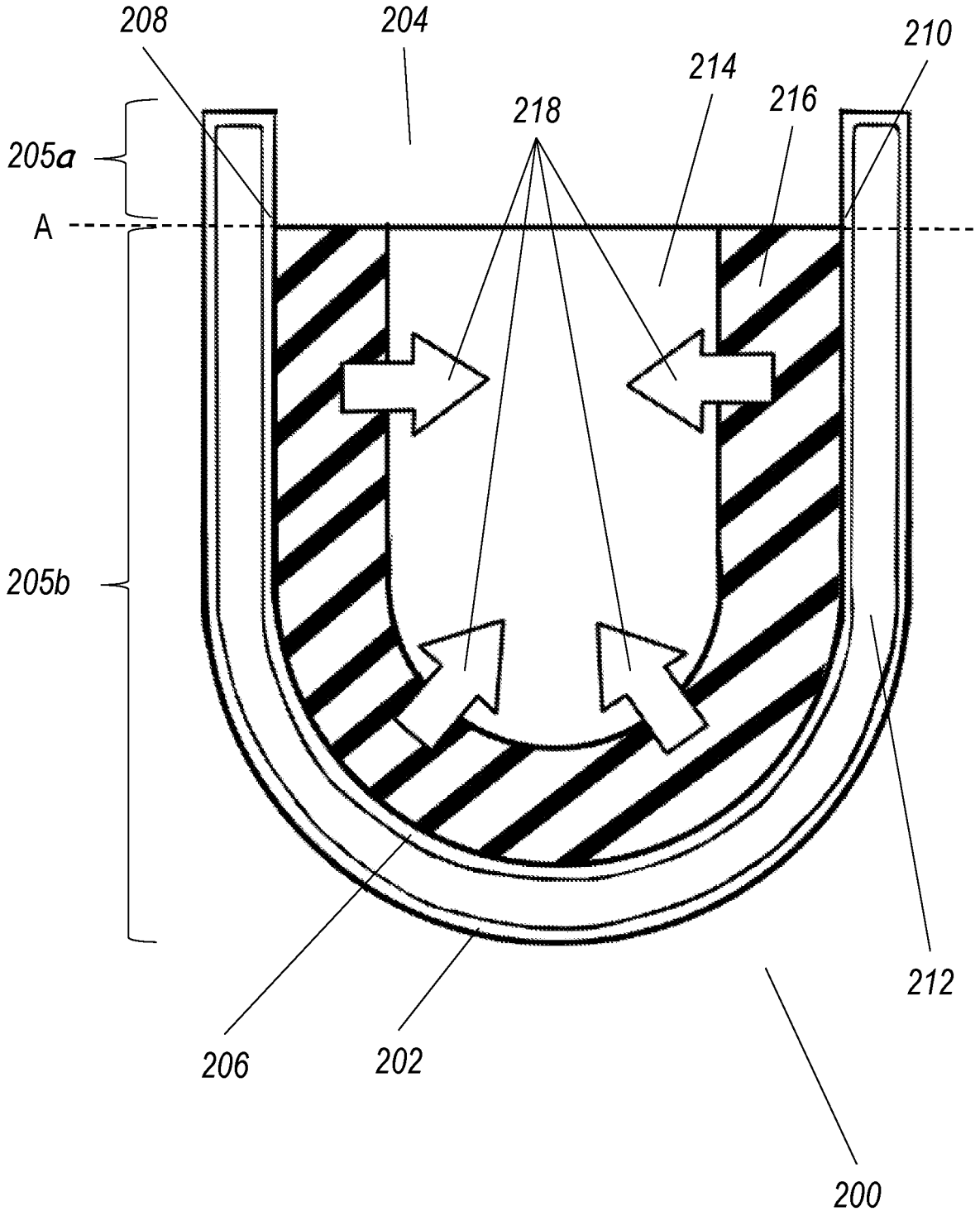
FIG. 2 illustrates a cross-section of one embodiment of a device for making clear ice midway through a freezing operation.

FIG. 2 depicts a cross-section of an exemplary device 200 for making clear ice midway during a freezing operation. In this embodiment, the housing 202 of the device 200 defines a single elongate trough 204 with a semicircular base flume surface wall 206 and a first and second side flume surface wall 208 and 210. These surface flume walls 206, 208, 210 are in thermal communication with an internal cooling cavity 212 or other cooling apparatus enclosed by the housing 202. During a freezing operation of the device 200, sufficient coolant is circulated through the internal cooling cavity 212 such that water 214 flowing down the length of the elongate trough 204 in its ice-forming zone 205*b* as divided by Line A can freeze on the surface flume walls 206, 208, 210 to form an ingot of clear ice. FIG. 2 depicts a midway point during a freezing operation in which clear ice 216 (shaded area) has begun to form on the flume surface walls 206, 208, 210 but has not yet frozen sufficient water to form a solid ingot of clear ice. Arrows 218 illustrate the general direction of ice formation during this process. When a solid ingot of clear ice has formed, any remaining flowing water can traverse the elongate trough 204 in the fluid overflow zone 205*a*.

Figure 3:
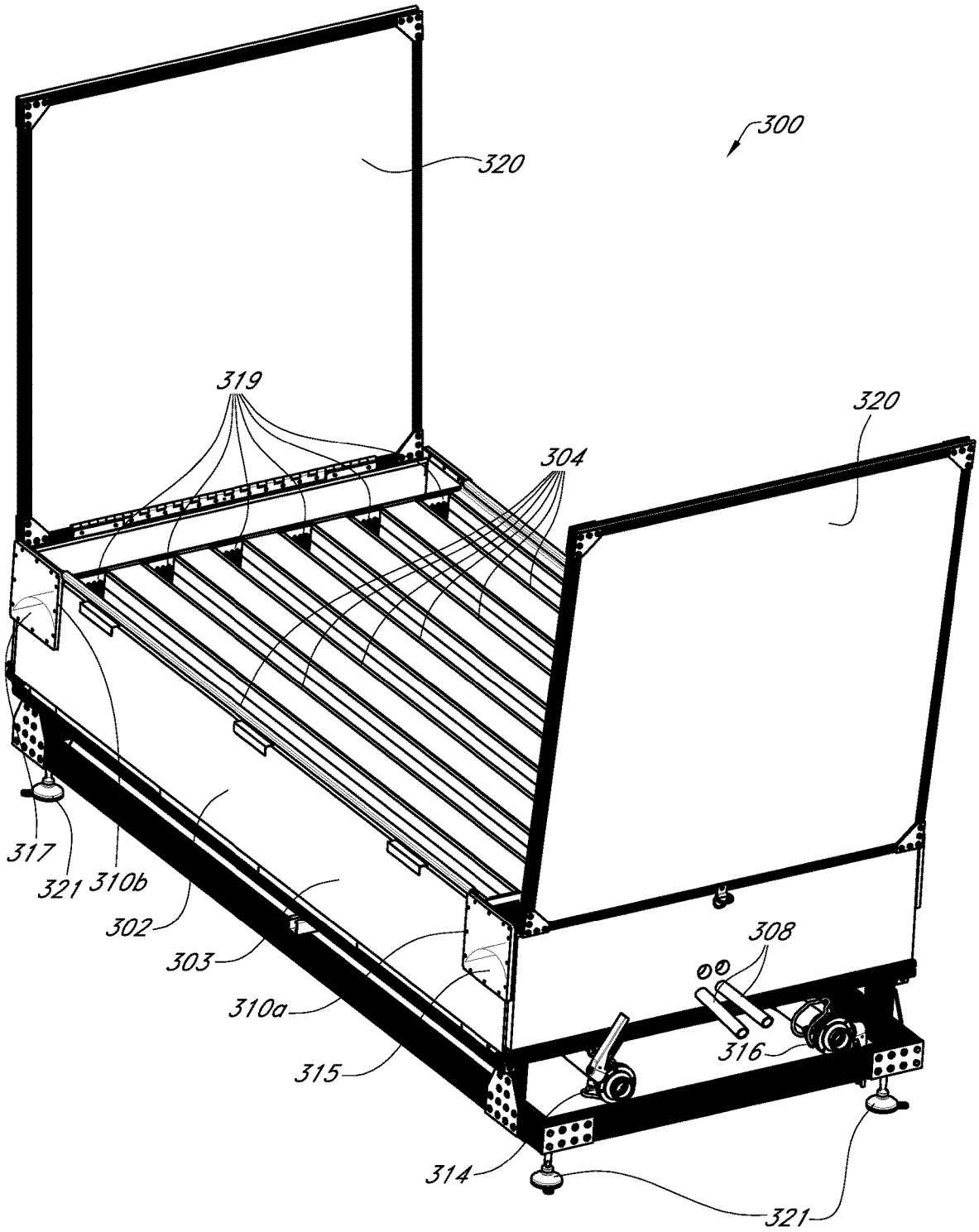
FIG. 3 illustrates a perspective view of one embodiment of a device for making clear ice.

FIG. 3 depicts a perspective view of one embodiment of a device 300 for making clear ice. The device 300 comprises a housing 302 enclosing six elongate troughs 304 each in thermal communication with an individual internal cooling cavity (not shown, see FIGS. 4-5). A fluid intake 314 directs a fluid (not shown) to be frozen in the device 300 (e.g., water) into a fluid intake manifold 315 which then distributes the fluid into each of the elongate troughs 304 via a fluid entry portal (not shown) positioned at the first end 310*a* of each elongate trough 304. After flowing through the length of an elongate trough 304, fluid can exit via a fluid exit portal 319 into a singular fluid drain manifold 317 that collects the fluid from all elongate troughs 304. The fluid drain manifold 317 can then direct the fluid out of the device 300 via a fluid outlet 316. A fluid supply (not shown) can be connected to the fluid intake 314 and optionally the fluid outlet 316 as well in order to provide a continuous flow of fluid through the elongate troughs 304 during a freezing operation of the device. In some embodiments, the fluid supply and/or mechanical components of the fluid intake 314 and/or fluid outlet 316 can regulate at least one of the quantity, flow rate, and temperature of the fluid entering the elongate troughs 304.

Coolant outlet and inlet lines 308 connect the internal cooling cavities (not shown) to a coolant supply (not shown) that chills and circulates coolant through the device 300 during a freezing operation. As discussed herein, various coolants can be employed, including, but not limited to, propylene glycol, ethylene glycol, and brine. In some embodiments, the coolant supply and/or mechanical components of the coolant outlet and inlet lines 308 can regulate at least one of coolant temperature and flow rate into the plurality of internal cooling cavities either individually or collectively. In alternative embodiments, the internal cooling cavities can be replaced by other cooling sources, such as cold plates, condensers, evaporators, etc.

The device 300 can also comprises a lid 320, in some embodiments. A lid, when constructed of thermally insulating materials, can assist in maintaining a uniform and adequately cool temperature within the device 300 that can contribute to the generation of clear ice along all the flume surface walls of all elongate troughs 304. In the embodiment shown in FIG. 3, the lid 320, shown in an open configuration, comprises two halves separately hinged at either the first end 310*a* or the second end 310*b* and of sufficient dimensions as to fully enclose the elongate troughs 304 when both halves of the lid 320 are rotated down to a closed configuration (not shown). One of skill in the art will appreciate that a variety of lid constructions and attachments can be employed without deviating from the scope of this disclosure. In some embodiments, no lid 320 is present on the device 300. In further embodiments, the exterior walls 303 of the housing 302 can comprise thermally insulating materials including, but not limited to, polyoxymethylene (POM), polyurethane, polystyrene, fiberglass, and mineral wool, etc. to further assist in the maintenance of a satisfactorily and uniformly chilled environment within the device 300 to contribute towards efficient generation of clear ice in each of the elongate troughs 304. In additional embodiments, the device 300 can rest upon adjustable legs 321 or leveled rails (not shown) that can automatically or manually level the device 300 so that an equal fluid level or a level fluid surface can be more readily attained through the elongate troughs 304 during a freezing operation of the device 300.

Figure 4:
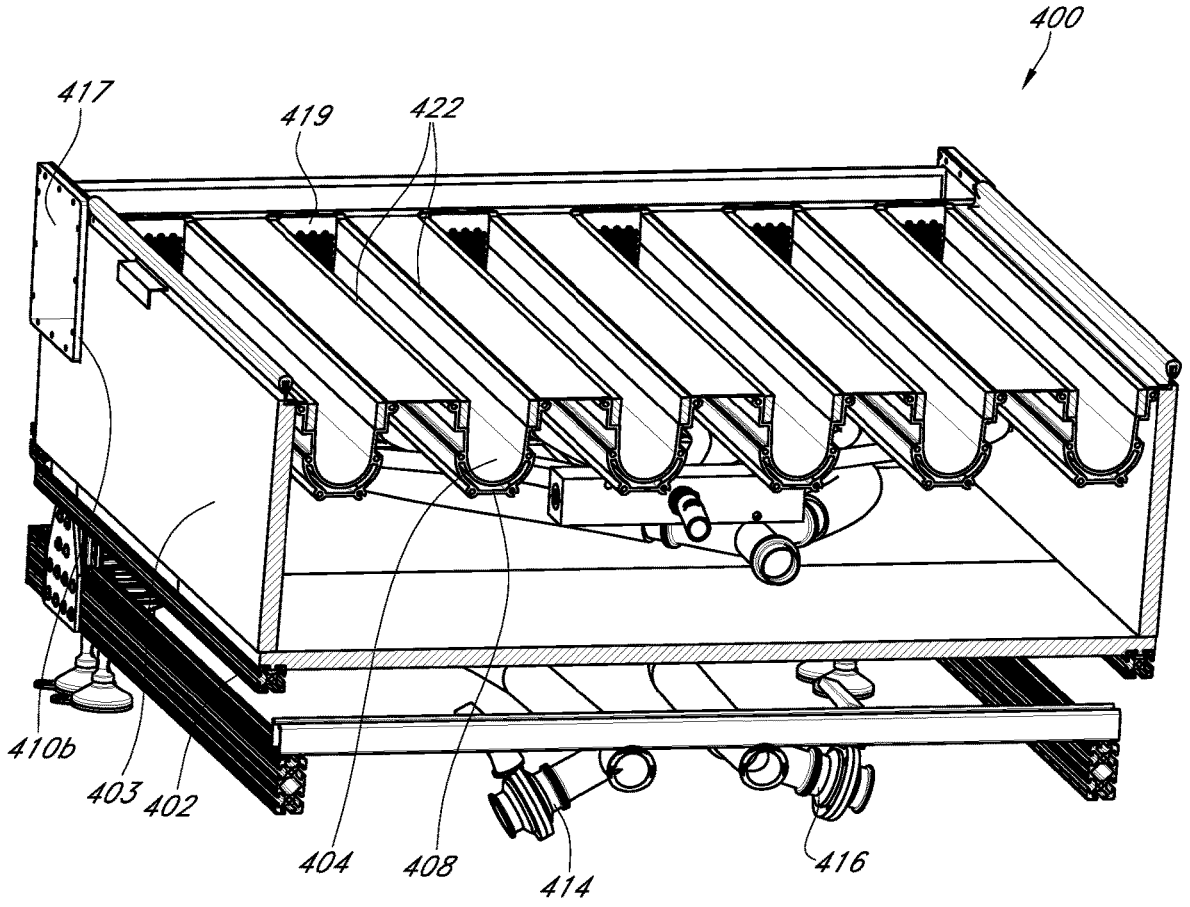
FIG. 4 illustrates a cross-sectional view of an embodiment of a device for making clear ice.

FIG. 4 depicts a cross-section of an embodiment of a device 400 for making clear ice. The device 400 comprises housing 402 defining a plurality of elongate troughs 404 enclosed on five sides (one side not shown) by a plurality of exterior walls 403. In many embodiments, the exterior walls 403 can comprise thermally insulating material as described elsewhere herein. In this embodiment, the elongate troughs 404 are each in thermal communication with a separate internal cooling cavity 408. During a freezing operation of the device 400, coolant is circulated by a coolant supply through each of the internal cooling cavities 408 while a fluid (e.g., water) is circulated through each of the elongate troughs 404. In some embodiments, such as the embodiment of FIG. 4, the elongate troughs have a greater height than the intended height of the ingot of clear ice to be formed. Having such a fluid overflow space (see FIG. 5 below) above an ice-forming zone can allow for the passage of fluid through an elongate trough 404 even after a substantial height of clear ice has developed, and in some embodiments, maintaining this constant flow of fluid can be important for producing aesthetically pleasing clear ice. To impede the formation of clear ice above the intended height, the elongate troughs 404 can comprise a thermally insulating strip 422 along each side flume wall of the elongate trough 404 starting at a height substantially matching that of the intended ingot height and continuing to the top of the trough 404 (i.e., coextensive with the fluid overflow zone). In this manner, the elongate troughs 404, in certain embodiments, can comprise multiple materials as described herein. For example, the portions of an elongate trough 404 on which ice formation is desired can be composed of or include aluminum, stainless steel, or another material that easily conducts heat while the insulating strips 422 can comprise high density polyethylene (HDPE), polyoxymethylene (POM) (a.k.a. Delrin®), or another thermally insulating material or polymer.

FIG. 4 also depicts one embodiment of an internal architecture of a fluid intake 414 and fluid outlet 416 although other arrangements of plumbing can be employed in alternative embodiments. In in the embodiment depicted in FIG. 4, the fluid outlet 416 is attached to a fluid drain manifold 417 positioned at a second end 410*b* (the first end not depicted) of the device 400.

Figure 5:
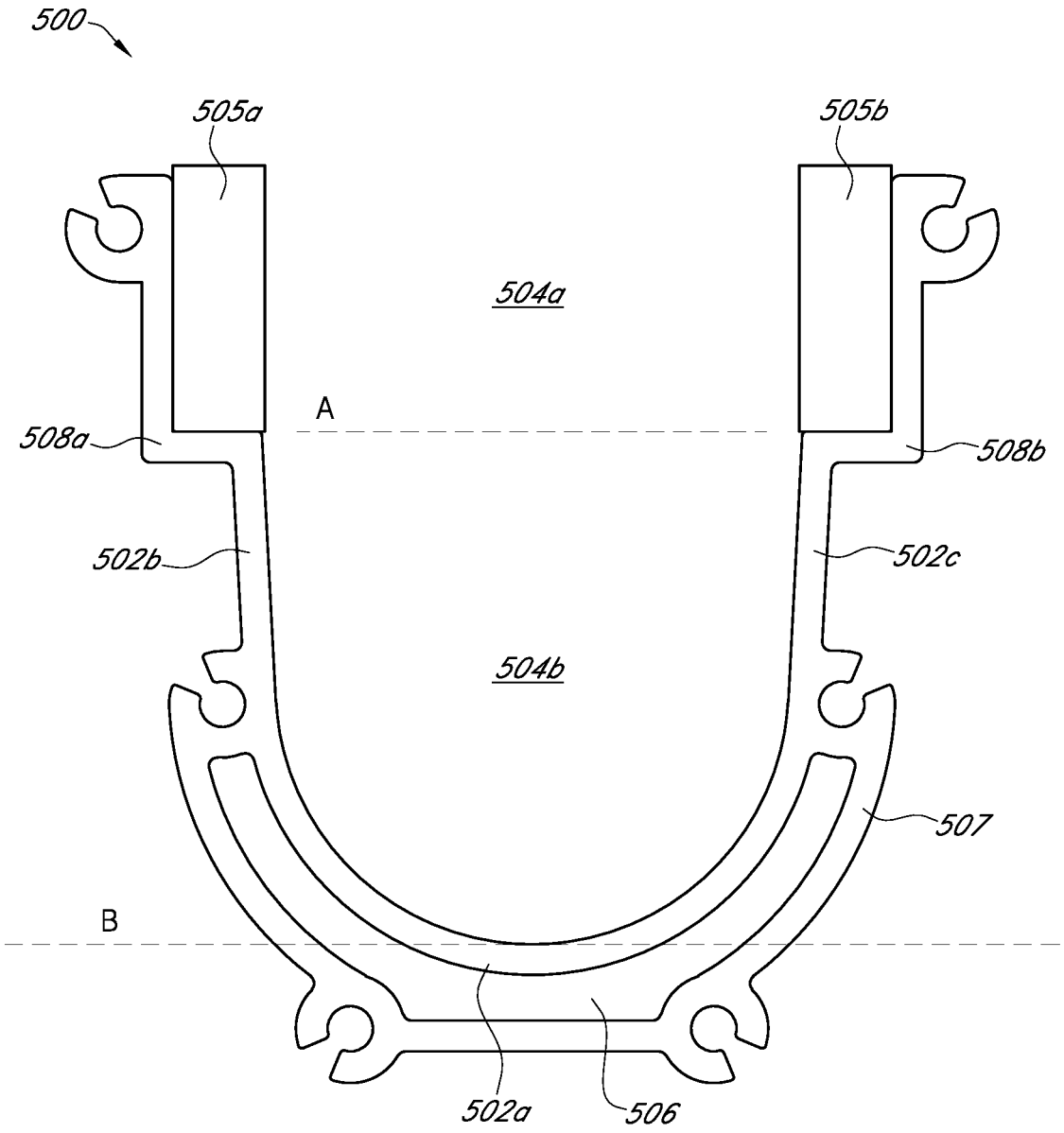
FIG. 5 illustrates a cross-sectional view of an embodiment of an elongate trough.

FIG. 5 shows a cross-sectional profile of the embodiment of an elongate trough of FIG. 4 above. The profile 500 of the elongate trough, which in some embodiments can be considered as part of housing of the device as described herein, defines an ice-forming zone 504*b* and a fluid overflow zone 504*a* (divided by Line A for illustrative purposes) with a semi-circular base surface flume wall 502*a* and two side surface flume walls 502*b* and 502*c*. In the embodiment of FIG. 5, at least a portion of the flume surface walls 502*a-c* of the ice-forming zone 504*b* are in contact with an internal coolant cavity 506 defined by a coolant cavity wall 507. In other embodiments, all portions of the surface flume walls 502*a-c* of the ice-forming zone 504*b* are in contact with the internal coolant cavity 506. In order to impede the formation of ice within the fluid overflow zone 504*a*, insulating strips 505*a* and 505*b* comprising a thermally insulating material line the side surface flume walls 502*b* and 502*c* for their portions that are coextensive with the fluid overflow zone 504*a* in the embodiment of FIG. 5. In alternative embodiments, insulating strips 505*a* and 505*b* can extend into the ice-forming zone 504*b* to slow down the rate of ice formation as it approaches the border of the fluid overflow zone 504*a*. In this manner, it can be said that a surface area of one or more surface flume walls 502*b* and 502*c* at least coextensive with the fluid overflow zone 504*a* can comprise a thermally insulating material. In certain embodiments, the insulating strips 505*a* and 505*b* comprise HDPE. In some embodiments, side surface flume walls 502*b* and 502*c* both form a right angle compared to Line B which is tangent to the lowest point of semicircular base surface flume wall 502*a*. In other embodiments, one or both of side surface flume walls 502*b* and 502*c* lean outward from the center of the ice-forming zone 504*b*, forming a non-right angle with Line B. See the analogous discussion of $\theta$, $\theta^1$, and $\theta^2$ below in FIGS. 12A-12C, 13A-13C, and 14A-14C.

In the embodiment of FIG. 5, the flume surface walls 502*a-c* and the coolant cavity wall 507 are monolithic and can be produced by extruding a singular material (e.g., aluminum, etc.) through a mold (not shown) or by roll forming or die stamping (e.g., stainless steel, etc.). In this embodiment, the insulating strips 505*a* and 505*b* are subsequently attached in notches 508*a* and 508*b* that are configured to receive them so that the insulating strips 505*a* and 505*b* sit substantially flush with the side surface flume walls 502*b* and 502*c* as depicted. A variety of coupling means can be employed to attach the insulating strips 505*a* and 505*b* to the profile 500, including, but not limited to, adhesives, mechanical fasteners, etc. In other embodiments, the profile 500 can be produced in various subassemblies that are subsequently attached to form the complete elongate trough. In these embodiments, various coupling means can be employed to secure the subassemblies to each other, including, but not limited to, welds, adhesives, and mechanical fasteners.

Figure 6A:
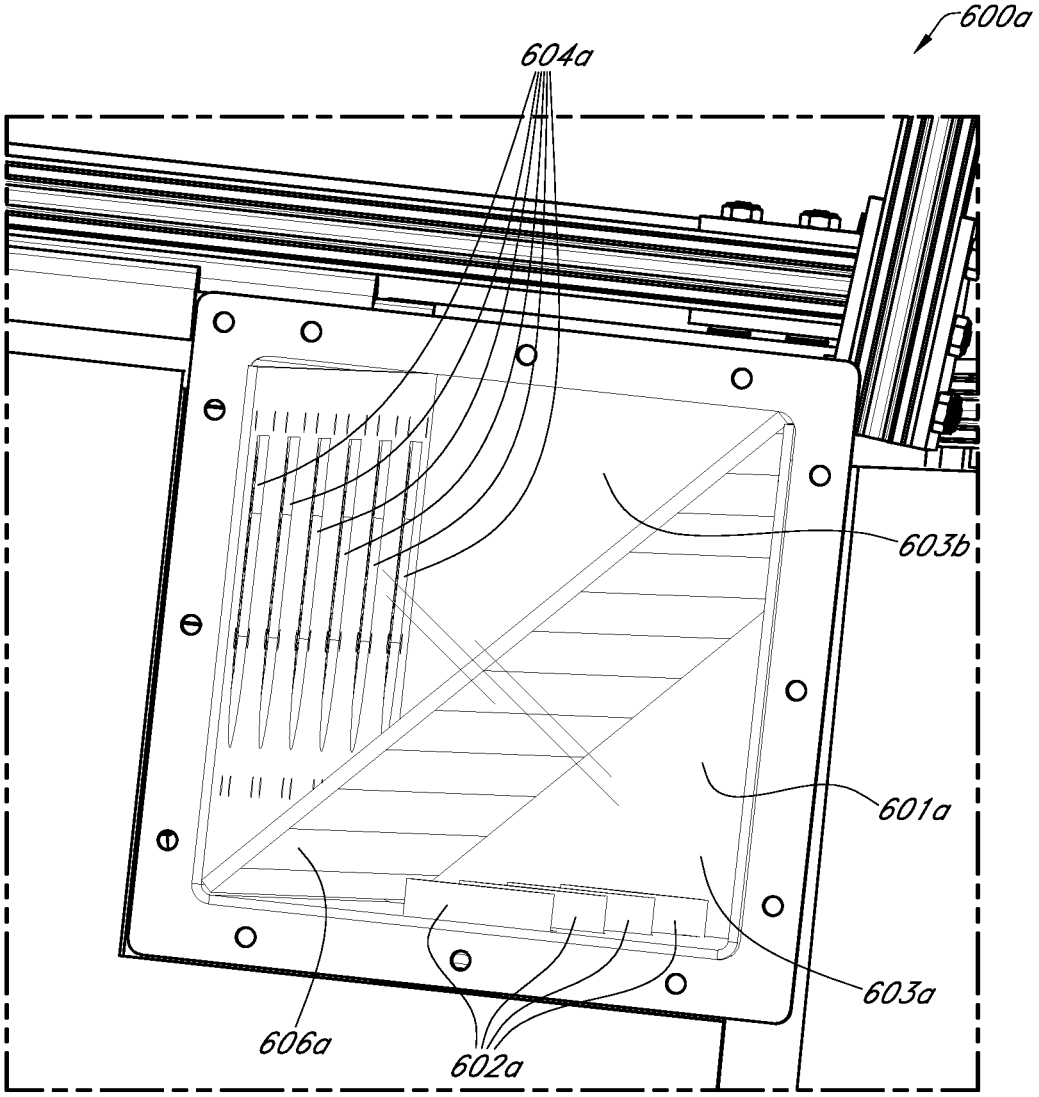
FIG. 6A illustrates a perspective view of an embodiment of a fluid intake manifold.

FIG. 6A depicts a perspective view down the width of an embodiment of fluid intake manifold 600*a*. Fluid (e.g., water) enters the intake manifold cavity 601*a* of the fluid inlet manifold 600*a* through at least one fluid intake pipe 602*a*. In some embodiments, the at least one fluid intake pipe 602*a* is coupled to the fluid intake 414 of FIG. 4. In other embodiments, the fluid intake manifold 600*a* can be considered part of the fluid intake 112 of FIG. 1 or the fluid intake 414 of FIG. 4. In the embodiment of FIG. 6A, there are four fluid inlet pipes 602*a*, but any number greater than or equal to one can be employed in alternative embodiments. Fluid leaves the manifold cavity 601*a* through fluid entry portals 604*a* that direct the flow of fluid into one or more elongate troughs (not shown). In many embodiments, there is only one fluid entry portal 604*a* for each elongate trough, although any number of elongate troughs (and therefore corresponding fluid entry portals 604*a*) can connect to a fluid intake manifold 600*a*. In some embodiments, the dimensions of a fluid entry portal 604*a* match that of the profile of the corresponding elongate trough (its ice-forming and fluid overflow zones combined, e.g., see FIG. 5). In other embodiments, the dimensions of a fluid entry portal 604*a* differ from that of the profile of the corresponding elongate trough. In certain embodiments, the dimensions of a fluid entry portal 604*a* match the width and profile of the corresponding elongate trough but is shorter than the full height of the elongate trough. In many embodiments, however, each fluid entry portal 604*a* is fitted with a flow straightener insert (not shown, see FIG. 7) that organizes the turbulence of the flow of fluid into the elongate trough.

In many embodiments, a fluid intake manifold 600*a* further comprises a cavity divider 606*a*. The cavity divider 606*a* is a rigid or semi-rigid but porous insert that mitigates the formation of a circular current of fluid within the manifold cavity 601*a* as fluid makes its way from the fluid inlet pipes 602*a* to the fluid entry portals 604*a*. In many embodiments, the cavity divider 606*a* has a porosity of 5% to 75% open area. In other embodiments, the cavity divider 606*a* has a porosity of 10% to 50% open area. In further embodiments, the cavity divider 606*a* has a porosity of 15% to 30% open area. In the embodiment of FIG. 6A, the cavity divider 606*a* reaches across opposite corners, dividing the rectangular prism of the manifold cavity 601*a* into two triangular prisms 603*a* and 603*b*, respectively, such that the fluid inlet pipes 602*a* are in fluid communication to a first triangular prism 603*a* and the fluid entry portals 604*a* are in fluid communication to a second triangular prism 603*b*. The term "fluid communication" is hereby intended to mean that elements "in fluid communication" can pass fluid (e.g., water) between each other. In alternative embodiments, the manifold cavity 601*a* and cavity divider 606*a* can take other geometries. For example, the manifold cavity 601*a* may take the shape of a cylinder, triangular prism, or the like. In other embodiments, the cavity divider 606*a* is absent. In many embodiments, the flow of fluid into and out of the manifold cavity 601*a* is sufficient to completely fill or substantially fill (approximately 95% filled or more) the manifold cavity 601*a*.

Figure 6B:
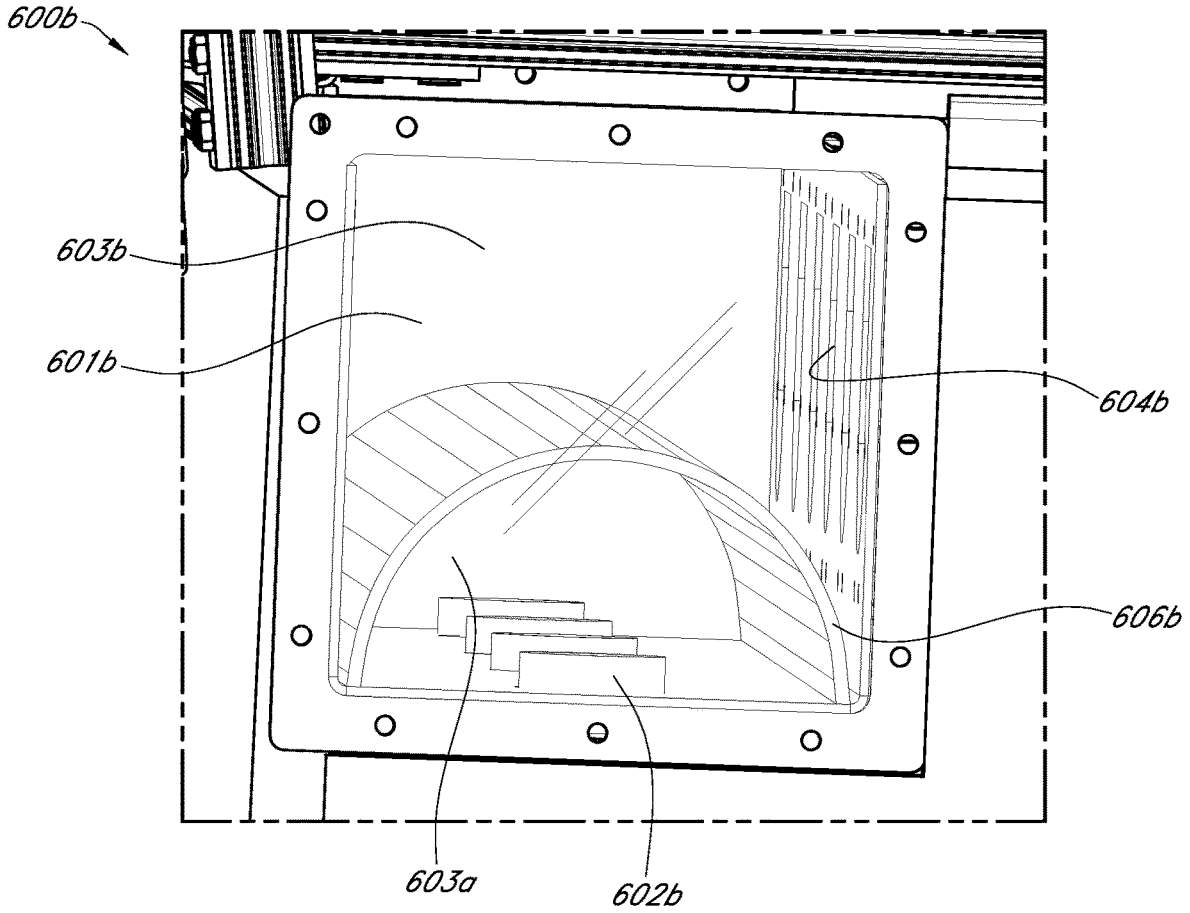
FIG. 6B illustrates a perspective view of an embodiment of a drain manifold.

FIG. 6B depicts a perspective view down the length of a drain manifold 600*b*. Fluid (e.g., water) enters the drain manifold cavity 601*b* of the drain manifold 600*b* through at least one fluid exit portal 604*b*. In many embodiments, there is one fluid exit portal 604*b* for each connected elongate trough (not shown), although any number of elongate troughs (and therefore fluid exit portals 604*b*) can connect to a drain manifold 600*b*. In some embodiments, the dimensions of a fluid exit portal 604*b* match that of the profile of the corresponding elongate trough (its ice-forming and fluid overflow zones combined, e.g., see FIG. 5). In other embodiments, the dimensions of a fluid exit portal 604*b* differ from that of the profile of the corresponding elongate trough. In certain embodiments, the dimensions of a fluid exit portal 604*b* match the width and profile of the corresponding elongate trough but is shorter than the full height of the elongate trough. In many embodiments, however, each fluid exit portal 604*b* is fitted with a flow straightener insert (not shown, see FIG. 7) that organizes the turbulence of the flow of fluid out of the elongate trough. Fluid leaves the drain manifold cavity 601*b* through at least one drainage pipe 602*b*. In some embodiments, the at least one drainage pipe 602*b* is coupled to the fluid outlet 416 of FIG. 4. In the embodiment of FIG. 6B, there are four drainage pipes 602*b*, but any number greater than or equal to one can be employed in alternative embodiments.

In many embodiments, a drain manifold 600*b* further comprises a cavity divider 606*b*. The cavity divider 606*b* is a rigid or semi-rigid but porous insert that mitigates the formation of a circular current of fluid within the drain manifold cavity 601*b* as fluid makes its way from the fluid exit portals 604*b* to the drainage pipes 602*b*. In many embodiments, the cavity divider 606*a* has a porosity of 5% to 75% open area. In other embodiments, the cavity divider 606*a* has a porosity of 10% to 50% open area. In further embodiments, the cavity divider 606*a* has a porosity of 15% to 30% open area. In the embodiment of FIG. 6B, the cavity divider 606*a* forms an arcuate shape between adjacent corners of the same side of the rectangular prism of the drain manifold cavity 601*b* thereby dividing the drain manifold cavity 601*b* into a first 603*a* and second portion 603*b* wherein at least one drainage pipe 602*b* is in fluid communication to the first portion 603*a* and wherein the corresponding fluid exit portals 604*b* are in fluid communication to the second portion 603*b*. In alternative embodiments, the drain manifold cavity 601*b* and cavity divider 606*b* can take other geometries. For example, the drain manifold cavity 601*b* may take the shape of a cylinder, triangular prism, or the like. In other embodiments, the cavity divider 606*b* is absent. In many embodiments, the flow of fluid into and out of the manifold cavity 601*b* is sufficient to completely fill or substantially fill (approximately 95% filled or more) the manifold cavity 601*b*.

Figure 7:
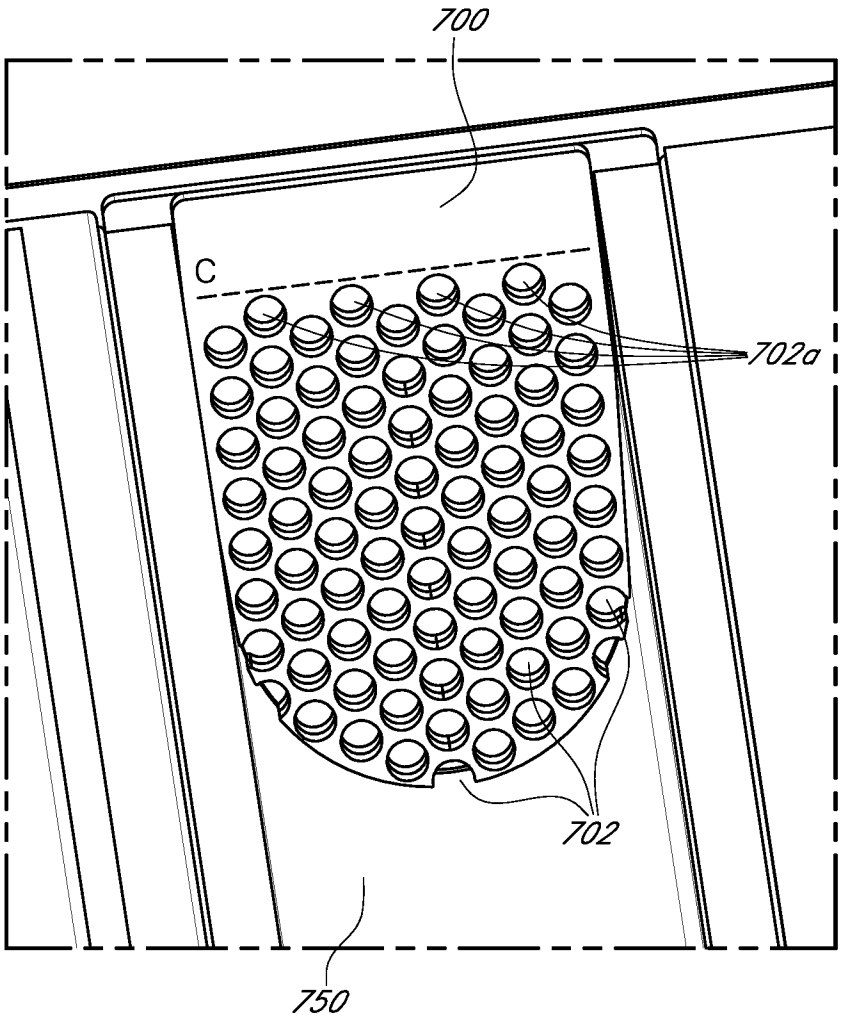
FIG. 7 illustrates a perspective view of an embodiment of a flow straightener insert in position within an elongate trough.

FIG. 7 depicts a perspective view of a flow straightener insert 700 positioned within an elongate trough 750 attached to either a fluid entry portal or fluid exit portal of the elongate trough 750. In many embodiments, a flow straightener insert 700 comprises a rigid or semi-rigid material defining one or more apertures or openings 702. These openings 702 can have a variety of shapes, number, and arrangement in the flow straightener insert 700 across multiple embodiments, but in many embodiments, the openings are all circular (except for those abutting against the edge of the insert 700), have the same diameter, and spaced in series of packed columns as shown in FIG. 7. In some embodiments, the highest one or more openings 702*a* of the flow straightener insert 700 is no taller than the maximum height of the corresponding fluid inlet portal or fluid exit portal. In some embodiments, the highest one or more openings 702*a* are no taller than Line C, a predetermined height that is within the fluid overflow zone of the elongate trough 750 but less than the maximum height of the elongate trough 750. In some embodiments, each elongate trough 750 has a flow straightener insert 700 positioned at both its corresponding fluid entry portal and fluid exit portal. In other embodiments, each elongate trough 750 has a flow straightener insert 700 positioned at only one of its fluid entry portal or fluid exit portal. In still other embodiments, an elongate trough 750 can lack a flow straightener insert 700 at both its fluid entry portal and fluid exit portal. Across various embodiments, the flow straightener insert 700 can be coupled to the flow entry portal or fluid exit portal by a variety of coupling means, including, but not limited to adhesives, mechanical fasteners, etc.

In many embodiments, the flow straightener insert 700 serves to organize the flow of fluid into or out of an elongate trough 750. As a particular range of velocities can be critical for the development of clear ice at speeds superior to existing technologies in some embodiments, the flow straightener insert 700 can prevent or mitigate the formation of swirling vortexes of fluid within the elongate trough 750. Such vortexes can generate areas within the elongate trough 750 where fluid is moving too slowly, thus leading to cloudy sections within the generated ingot of clear ice.

Figure 8:
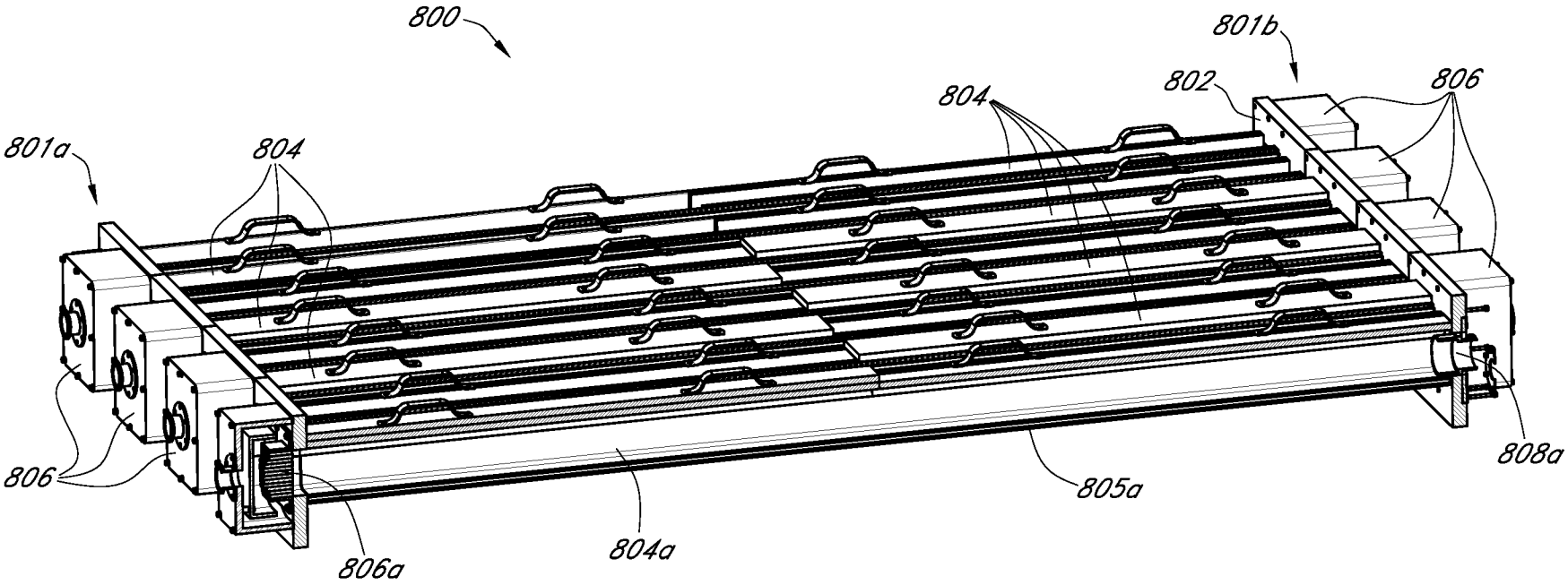
FIG. 8 illustrates a perspective view of another embodiment of a device for making clear ice having one elongate trough shown in cross-section.

FIG. 8 depicts a perspective view and partial cross-section of an alternate embodiment of a device 800 for making clear ice. The device 800 comprises a housing 802 that defines eight elongate troughs 804 showing one elongate trough 804*a* in cross-section. In other embodiments, any number of elongate troughs can be employed. Fluid (e.g., water) enters each elongate trough 804 through a corresponding individual inlet manifold 806 and exits via a corresponding individual drain manifold 808 (only drain manifold 808*a* of elongate trough 804*a* is visible in FIG. 8). Adjacent elongate troughs 804 are arranged anti-parallel to each other such that the inlet manifold 806 of one elongate trough is adjacent to one or more drain manifolds 808 on a given terminal end 801*a* and 801*b* of the device 800 and vice versa. In some embodiments, such an arrangement allows for a more compact arrangement of elongate troughs 804. Each elongate trough 804 is in thermal communication with an internal coolant cavity 805 (only the internal cooling cavity 805*a* of elongate trough 804*a* is visible) through which coolant (supplied by a coolant supply, coolant inlet and outlet lines, all not shown) flows during a freezing operation of the device 800. Fluid (e.g., water) enters the inlet manifolds 806 and exits from the drain manifolds 808 via a fluid supply, and fluid inlet and outlet lines (all not shown).

Figure 9:
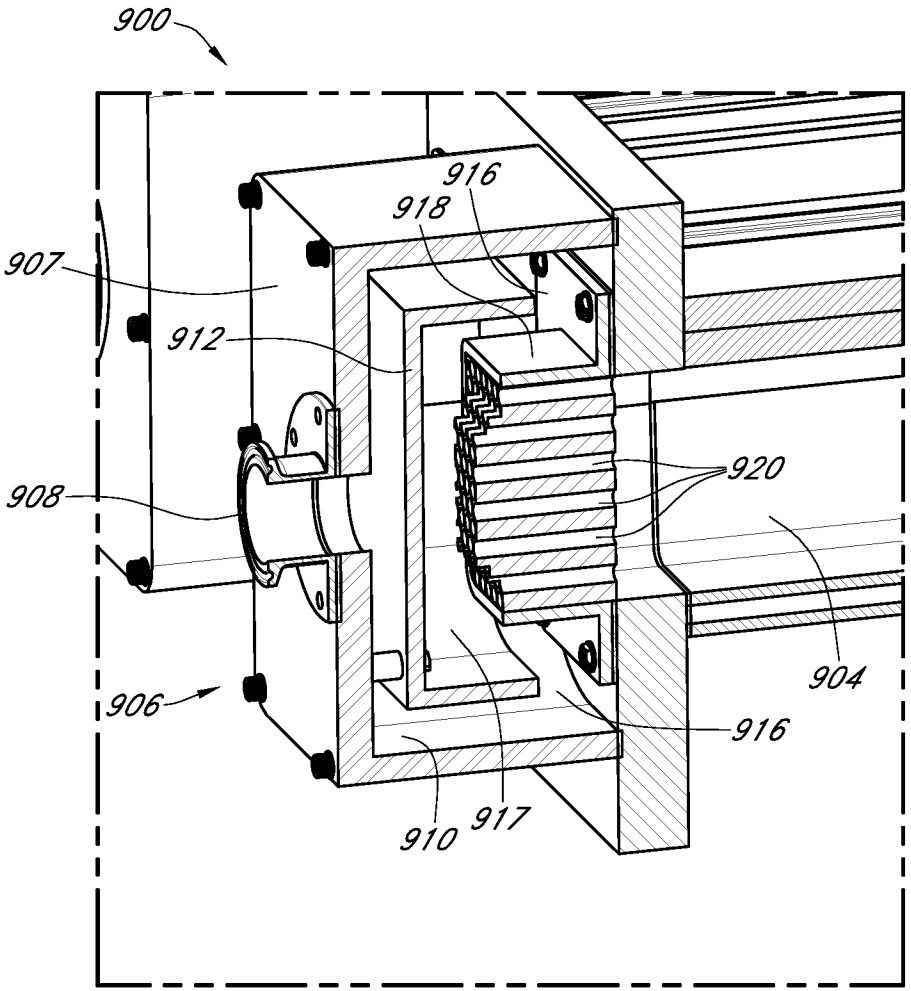
FIG. 9 illustrates a perspective view of another embodiment of a fluid inlet manifold in cross-section.

FIG. 9 shows a perspective cross-sectional view of an embodiment of an inlet manifold 906 of a device 900 for forming clear ice. In some embodiments, the inlet manifold 906 of FIG. 9 can be the same embodiment of those depicted in FIG. 8. The inlet manifold 906 in this embodiment features an inlet pipe 908 that connects to an internal cavity 910 defined by an outer casing 907 of the inlet manifold 906. A flow guide 912 within the internal cavity 910 redirects incoming fluid around its perimeter through an edge gap 916 to enter a guide cavity 917. From the guide cavity 917, fluid can then pass through the one or more channels 920 of a flow straightener plug 918 to enter an elongate trough 904. The flow straightener plug 918 can have any number of channels 920 in various embodiments, and in some embodiments, such as the embodiment of FIG. 9, some channels 920 can have longer lengths than others and can extend farther into the guide cavity 917 than other channels 920. This arrangement of the flow guide 912 and flow straightener plug 918 organizes the general flow of fluid into the inlet manifold 906 in a manner that avoids inefficient whirlpooling of fluid while maintaining sufficient velocity into the elongate trough 904 for the generation of clear ice. In many embodiments, fluid exits an elongate trough 804 through a flow straightener plug 918 and into the drain manifold 808.

Figure 10:
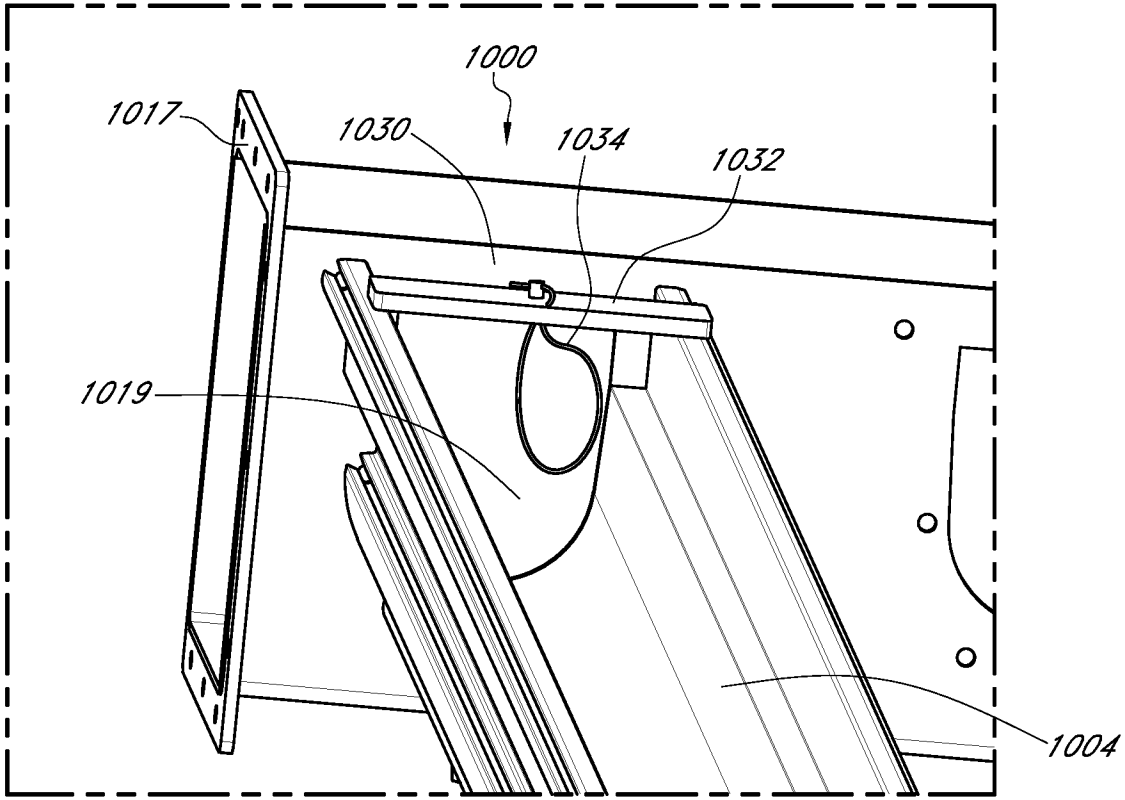
FIG. 10 illustrates a perspective view of one embodiment of an ingot removal structure positioned in an elongate trough before the formation of clear ice.

FIG. 10 depicts a detailed perspective view of one embodiment of a device 1000 for producing clear ice with an embodiment of an ingot removal structure 1030 in position over an elongate trough 1004. In many embodiments, an ingot removal structure 1030 comprises a support beam 1032 through which an ingot implant 1034 is secured extending down into the ice-forming zone of the elongate trough 1004. An ingot removal structure 1030 can be positioned at one or both terminal ends of an elongate trough (i.e., near a fluid entry or exit portal 1019 of a fluid inlet or drain manifold 1017) in various embodiments. In other embodiments, one or more ingot removal structures 1030 can be positioned at other locations along the length of the elongate trough 1004. During a freezing operation of the device 1000, clear ice accumulates in the elongate trough 1004. Because the ingot implant 1034 extends into the ice-forming zone, the ingot implant 1034 becomes embedded in the ingot of ice. Once the freezing operation of the device 1000 has been completed and the ingot of ice is to be removed from the elongate trough 1004, the ingot can be lifted out of the trough by gripping the support beam 1032 of at least one ingot removal structure 1030. An ingot removal structure 1030 can be removed from an ingot of ice by mechanically cutting off a length of the ingot that contains the ingot implant 1034. By positioning an ingot removal structure 1030 very near the terminal ends of an elongate trough, very little ice must be cut to remove the ingot removal structure 1030. Because the ingot implant 1034 is in contact with the fluid that forms a comestible, it can be valuable that the ingot implant 1034 comprises food-safe material. In some embodiments, the ingot implant 1034 is a food-safe zip tie that passes through a hole in the support beam 1032, although one will appreciate that many alternative shapes, materials, and arrangements can be employed to form an ingot removal structure 1030 without deviating from the scope of this disclosure.

Figure 11A:
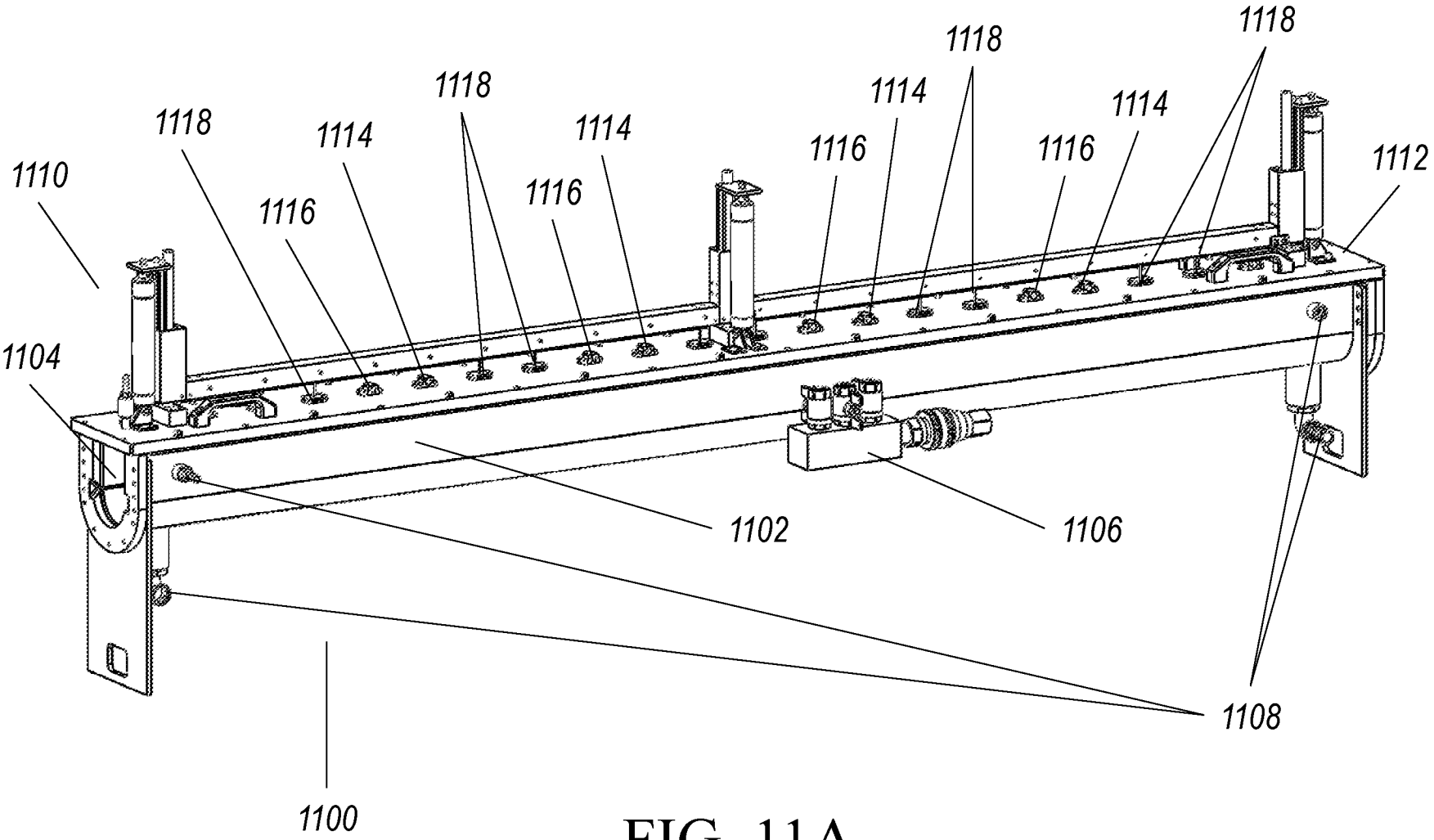
FIG. 11A illustrates a perspective view of another embodiment of a device for making clear ice having the lid attached.

FIG. 11A depicts a perspective view of an alternate embodiment of a device 1100 for making clear ice. The device 1100 comprises a housing 1102 defining a single elongate trough 1104 as well as at least one internal cooling cavity (not shown). A coolant manifold 1106 can control the flow of coolant in and out of the at least one internal cooling cavities via a plurality of coolant inlets and outlets 1108 when connected by various plumbing elements (not shown). In embodiments wherein the device 1100 comprises a plurality of internal cooling cavities the coolant manifold 1106 can control the flow of coolant through each internal cooling cavity individually. In some embodiments, the coolant manifold 1106 can further comprise coolant inlets and outlets 1108 of its own.

The device 1100 comprises a removable lid 1110 depicted in FIG. 11A in an attached position with its rigid substrate 1112 secured to the housing 1102. The lid 1110 features a plurality of fluid inlets 1114 and outlets 1116 (analogous to the fluid intake 112 and drain 114 of FIG. 1A, respectively) along its length in this embodiment. In many embodiments, this arrangement of fluid inlets 1114 and outlets 1116 can allow for a turbulent flow of water through the whole length of the elongate trough 1104 that is fully filled with water during a freezing operation of the device 1100. In additional embodiments, positioning the fluid inlets 1114 and outlets 1116 in the lid can keep them above the freezing level, thereby leaving them operation for the full duration of a freezing operation. Although this embodiment of the lid 1110 is used with an embodiment of the device 1100 that comprise at least one internal cooling cavity in FIG. 11A, the embodiment of the lid 1110 of FIG. 11A can be used on a device using an alternate cooling source for the flume surface walls, such as a cold plate, evaporator, or condenser.

Figure 11B:
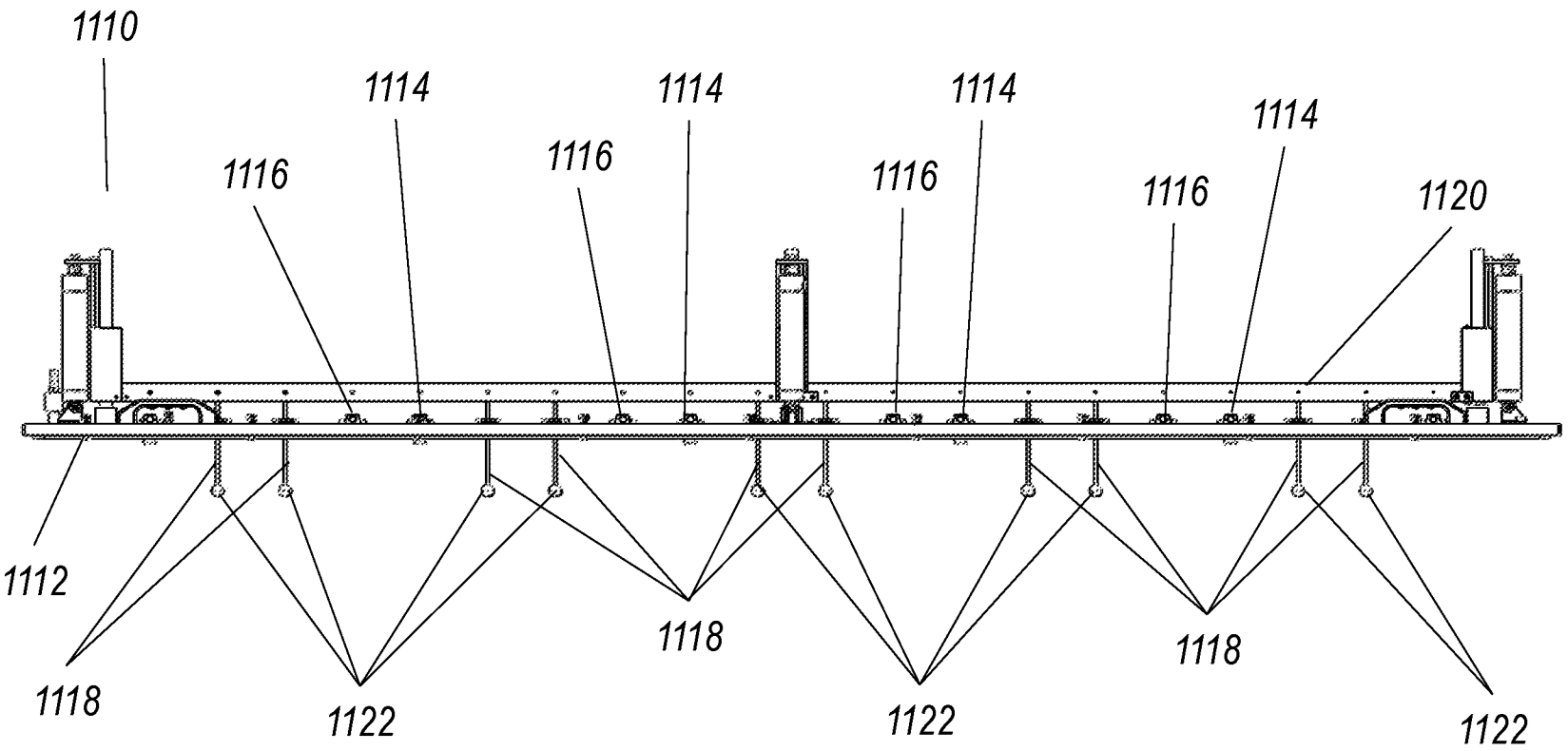
FIG. 11B illustrates a profile view of an embodiment for a lid for a clear ice making device.

In further embodiments, the lid 1110 can further comprise one or more inclusion holders 1118 that extend through the lid 1110 into the ice-making volume defined by the elongate trough 1104. In the embodiment of FIG. 11A, a plurality of inclusion holders 1118 are all attached to a gantry 1120 that allows for a synchronized motion (e.g., a retraction motion) of the inclusion holders 1118. FIG. 11B illustrates a profile view of a lid 1110 unattached to the housing 1102 of the device 1100. The inclusion holders 1118 indeed traverse the substrate 1112 of the lid 1110, and each inclusion holder 1118 can be fitted to secure an inclusion 1122 (e.g., a piece of fruit or other edible good, a flower, etc.) such that the inclusion 1122 can be held in position within an elongate trough 1104 during a freezing operation of the device 1100.

Figure 11C:
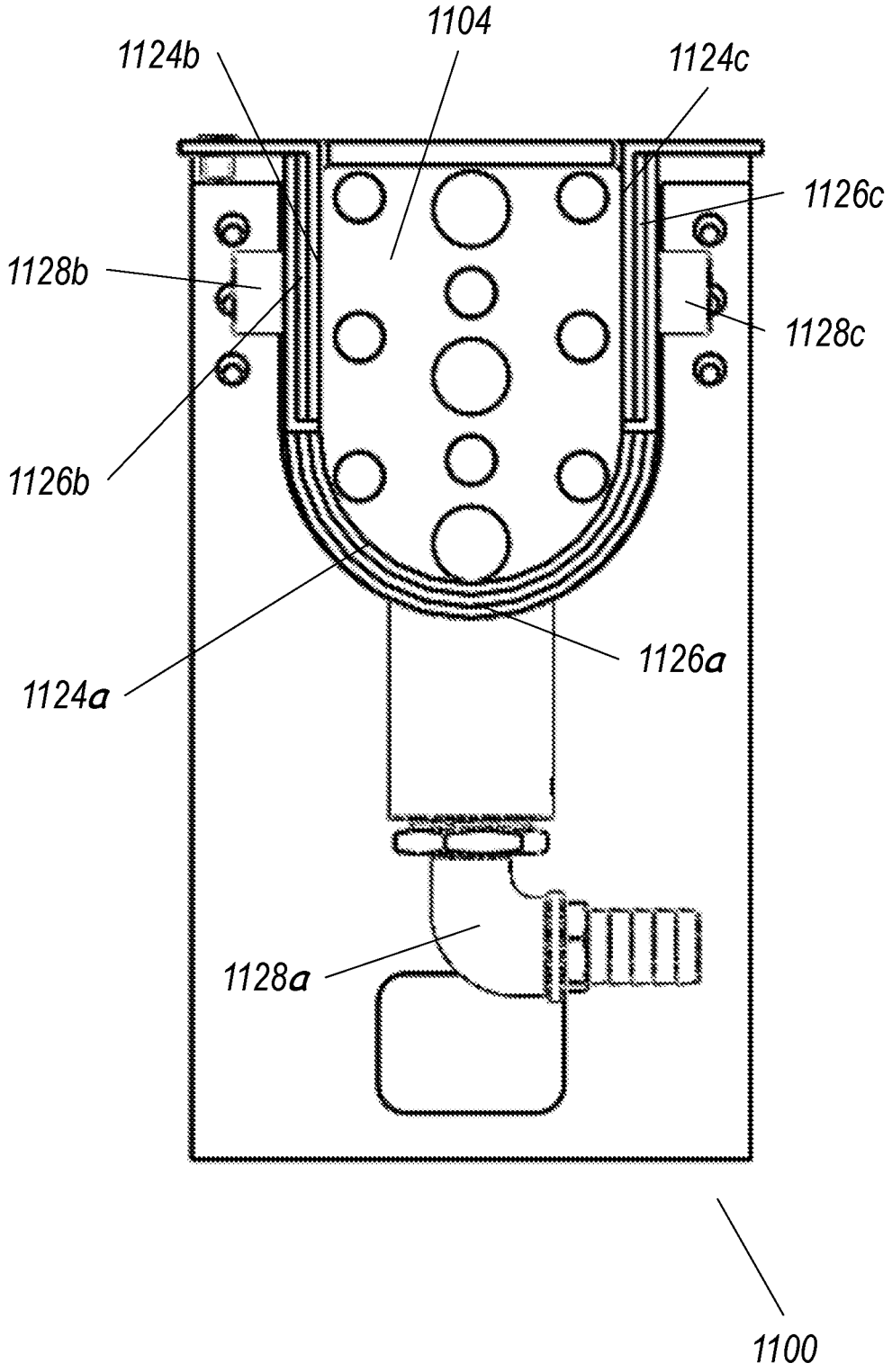
FIG. 11C illustrates a cross-sectional view of an embodiment or a device for making clear ice.

FIG. 11C depicts a cross-sectional view of an embodiment of the device 1100 of FIG. 11A. In this embodiment, the elongate trough 1104 is defined by three flume surface walls 1124*a*, 1124*b*, and 1124*c* that are each in thermal communication with a unique corresponding internal cooling cavity 1126*a*, 1126*b*, and 1126*c*. Each internal cooling cavity 1126*a*, 1126*b*, and 1126*c* can be supplied by unique a coolant inlets and outlets 1128*a*, 1128*b*, and 1128*c*. The compartmentalized arrangement of the cooling cavities 1126*a*, 1126*b*, and 1126*c* in this embodiment allow for a more specific control of the temperatures experienced at each flume surface wall 1124*a*, 1124*b*, and 1124*c* during a freezing operation of the device 1100.

Figures 12A, 12B, 12C:
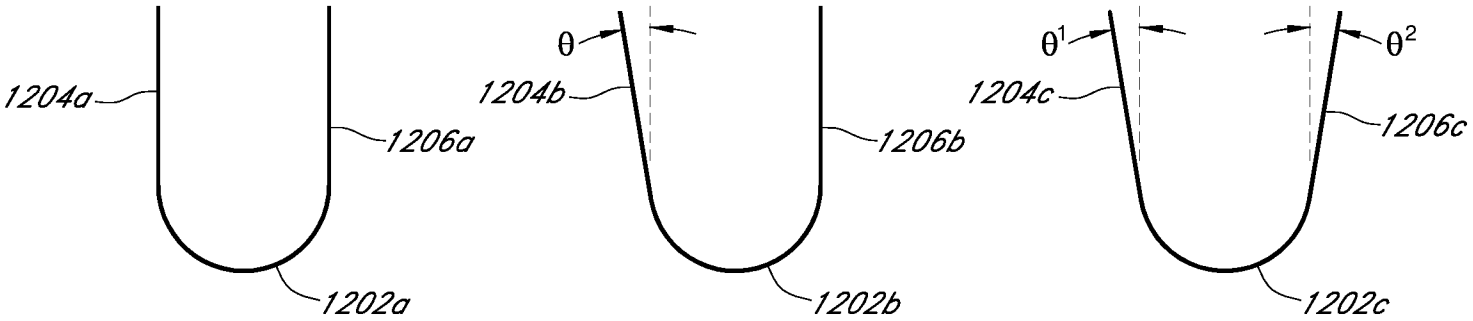
FIGS. 12A-12C illustrate cross-sections of various embodiments of the elongate trough having different cross-sectional shapes.

FIGS. 12A-12C, 13A-13C, and 14A-14C depict various embodiments of possible cross-sectional shapes for an elongate trough. In FIGS. 12A-12C, the elongate trough is defined by a semicircular base surface wall 1202*a*, 1202*b*, 1202*c*, and a first and second side surface walls 1204*a*, 1204*b*, 1204*c* and 1206*a*, 1206*b*, 1206*c*, respectively. In FIG. 12A, the side surface walls 1204*a* and 1206*a* are vertical in comparison to a plane tangent to the lowest point of the base surface wall 1202*a*. In FIG. 12B, the first side surface wall 1204*b* has an internal angle θ away from a vertical position as defined in FIG. 12A. Across many embodiments, the angle θ can be any value greater than about 0° but less than or equal to about 15°. In other embodiments, the angle θ can be about 0.25° to about 10°. In still other embodiments, the angle θ can be about 0.25° to about 8°. In further embodiments, the angle θ can be about 0.25° to about 5°. In still further embodiments, the angle θ can be about 1° to about 10°. In FIG. 12B, despite the first side surface wall's 1204*b* deviation from upright, the second side surface wall 1206*b* stands upright, creating an asymmetric cross-sectional shape for the elongate trough. In FIG. 12C, the first side surface wall 1204*c* has an internal angle $\theta^1$ away from vertical and the second side surface wall 1206*c* has an internal angle $\theta^2$ away from vertical. In many embodiments, both $\theta^1$ and $\theta^2$ can each be any value greater than about 0° but less than or equal to about 15°. In other embodiments, the angles $\theta^1$ and $\theta^2$ can each be about 0.25° to about 10°. In still other embodiments, the angles $\theta^1$ and $\theta^2$ can each be about 0.25° to about 8°. In further embodiments, the angles $\theta^1$ and $\theta^2$ can each be about 0.25° to about 5°. In still further embodiments, the angles $\theta^1$ and $\theta^2$ can each be about 1° to about 10°. In some embodiments, $\theta^1$ and $\theta^2$ have the same value, creating a symmetric cross-sectional shape for the elongate trough. In alternate embodiments, $\theta^1$ and $\theta^2$ have the different values, creating an asymmetric cross-sectional shape for the elongate trough. Therefore, across many embodiments, at least one of the two side flume surface walls 1204*a*, 1204*b*, 1204*c* and 1206*a*, 1206*b*, 1206*c* can have an interior angle greater than or equal to about 0 degrees and less than or equal to about 15 degrees from upright.

Figures 13A, 13B, 13C:
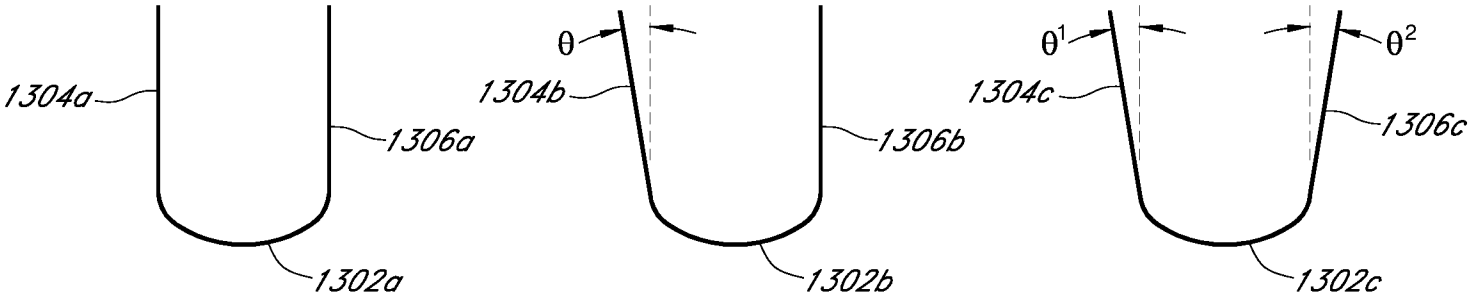
FIGS. 13A-13C illustrate cross-sections of various embodiments of the elongate trough having different cross-sectional shapes.
Figures 14A, 14B, 14C:
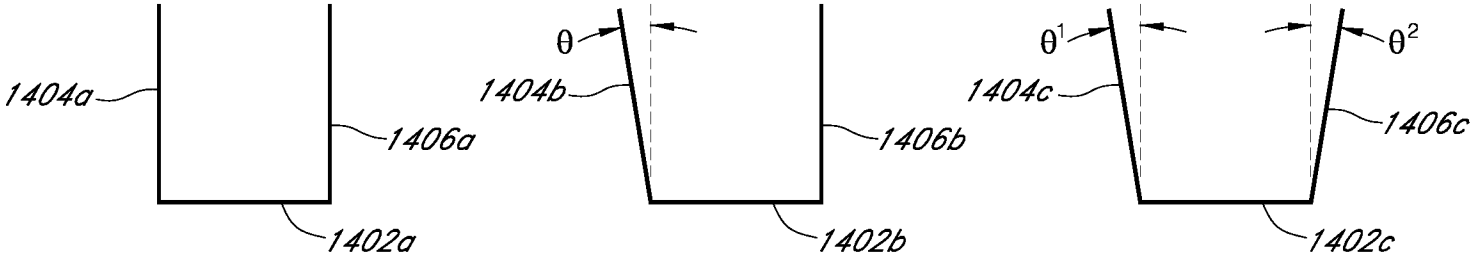
FIGS. 14A-14C illustrate cross-sections of various embodiments of the elongate trough having different cross-sectional shapes.

FIGS. 13A-13C depict analogous cross-sectional shapes for an elongate trough wherein the base surface wall 1302*a*, 1302*b*, 1302*c* is semi-elliptical, and FIGS. 14A-14C further depict analogous cross-sectional shapes for an elongate trough wherein the base surface wall 1402*a*, 1402*b*, 1402*c* is flat, creating a square base when both the first and second side surface walls 1404*a* and 1406*a* are vertical or perpendicular to base surface wall 1402*a* (shown in FIG. 14A).

In many embodiments of FIGS. 13A-13C, the angles $\theta$, $\theta^1$, and $\theta^2$ can each be any value greater than about 0° but less than or equal to about 15°. In other embodiments, the angles $\theta$, $\theta^1$, and $\theta^2$ can each be about 0.25° to about 10°. In still other embodiments, the angles $\theta$, $\theta^1$, and $\theta^2$ can each be about 0.25° to about 8°. In further embodiments, the angles $\theta$, $\theta^1$, and $\theta^2$ can each be about 0.25° to about 5°. In still further embodiments, the angles $\theta$, $\theta^1$, and $\theta^2$ can each be about 1° to about 10°. In some embodiments, $\theta^1$ and $\theta^2$ have the same value, creating a symmetric cross-sectional shape for the elongate trough. In alternate embodiments, $\theta^1$ and $\theta^2$ have the different values, creating an asymmetric cross-sectional shape for the elongate trough. Therefore, across many embodiments, at least one of the two side flume surface walls 1304*a*, 1304*b*, 1304*c* and 1306*a*, 1306*b*, 1306*c* can have an interior angle greater than or equal to about 0 degrees and less than or equal to about 15 degrees from upright In many embodiments of FIGS. 14A-14C, the angles $\theta$, $\theta^1$, and $\theta^2$ can each be any value greater than about 0° but less than or equal to about 15°. In other embodiments, the angles $\theta$, $\theta^1$, and $\theta^2$ can each be about 0.25° to about 10°. In still other embodiments, the angles $\theta$, $\theta^1$, and $\theta^2$ can each be about 0.25° to about 8°. In further embodiments, the angles $\theta$, $\theta^1$, and $\theta^2$ can each be about 0.25° to about 5°. In still further embodiments, the angles $\theta$, $\theta^1$, and $\theta^2$ can each be about 1° to about 10°. In some embodiments, $\theta^1$ and $\theta^2$ have the same value, creating a symmetric cross-sectional shape for the elongate trough. In alternate embodiments, $\theta^1$ and $\theta^2$ have the different values, creating an asymmetric cross-sectional shape for the elongate trough. Therefore, across many embodiments, at least one of the two side flume surface walls 1404*a*, 1404*b*, 1404*c* and 1406*a*, 1406*b*, 1406*c* can have an interior angle greater than or equal to about 0 degrees and less than or equal to about 15 degrees from upright. In some embodiments, the joints connecting side surface walls 1404*a*, 1404*b*, 1404*c*, 1406*a*, 1406*b*, 1406*c* to the base surface wall 1402*a*, 1402*b*, 1402*c*, are sharp angles (i.e., as depicted in FIGS. 14A-14C). In some embodiments, the joints connecting side surface walls 1404*a*, 1404*b*, 1404*c*, 1406*a*, 1406*b*, 1406*c* to the base surface wall 1402*a*, 1402*b*, 1402*c* are bent angles having some form of arcuate geometry to smooth the transition between the flat base surface wall 1402*a*, 1402*b*, 1402*c* and the side surface walls 1404*a*, 1404*b*, 1404*c*, 1406*a*, 1406*b*, 1406*c*. In some embodiments, the arcuate joint transition accounts for about 30% or less of the total length of width the base surface wall 1402*a*, 1402*b*, 1402*c*. In some embodiments, the arcuate joint transition accounts for about 20% or less of the total length of width the base surface wall 1402*a*, 1402*b*, 1402*c*.

Figure 15A:
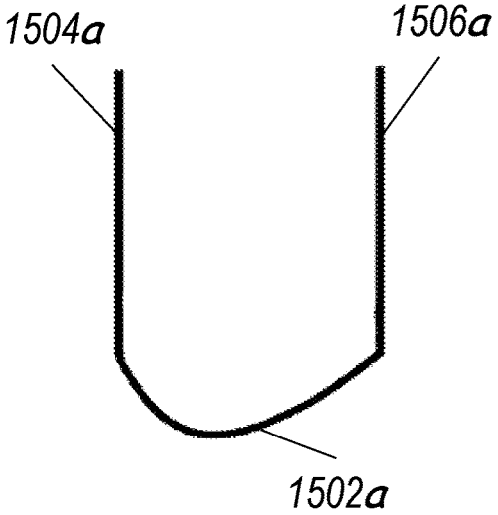
FIGS. 15A-15D illustrate cross-sections of various embodiments of the elongate trough having different cross-sectional shapes.
Figure 15B:
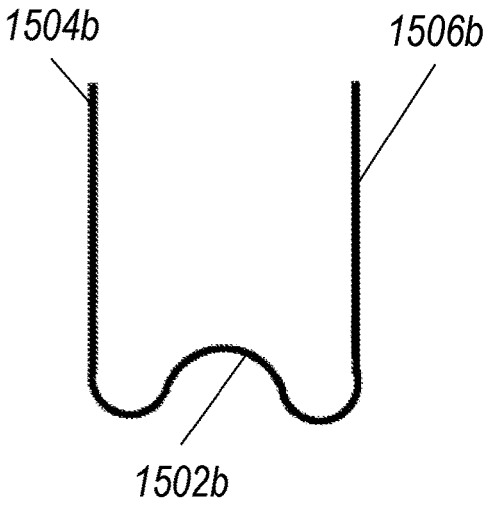
Figure 15C:
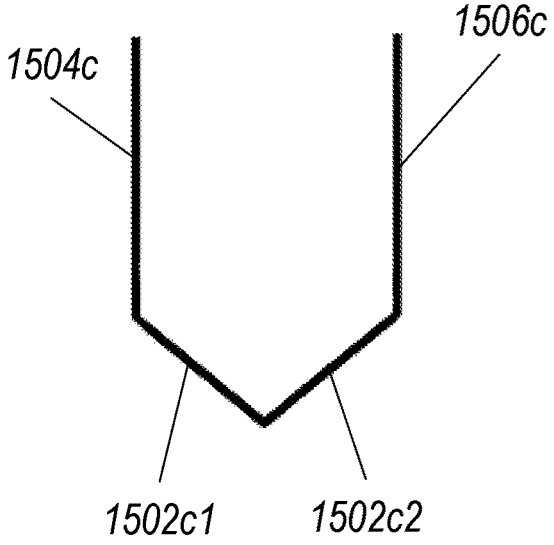
Figure 15D:
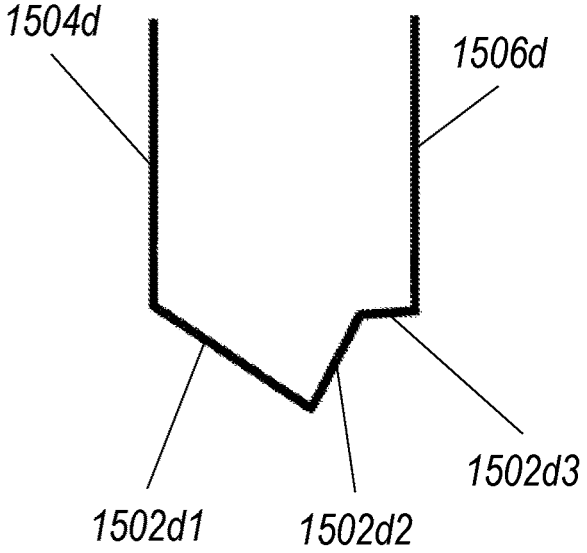

The embodiments of possible cross-sectional shapes for an elongate flume depicted in FIGS. 12A-12C, 13A-13C, and 14A-14C are intended to be illustrative and not limiting of the total possible cross-sectional shapes available. FIGS. 15A-15D depict further illustrative examples of cross-sectional shapes including various irregular shapes. As shown in FIG. 15A, an elongate trough can have a base surface wall 1502*a* having an arcuate but lopsided shape. As shown in FIG. 15B, an elongate trough can have a base surface wall 1502*b* having a waveform pattern. As shown in FIG. 15C, an elongate trough can have two base surface walls 1502*c*1 and 1502*c*2 to define a V-shape for a base. In other embodiments, an elongate trough can comprise any number of flume surface walls. FIG. 15D, for example, shows an embodiment having three base surface walls 1502*d*1, 1502*d*2, and 1502*d*3 forming a V-shape that forms a shoulder with the side surface wall 1506*d*. Although FIGS. 15A-15D are depicted as having vertical sidewalls and sharp joint transitions, one of skill in the art will appreciate that other embodiments can have sloping sidewalls and smoother, bent arcuate joint transitions as described above for FIGS. 12A-12C, 13A-13C, and 14A-14C.

For some embodiments, having a $\theta$, $\theta^1$, and $\theta^2$ greater than about 0° can be valuable to the production of clear ice during a freezing operation of the device. In certain embodiments of the device, clear ice forms on at least a portion of the base flume wall and the two side surface walls (as shown in FIG. 2). As discussed above, this arrangement can be considered "multi-directional freezing" in certain embodiments. Multi-directional freezing can greatly expedite clear ice production since ice can accumulate on multiple surfaces simultaneously to form a single piece of clear ice. However, when the portions of clear ice that are forming on opposite side surface walls begin to approach each other, at least two situations can occur that can damage the clarity of the ice. First, the space between the ice of the two side walls can fill in too quickly with new ice, therefore trapping air and other impurities inside a narrow portion of the ingot of ice. This creates a plane of cloudy ice that can run through a portion of the volume of the ingot, thus ruining the desired clear ice properties. Second, ice bridges can develop between the two opposing ice sheets accumulating on the side surface walls. These ice bridges disrupt the desired simple crystal lattice for the clear ice and can yield internal cracks, visible to an observer, in the final product once the spaces around the bridges are similarly frozen. This, too, ruins the desired clarity of the final product.

In some embodiments with certain flow rates, angling one or more side surface walls of an elongate trough can avoid or mitigate the above concerns. By sloping their planes of ice formation slightly away from each other, the device can, in certain embodiments, instead direct a more gradual filling in of ice from the bottom of a "v-shaped" or "u-shaped"

valley rather than suddenly abutting two vertical planes of clear ice into each other. In many embodiments, sloping the side surface walls does slightly lengthen the required time to produce an ingot of clear ice compared to an analogous elongate trough having vertical walls (see Example 1, below). In other embodiments, the device can generate an ingot of clear ice using elongate troughs having vertical side surface walls by intentional control of flow rate and temperature of the three side walls.

Once an ingot of ice has been produced, such as by an embodiment of the device of the above figures, it can be further processed to efficiently generate a plurality of comestibles with aesthetically pleasing shapes and/or additional properties as described herein.

Methods

Figure 16:
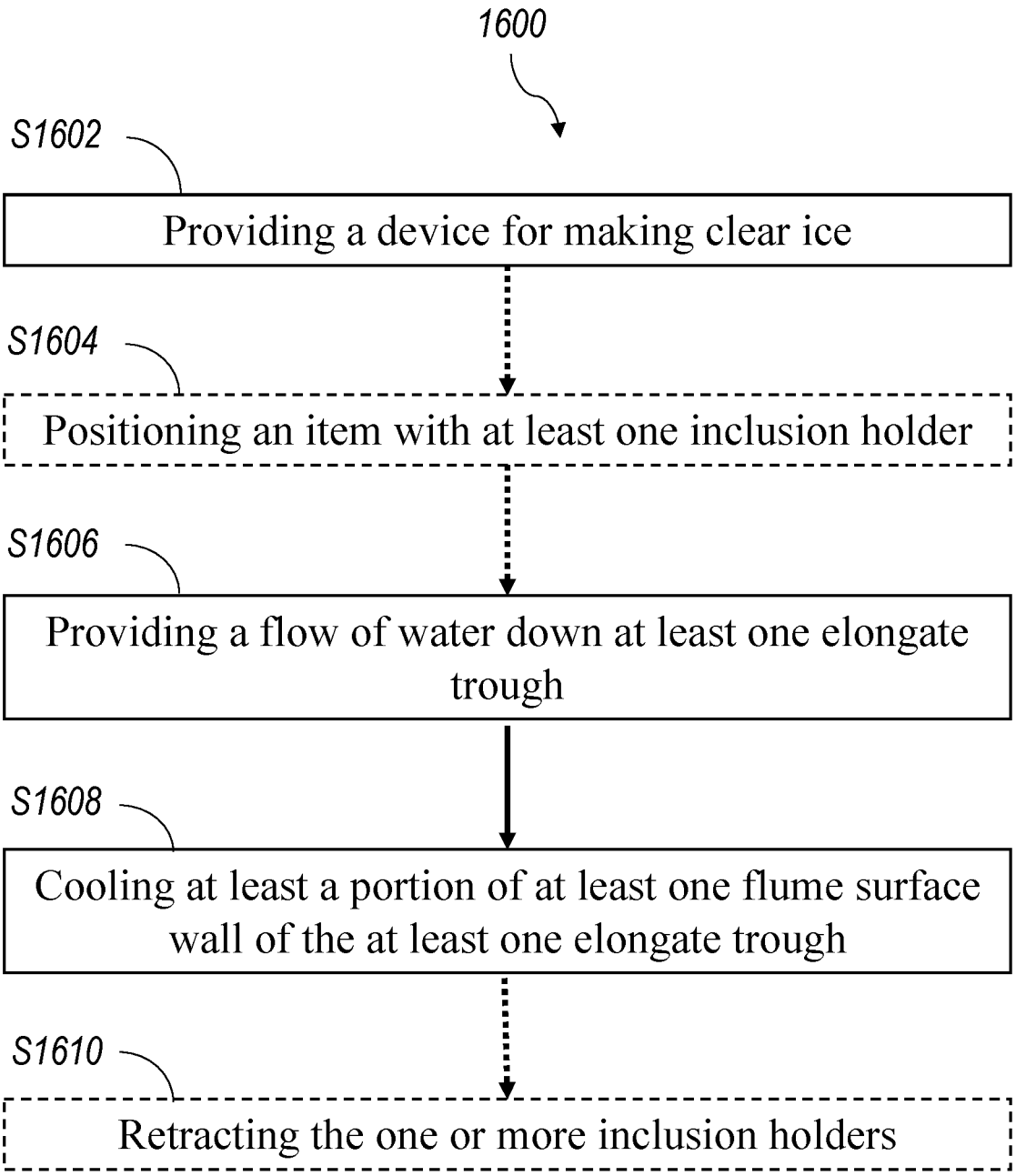
FIG. 16 illustrates a method of making clear ice.

As shown in FIG. 16, a method 1600 for producing clear ice of one embodiment includes providing a device for making clear ice in block S1602, optionally positioning an item with at least one inclusion holder in block S1604, providing a flow of water down at least one elongate trough in block S1606, circulating coolant through the at least one internal cooling cavity in block S1608, and optionally retracting the one or more inclusion holders in block S1610. The method functions to produce clear ice, particularly ingots of clear ice. The method is used for the production of clear ice for consumption in beverages but can additionally, or alternatively, be used for any suitable applications. The method can be configured and/or adapted to function for any suitable rapid freezing of liquids to produce frozen substances.

The method 1600 includes for providing a device for making clear ice according to block S1602. The device for making clear ice can be any of the embodiments of devices described elsewhere herein and depicted in the various figures above.

Next, at step S1604, the method 1600 optionally includes for positioning at least one item in at least one inclusion holder. As described above, the inclusion holders can secure an item within the space defined by an elongate trough during a freezing operation of the device such that the one or more items will be inside the ingot of clear ice upon completion of the freezing cycle. These inclusion holders, such as skewers, clips, or clamps, can be affixed to a lid of the device or elsewhere as described above.

At Step S1606, the method 1600 then includes providing a flow of water down at least one elongate trough. In many embodiments, the flow of water is provided to the elongate trough by at least one fluid intake valve positioned in the housing of the device or in the lid of the device and drained by at least one drain valve as described above. In other embodiments, the flow of water can be provided by other means appreciated by those of skill in the art. A sufficient flow rate of water is required in order to exclude air bubbles and impurities from the growing layer of clear ice on at least one flume surface wall during a freezing operation of the device in many embodiments.

At Step S1608, the method next includes cooling at least a portion of at least one flume surface wall of the at least one elongate trough to produce a growing layer of clear ice on the at least a portion of at least one flume surface wall. In many embodiments, this cooling can be performed by the circulation of coolant through at least one internal coolant cavity as described above. Also as discussed above, coolant is provided to the device by a coolant supply system via at least one coolant intake valve and is cycled out by at least one coolant outtake valve in many embodiments. In alternate embodiments, Step S1608 includes for providing and utilizing an alternative cooling apparatus including but not limited to cold plates, compressors, etc. for the generation of the temperatures needed to produce clear ice on the one or more flume surface walls.

In some embodiments, the at least a portion of at least one flume surface wall is cooled to a temperature of about 0° C. or less. In another embodiment, the at least a portion of at least one flume surface wall is cooled to about −45° C. In still other embodiments, the at least a portion of at least one flume surface wall is cooled to about 0° C. to about −20° C. In further embodiments, the at least a portion of at least one flume surface wall is cooled to about −2° C. to about −20° C. In further embodiments, the at least a portion of at least one flume surface wall is cooled to about −2° C. to about −35° C. In some embodiments, the at least a portion of at least one flume surface wall is adapted to hold a constant temperature during a freezing operation of the device. In other embodiments, the at least a portion of at least one flume surface wall is adapted to provide a variable temperature during a freezing operation of the device that changes according a predetermined temperature schedule.

In many embodiments, the cooling of step S1608 involves gradually decreasing the temperature of the flume surface walls over time. In many embodiments, a gradual decrease in temperature allows the device to overcome the inherent insulating properties of the ice as it forms. Because ice freezes directionally outwards from the flume surface walls that relay the chilled temperatures to the flow of water as shown in FIG. 2, the insulating properties of ice proportionally impede the heat transfer between the flume surface walls and flow of water as the layer of ice grows. In some embodiments, the temperature of the flume surface walls decreases from about 0° C. to about −30° C. over the duration of a freezing operation of the device. In other embodiments, the temperature of the flume surface walls decreases from about −2° C. to about −20° C. over the duration of a freezing operation of the device. In some embodiments, a freezing operation of the device lasts about 12 hours or less. In other embodiments, a freezing operation of the device lasts about 30 minutes to about 10 hours. In still further embodiments, a freezing operation of the device lasts about 30 minutes to about 4 hours. In additional embodiments, a freezing operation of the device lasts about 2 hours.

At optional Step S1610, the method 1600 provides for retracting the at least one inclusion holder. In many embodiments, the at least one inclusion holder should be retracted before the growing layer of clear ice comes into contact with the inclusion holder. In many embodiments, the at least one inclusion holder is retracted after a sufficient accumulation of ice has formed within the elongate trough such that the item remains at least partially embedded in the accumulation of ice upon retraction of the at least one inclusion holder. In some embodiments, the at least one inclusion holder is retracted by mechanical means. In some of these embodiments, the at least one inclusion holder is retracted mechanically after a certain duration of time of a freezing operation has passed or after a predetermined volume of ice has formed. In other embodiments, the at least one inclusion holder is retracted manually. In various embodiments wherein there are a plurality of inclusion holders, each or a subset can be collectively retracted simultaneously or individually at different times and/or at different volumes of formed ice.

Regardless of the presence or operation of any inclusion holders, the method 1600 allows for the flow of water and the circulation of coolant until a desired quantity of clear has formed within the at least one elongate trough. The resulting ingot of clear ice will have a length and cross-sectional shape determined by or related to those of the corresponding elongate trough in which it formed. Once the ingot of ice has formed to a predetermined or desired height or volume, the flow of water and circulation of coolant can be ceased, and the ingot of ice can be removed by a variety of means appreciated by those of skill in the art, including but not limited to letting the ingot slightly melt and removing it by mechanical means. In some embodiment, the slight melting can be provided by a circulation of warmer coolant in the at least one internal cooling cavities. In other embodiments, one or more side surface walls may further include one or more heating elements or heating means, such that an external surface of the ice ingot may be melted to facilitate ice removal from the device. In some embodiments, the ingot of ice can be removed vertically by lifting it out of an elongate trough, but in other embodiments, the ingot of ice can be removed horizontally by sliding it out of the elongate trough through an openable or removable end wall. In some embodiments, the device is adapted such that the ingot of ice adheres to a surface of the lid such that removing the lid additionally removes the ingot of ice with it.

FIGS. 17A-25B show various exemplary, non-limiting methods for forming clear ice using any ice device described herein or known in the art. As used herein, the terms "flow inlet" and "flow inlet valve" can be considered synonymous with "fluid intake valve" and will be used interchangeably. Similarly, as used herein, the term "outlet" and "outlet valve" can be considered synonymous with "drain valve." As one of skill in the art will appreciate, any of the parameters, temperature ranges, stages, rates, time periods, circulation, agitation, etc. of any of FIGS. 17A-25B may be exchanged with each other. Various parameters were adjusted in each of the figures. For example, temperature of ice forming surface (e.g., flume surface walls), temperature of water, time, end plateau (i.e., flow or temperature stays constant for a time period at the end of the method, mid-cycle plateau (i.e., flow or temperature stays constant for a time period during the recipe), flow paths (i.e., flow inlets that are located towards the outside of the elongate trough are being controlled separately from flow inlets towards a center of the elongate trough), flow direction (i.e., flow reversal; pump direction is switched such that the inlets become the outlets and the outlets become the inlets), circulation (e.g., maintain some degree of water flow at the ice formation boundary to prevent dissolved gasses from freezing in the water), initial cool down (i.e., an initial aggressive ramp down in temperature to bring the water in the molds close to freezing more quickly, for example an initial temperature drop to about 0° C. to about −15° C.), annealing (i.e., period at the end of the method after the ice has been formed that allows for the temperature gradient in the ice to lessen or reduce internal stresses that can lead to cracking), and flow rate of the coolant. For example, one or more temperature plateaus may be from about 3 minutes to about 100 minutes. Further for example, an annealing period may be characterized by a coolant source temperature between about −2° C. and about 15° C. and the percentage max flow of about 0% to about 5%. As shown below, each step in each method may include or comprise about 1 to about 20 minutes; about 2 minutes to about 15 minutes; about 5 minutes to about 10 minutes; substantially 5 minutes; substantially 6 minutes; substantially 8 minutes; about less than 10 minutes; etc. As shown in the following figures, the initial steps may vary in time from about 5 minutes to about 10 minutes and then the subsequent steps may vary in time from about 2.5 minutes to about 7.5 minutes. Although, as one of skill in the art will appreciate decreasing or increasing a step by about 1 minute to about 10 minutes will not depart substantially from the scope of this disclosure.

In some embodiments, a method for forming clear ice includes: providing a device, for example, any of the above embodiments; optionally inserting a skewer or clip through the lid, the skewer or clip being coupled to an item or configured to release a fluid into a cavity in the ice (e.g., skewer defines one or more apertures); circulating, using the fluid inlet and outlet valves, a fluid in the elongate trough; optionally varying overtime one or both of: a temperature of the cooling apparatus or source or a fluid flow, through the fluid inlet valve, as a percentage of max flow; and optionally retracting the skewer or clip when the ice formation encases at least a portion of the item.

As shown above, in some embodiments, temperature of the flume surface walls (hereinafter, "surface temperature") is varied (e.g., 0° C. and about −25° C. or any of the ice making methods described elsewhere herein); in other embodiments, the flow rate of water (hereinafter, "water flow rate") is varied (e.g., percentage of max water flow between about 5% and about 100% or any of the ice making methods described elsewhere herein). In some embodiments, both surface temperature and water flow rate are varied. In some embodiments, neither temperature nor flow rate are varied. In various other embodiments, the temperature of the water flowing through the elongate troughs (hereinafter "water temperature) can be varied solely or in addition to the other parameters named above.

In some embodiments, the device is configured to receive an inclusion holder (e.g., a skewer or clip), such that the method includes inserting the skewer or clip and optionally retracting the skewer or clip at a predetermined time. The predetermined time is dependent on a type of item coupled to the skewer, dependent on a volume of the elongate trough, a random predetermined time, or combination thereof. In some embodiments, ice formation is monitored via a sensorized mold and/or skewer/clip such that the skewer or clip is removed or retracted based on a progress of ice formation. The method may optionally include releasing the ice from the elongate trough with the item encased therein, for example via gravity, manual removal, automatic removal (e.g., ejector pin, air, hydraulics, etc.). In some embodiments, the method optionally includes sealing a lid to the device, for example via a gasket, pressure seal, screw type seal, etc.

Figure 17B:
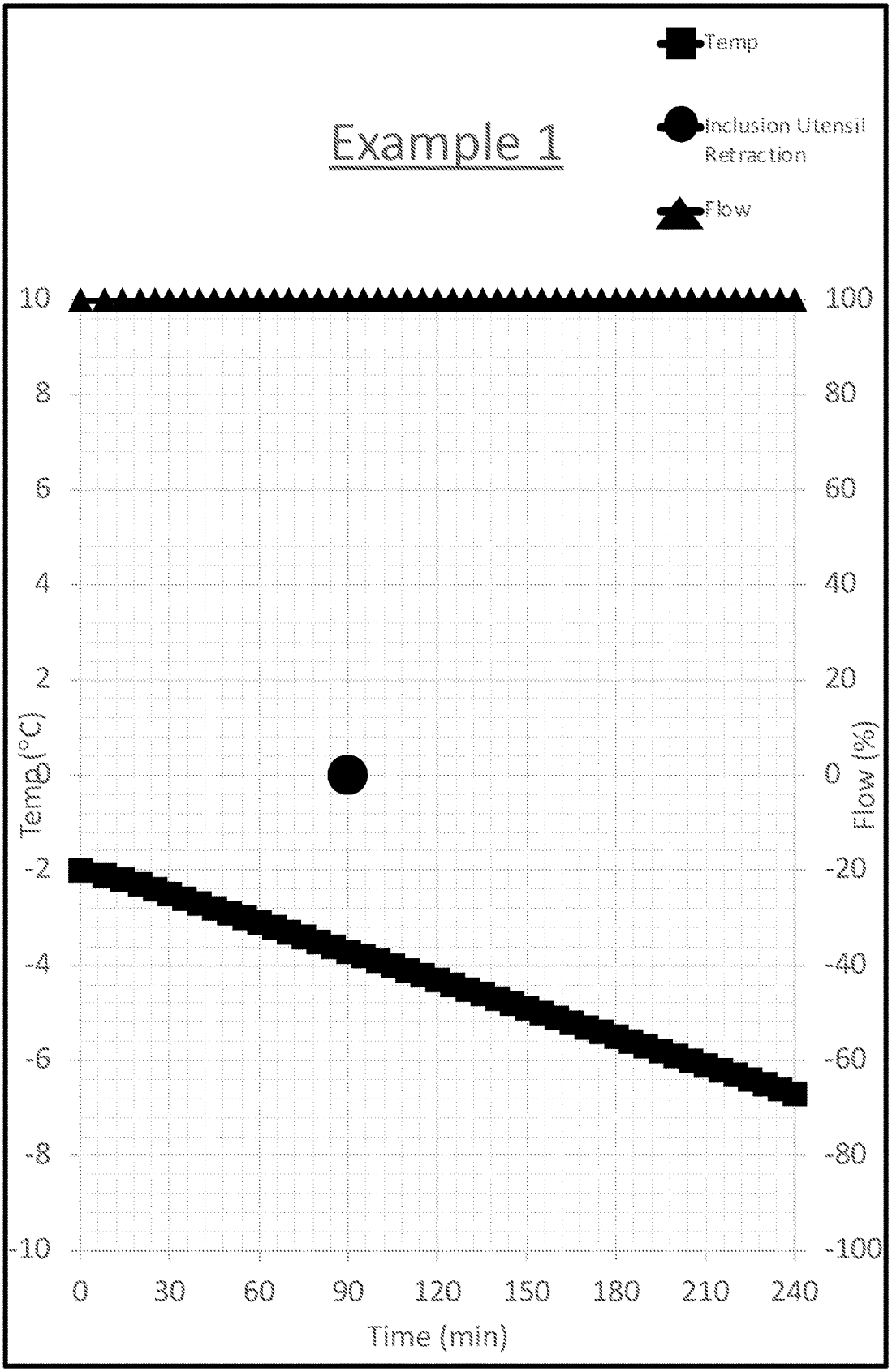

FIGS. 17A-17B show varied surface temperature over time at a constant flow. As shown in FIG. 17A, surface temperature is decreased incrementally over time. The size of the increments may vary over time; alternatively, the increments may not vary over time (i.e., are fixed), such that increment remains the same over time. In one exemplary embodiment, the increment is 0.1° C., such that the surface temperature decreases by an increment of about 0.1° C. over time. In other embodiments, the increment may be less than about 0.1° C. or more than about 0.1° C. In some embodiments, the increment may be from about 0.25° C. to about 5° C.; 0.5° C. to about 5° C.; about 1° C. to about 5° C.; about 0.5° C. to about 3° C.; about 0.5° C. to about 2.5° C.; etc.

Further, as shown in FIGS. 17A-17B, a surface temperature variation may be from about 0° C. to about −10° C.; about 0° C. to about −25° C.; about 0° C. to about −10° C.; about −2° C. to about −7° C.; about −1° C. to about −10° C.; etc. For example, the surface temperature may decrease gradually over time. In the example shown in FIGS. 17A-

17B, the percent max water flow remains at 100% through the duration of the ice making method. Alternatively, as one of skill in the art will appreciate, and as shown elsewhere herein, the percent max water flow may vary over time.

Further, as shown in FIGS. 17A-17B, a skewer or clip may be retracted at one or more of: a predetermined time, based on a degree of ice formation, based on a volume of ice formation, based on a type of inclusion or item coupled to the skewer or clip, based on a sensor reading (e.g., temperature, clarity of ice, volume of ice, etc.) or a combination thereof. As shown in FIGS. 17A-17B and for any of the embodiments described herein, a skewer or clip may be retracted after about 30 minutes to about 180 minutes; about 45 minutes to about 165 minutes; about 30 minutes to about 140 minutes; about 45 minutes to about 125 minutes; about 60 minutes to about 110 minutes; about 75 minutes to about 90 minutes; at about 90 minutes; at about 120 minutes; etc. from or after the start time (time=0) of the method. Alternatively, or additionally, in any of the embodiments described herein, a skewer or clip, may include a heating means (e.g., heating element, heating coils, etc.) such that the skewer or clip may be heated and retracted at any time during or after the ice making process.

Figure 18B:
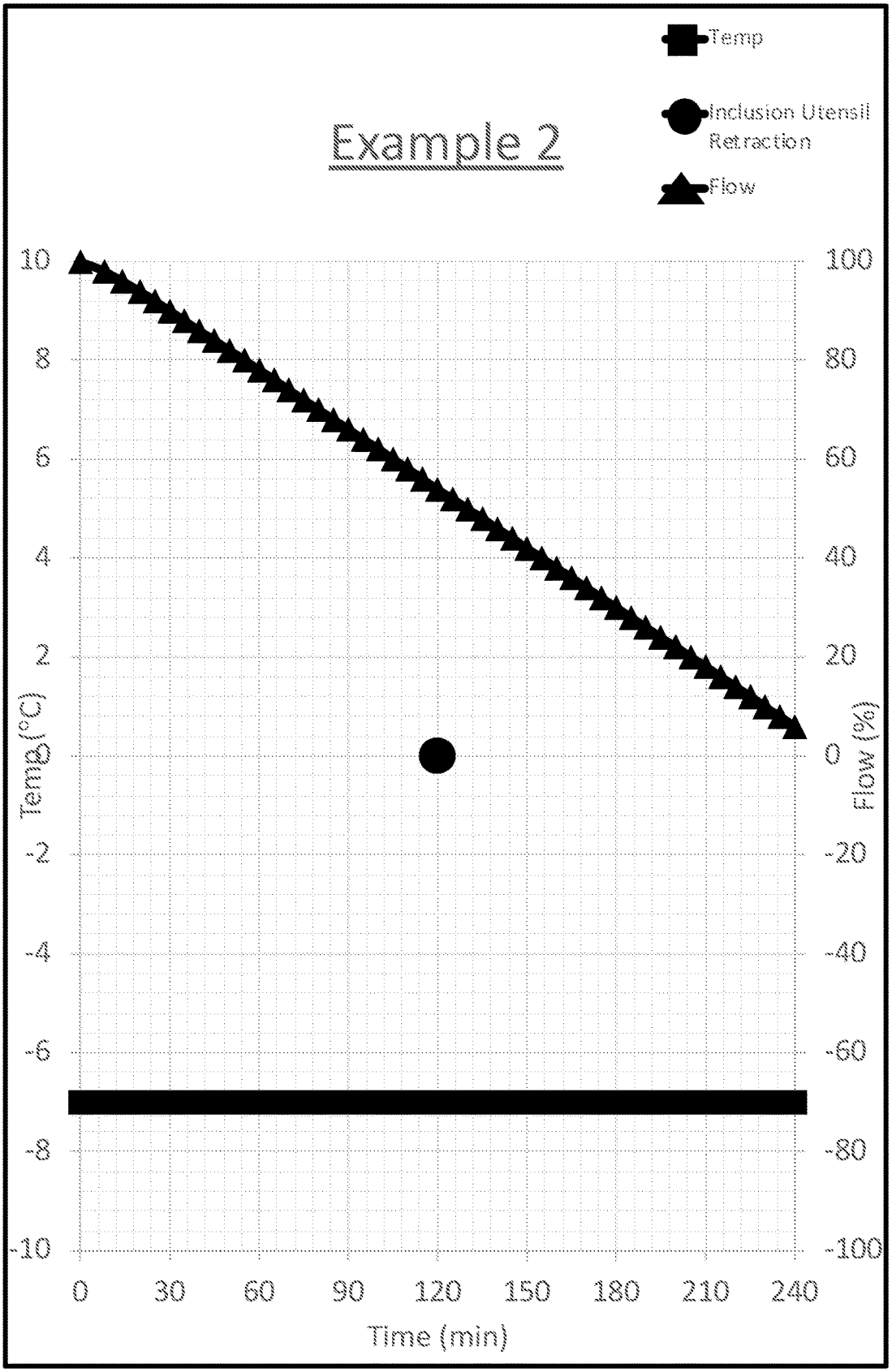

FIGS. 18A-18B show varied flow water rate over time at a constant surface temperature. As shown in FIG. 18A, water flow rate, as a percentage of max water flow, is decreased incrementally over time. The size of the increments may vary over time; alternatively, the increments may not vary over time, such that increment remains the same over time. In one exemplary embodiment, the increment is about 2%, such that the water flow rate decreases by an increment of about 2% over time. In other embodiments, the increment may be less than about 2% or more than about 2%. In some embodiments, the increment may be from about 0.5% to about 95%; about 1% to about 95%; about 2% to about 10%; about 1% to about 5%; about 5% to about 10%; about 5% to about 95%; about 10% to about 90%; about 15% to about 85%; about 20% to about 80%; about 25% to about 75%; about 30% to about 70%; about 35% to about 65%; about 40% to about 60%; about 45% to about 55%; about 45% to about 50%; etc. For example, the percent max water flow may decrease gradually over time. In the example shown in FIGS. 18A-18B, the surface temperature remains constant or fixed during the method. For example, the surface temperature may remain close to or at about −5° C. to about −10° C. For example, the surface temperature may remain at about or substantially −7° C. Alternatively, as one of skill in the art will appreciate, and as shown elsewhere herein, the surface temperature may vary over time. In this embodiment, the skewer or clip is retracted after about or substantially 120 minutes from the start (time=0) of the method.

Figure 19B:
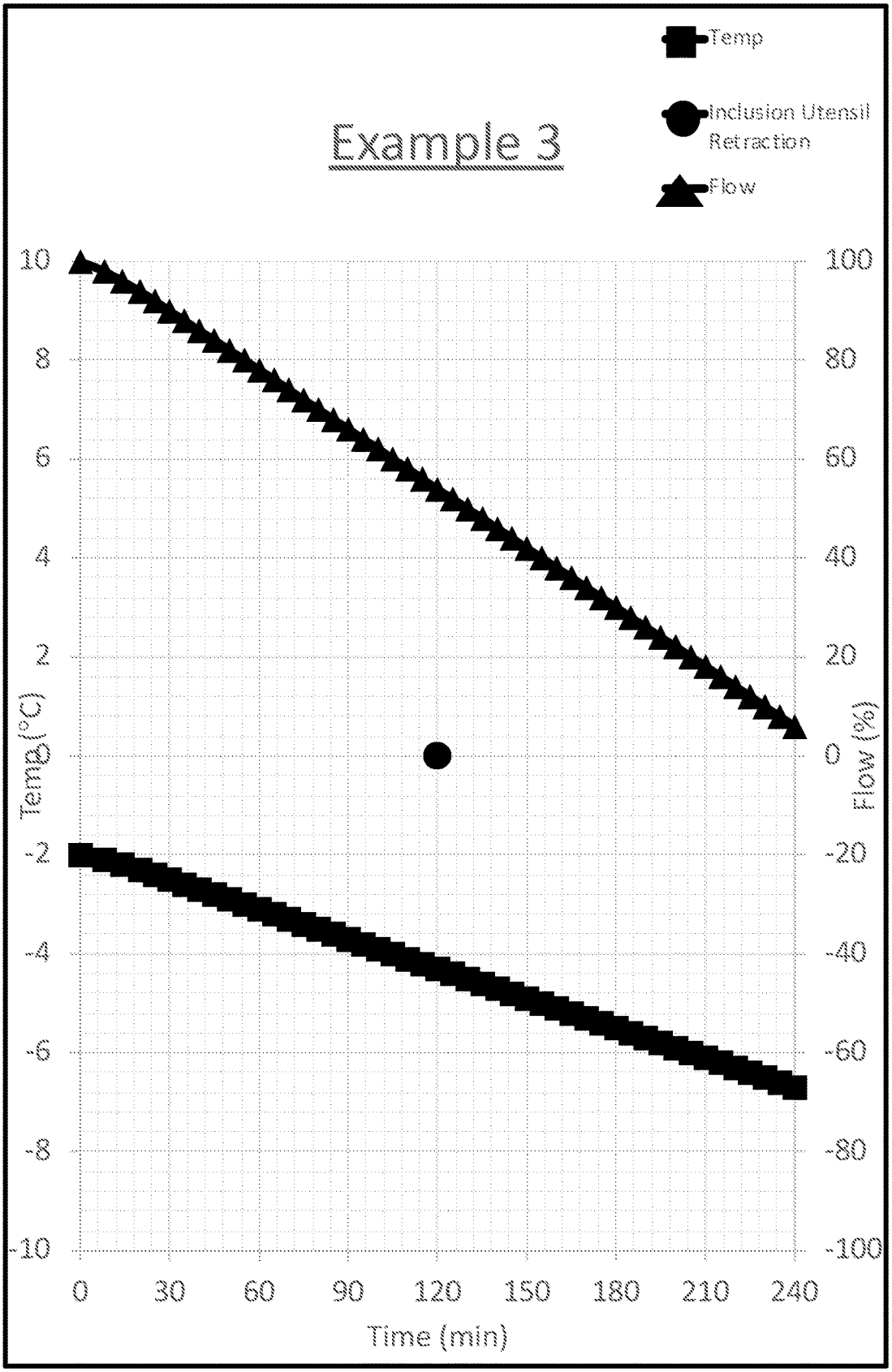

FIGS. 19A-19B show varied water flow rate and surface temperature over time. As one can appreciate, FIGS. 19A-19B show a combination of the methods of FIGS. 17A-17B and FIGS. 18A-18B. In this embodiment, both the surface temperature and the water flow rate are varied over time. The variation may be incremental, at a fixed interval, or variable, in a defined pattern or stochastic within a defined range.

Figure 20B:
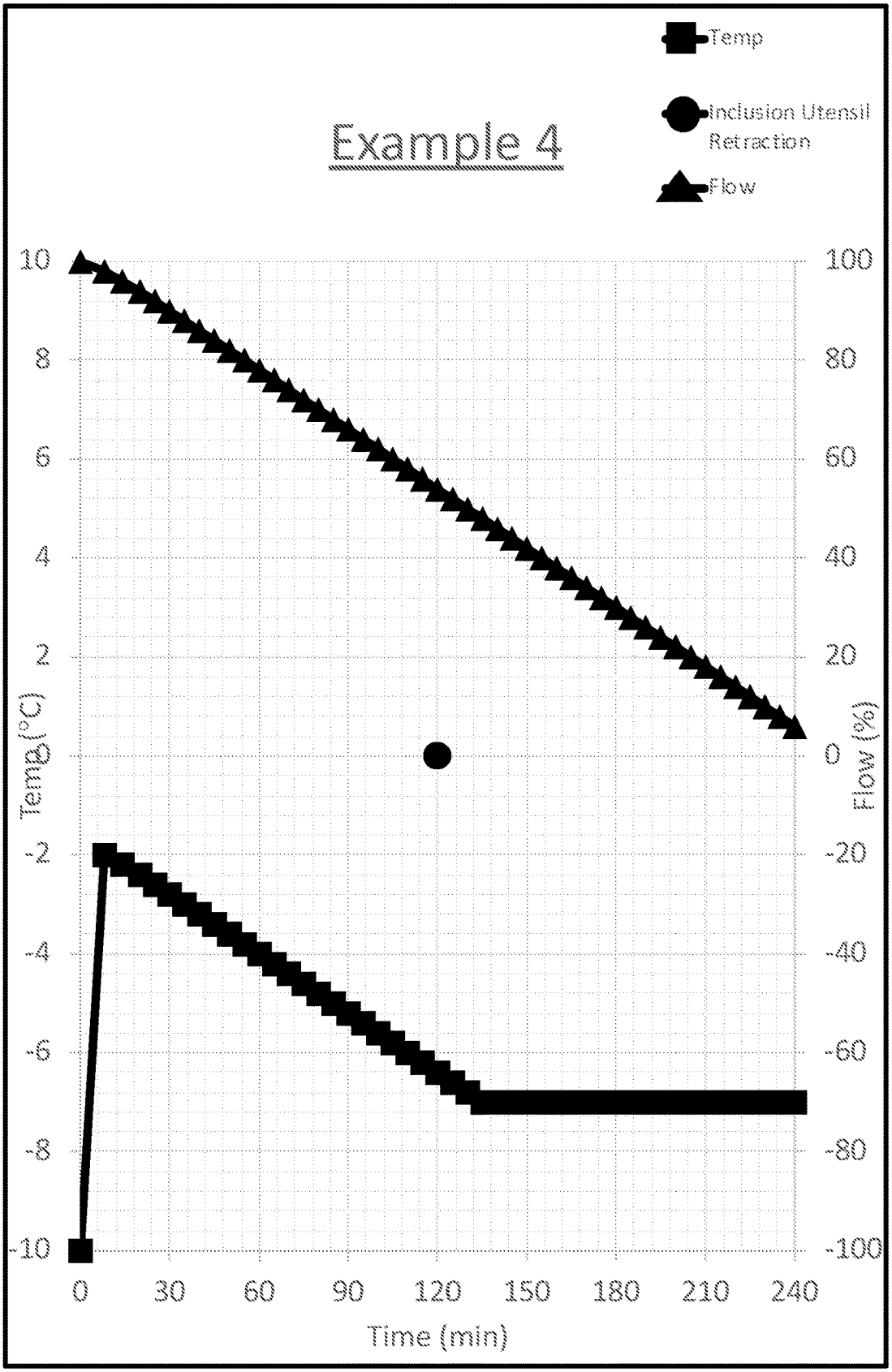

FIGS. 20A-20B show a method of making clear ice. The method includes an initial cool down cycle where the surface temperature remains fixed for a period of time. For example, the surface temperature may be set at or below about 0° C.; at or below about −2° C.; at or below about −4° C.; at or below about −6° C.; at or below about −8° C.; at or below about −10° C.; at or below about −12° C.; at or below about −14° C.; at or below about −16° C.; at or below about −18° C.; at or below about −20° C. The surface temperature may be set between about 0° C. and about −25° C.; about −5° C. and about −20° C.; about −10° C. and about −15° C.; or about or substantially −10° C. The period of time may range from about 1 minute to about 20 minutes about 1 minute to about 15 minutes; about 5 minutes to about 15 minutes; about 5 minutes to about 10 minutes; about 6 minutes to about 8 minutes; etc. This initial cool down cycle may also be referred to herein as a start plateau or beginning plateau. Further, as shown in FIGS. 20A-20B, the method may include an end plateau, such that the surface temperature is kept substantially constant for a period of time. For example, the surface temperature may be maintained between about 0° C. and about −15° C.; about −5° C. and about −15° C.; about −5° C. and about −10° C.; about −6° C. and about −8° C.; etc. for about 5 to about 150 minutes; about 10 minutes to about 145 minutes; about 20 minutes to about 140 minutes; about 75 minutes to about 115 minutes; about 90 minutes to about 110 minutes; about 100 minutes to about 110 minutes; etc. In between the initial plateau and the end plateau, the surface temperature may be incrementally decreased from about −2° C. to about −7° C. For example, the surface temperature may incrementally decrease by 0.2° C. between the beginning and end plateaus. Alternatively, the increment may be between about 0.1° C. and about 0.5° C.; about 0.1° C. and 1° C.; about 0.1° C. and about 0.3° C.; about 0.1° C. and about 0.4° C.; etc. For the embodiment shown in FIGS. 20A-20B, the water flow rate may vary over time as shown and described for FIGS. 19A-19B. Further, in the embodiment of FIGS. 20A-20B, the skewer or clip is retracted at about or substantially 120 minutes from a start of the method, as described elsewhere herein.

Figure 21B:
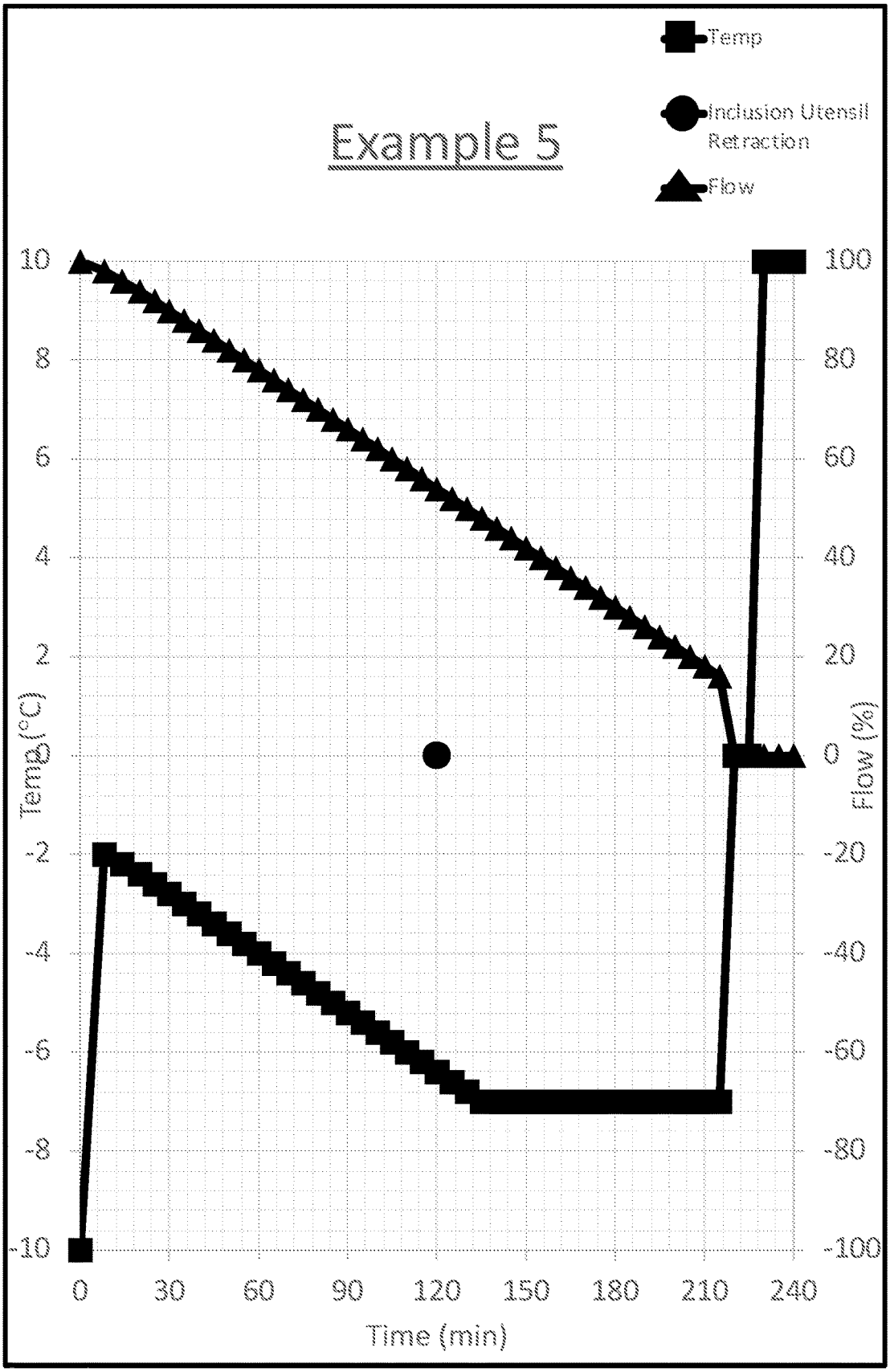

FIGS. 21A-21B show a method of making clear ice that is similar to that of FIGS. 20A-20B, except that the method of FIGS. 21A-21B further includes an annealing phase at or near the end of the method. For example, an annealing phase may comprise a period of warmer surface temperatures to lessen or reduce internal stress that may lead to cracking. In some embodiments, an annealing phase may be characterized by one or more surface temperature periods that range in temperature from about −5° C. to about 20° C.; about −2° C. to about 15° C.; about 0° C. to about 10° C., or any range or subrange therebetween. For example, an annealing phase may include a first period at a surface temperature between about −5° C. and about 5° C. and a second period at a surface temperature between about 5° C. and about 15° C. Alternatively, an annealing phase may be characterized by one period at a fixed surface temperature or a plurality of periods, each at a different temperature from a previous temperature and a future temperature. Each period of time may range from about 2 minutes to about 60 minutes; about 5 minutes to about 30 minutes; about 5 minutes to about 25 minutes; about 5 minutes to about 20 minutes; about 5 minutes to about 15 minutes; about 10 minutes to about 15 minutes; or any range or subrange therebetween. Further, in the embodiment of FIGS. 21A-21B, the skewer or clip is retracted at about or substantially 120 minutes from a start of the method, as described elsewhere herein.

Figure 22B:
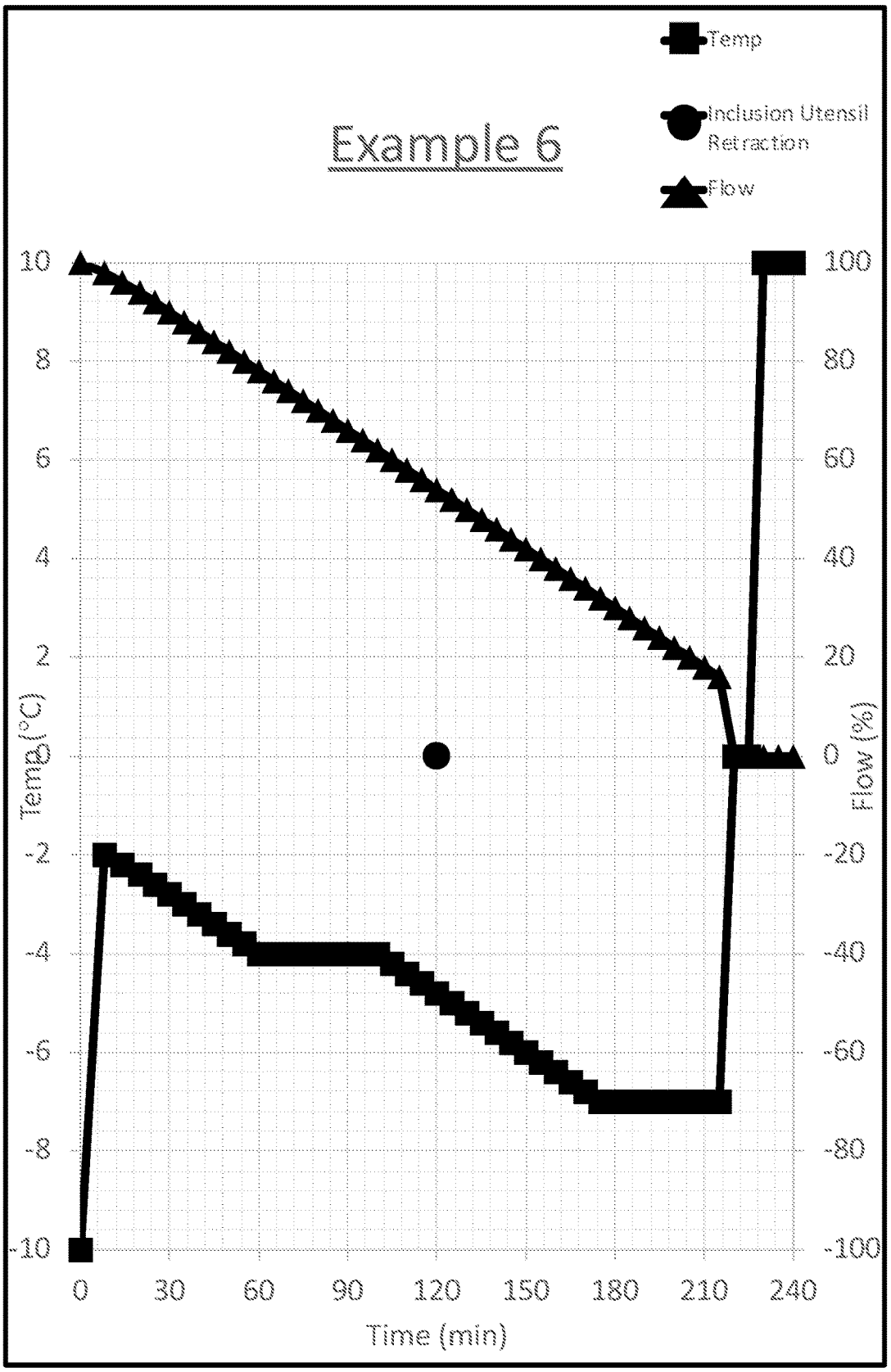

FIGS. 22-22B show a method of making clear ice that is similar to that of FIGS. 21A-21B, except that the method of FIGS. 22A-22B further includes a mid-method plateau, such that the surface temperature is kept substantially constant for a period of time. For example, the surface temperature may be maintained between about −10° C. and about 0° C.; about −8° C. and about 0° C.; about −6° C. and about 0° C.; about −6° C. and about −2° C.; about −5° C. and about −2° C.; about −5° C. and about −3° C.; or any range or subrange therebetween for about 5 to about 100 minutes; about 10 minutes to about 95 minutes; about 20 minutes to about 90 minutes; about 30 minutes to about 75 minutes; about 30 minutes to about 60 minutes; about 30 minutes to about 50 minutes; etc. In one example, a mid-cycle plateau may include a surface temperature of about −4° C. for about 45 minutes. In between the initial plateau and the end plateau, the surface temperature may be incrementally decreased from about −2° C. to about −7° C. For example, the surface temperature may incrementally decrease by 0.2° C. between the beginning and end plateaus. Alternatively, the increment may be between about 0.1° C. and about 0.5° C.; about 0.1° C. and 1° C.; about 0.1° C. and about 0.3° C.; about 0.1° C. and about 0.4° C.; etc. For the embodiment shown in FIGS. 20A-20B, the water flow rate may vary over time as shown and described for FIGS. 19A-19B. Further, in the embodiment of FIGS. 20A-20B, the skewer or clip is retracted at about or substantially 120 minutes from a start of the method, as described elsewhere herein.

Figure 23B:
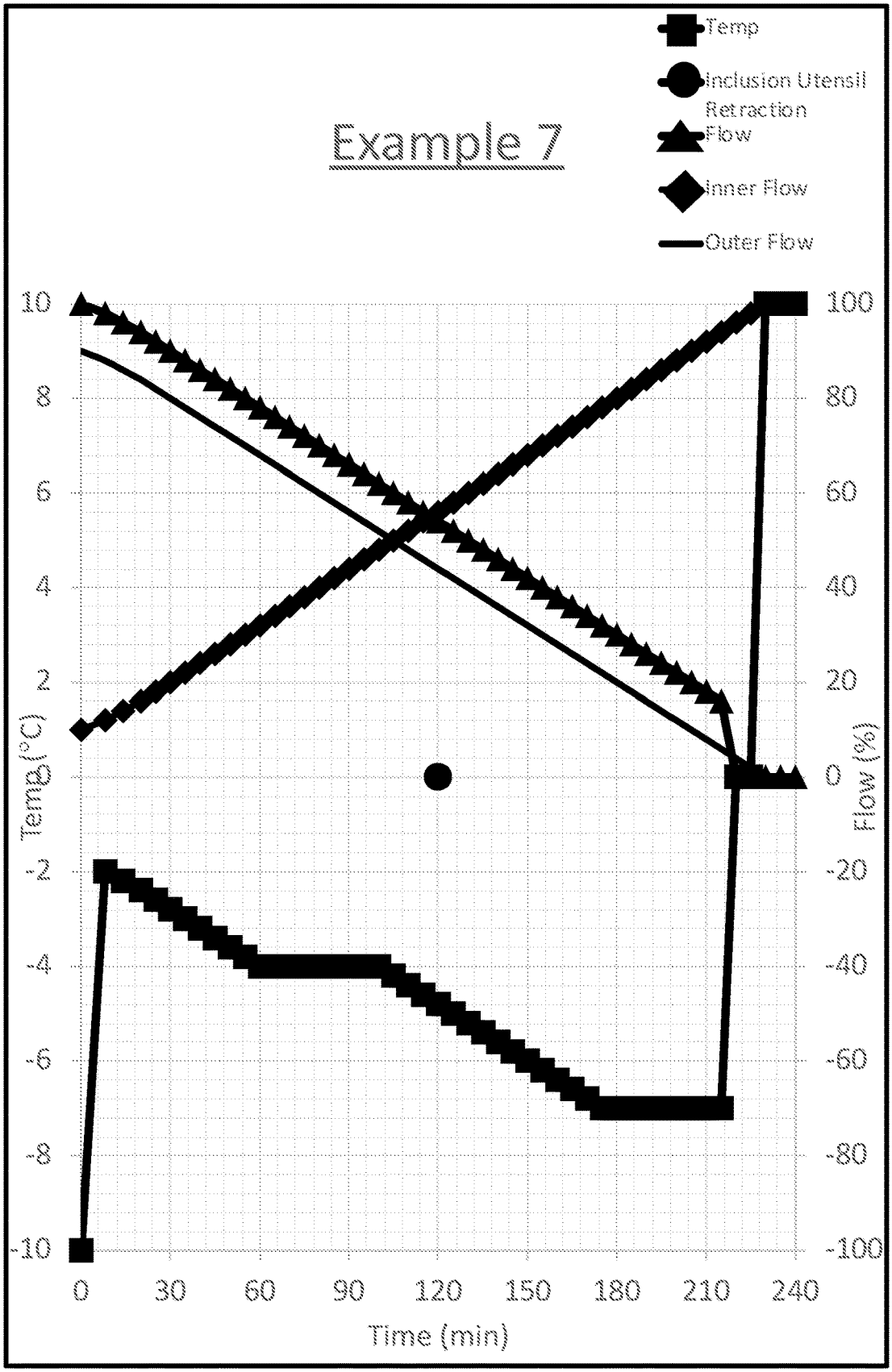

FIGS. 23A-23B show another method of making clear ice. The method is similar to that shown in FIGS. 22A-22B, except the method of FIGS. 23A-23B includes shifting or adjusting between fluid inlet valves positioned in an inner region and fluid inlet valves positioned in an outer region. In one exemplary embodiment, the inner and outer inlet valves are arranged similar to the embodiment shown in FIG. 11A, with the term "inner" meaning towards the middle of the length of the elongate trough. As shown in FIGS. 23A-23B, the overall water flow rate, as a percentage of max water flow, decreases incrementally over time. The size of the increments may vary over time; alternatively, the increments may not vary over time, such that increment remains the same over time or is fixed. In one exemplary embodiment, the increment is about 2%, such that the flow rate decreases by an increment of about 2% over time. In other embodiments, the increment may be less than about 2% or more than about 2%. In some embodiments, the increment may be from about 0.5% to about 95%; about 1% to about 95%; about 2% to about 10%; about 1% to about 5%; about 5% to about 10%; about 5% to about 95%; about 10% to about 90%; about 15% to about 85%; about 20% to about 80%; about 25% to about 75%; about 30% to about 70%; about 35% to about 65%; about 40% to about 60%; about 45% to about 55%; about 45% to about 50%; etc. For example, the percent max water flow may decrease gradually over time. However, as shown in FIGS. 23A-23B, the overall water flow rate or percent may comprise a combination of flow from flow inlet valves in an inner region and flow inlet valves in an outer region. For example, as water flow into the mold from the inner region inlet valves increases over time, water flow into the mold from the outer region inlet valves decreases over time. This is exemplified in the graph of FIG. 23B, which shows the intersection between the decreasing outer region water flow and the increasing inner region water flow. For example, the intersection point may be characterized by equal or substantially equal water flow from the inner region and outer region inlet valves (e.g., about 50% of max coming from inner region and about 50% of max coming from outer region). As shown in FIG. 23A, flow through the inlet valves in the inner region increases incrementally over time. For example, the increment may be about 0.25% to about 5%; about 0.5% to about 5%; about 0.75% to about 5%; about 0.5% to about 4%; about 0.5% to about 3%; about 1% to about 3%; about 1.5% to about 2.5%; about 1% to about 50%; about 2% to about 20%; etc. The water flow through the inlet valves in the inner region may start or begin at a flow of about 0% to about 50%; about 0% to about 25%; about 5% to about 20%; about 10% to about 20%; about 5% to about 15%; about 8% to about 12%; etc. As shown in FIG. 23A, flow through the inlet valves in the outer region decreases incrementally over time. For example, the increment may be about 0.25% to about 5%; about 0.5% to about 5%; about 0.75% to about 5%; about 0.5% to about 4%; about 0.5% to about 3%; about 1% to about 3%; about 1.5% to about 2.5%; about 1% to about 50%; about 2% to about 20%; etc. The water flow through the inlet valves in the outer region may start or begin at a flow of about 50% to about 100%; about 50% to about 95%; about 60% to about 95%; about 70% to about 95%; about 80% to about 95%; about 90% to about 95%; about 85% to about 95%; about 88% to about 93%; etc. Alternatively, water flow through the inner region inlet valves may decrease over time and the water flow through the outer region inlet valves may increase over time. Alternatively still, the water flow through the inner region inlet valves may stay constant or fixed while the water flow through the outer region inlet valves increases or decreases over time. Alternatively still, the water flow through the outer region inlet valves may stay constant or fixed while the water flow through the inner region inlet valves increases or decreases over time.

Figure 24B:
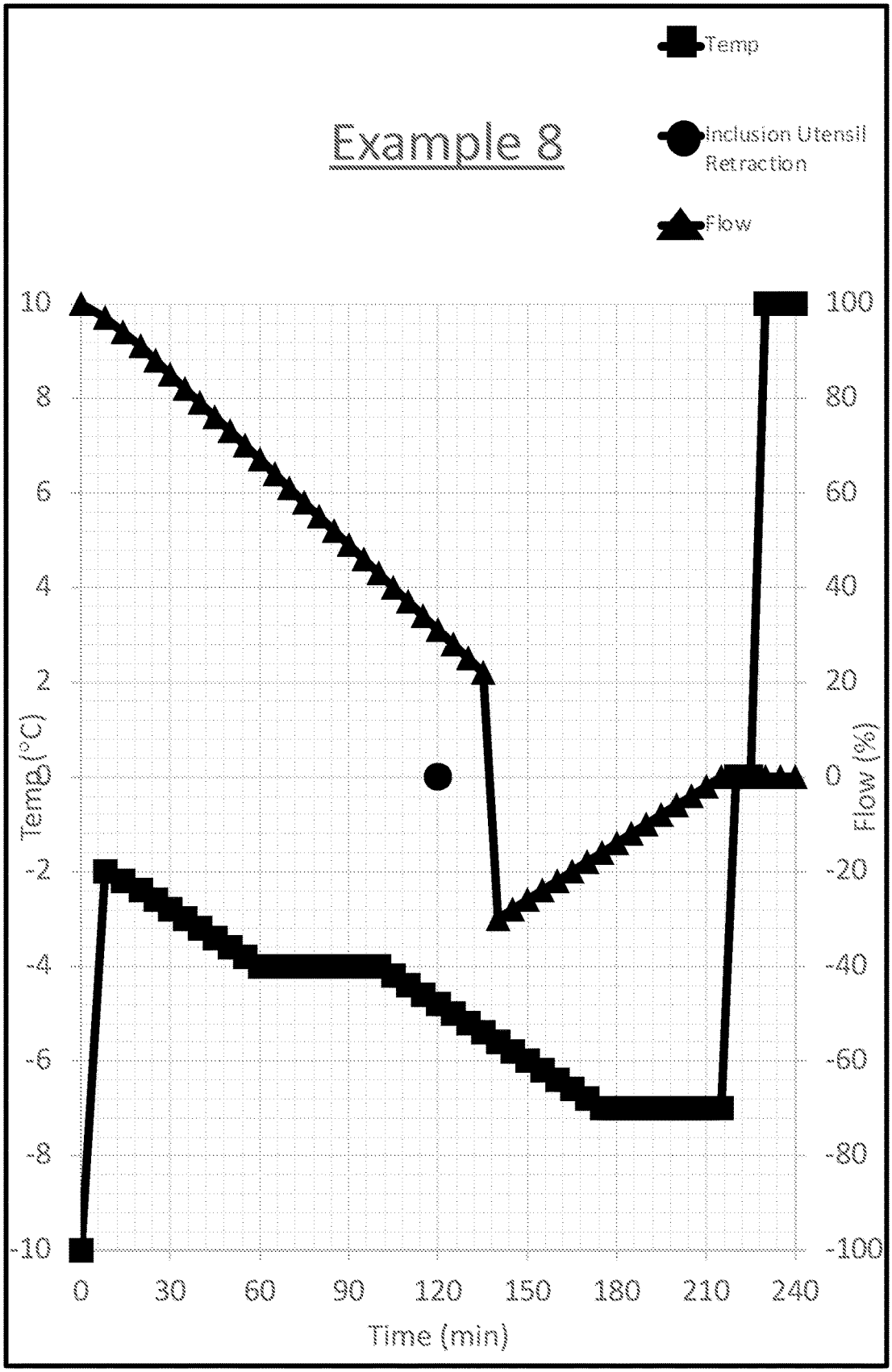

FIGS. 24A-24B show a method of making clear ice. The method of FIGS. 24A-24B are similar to that shown in FIGS. 22A-22B, except that instead of the percent max water flow decreasing incrementally over time, the method of FIGS. 24A-24B include an incremental decrease in water flow over time followed by a period of water flow reversal. Flow reversal means that inlet valves switch to outlet valves and/or outlet valves switch to inlet valves. As shown in FIGS. 24A-24B, the percentage max water flow incrementally decreases over time. For example, the increment may be between about 1% to about 10%; about 1% to about 8%; about 1% to about 6%; about 1% to about 4%; about 2% to about 4%; about 2% to about 5%; etc. for about 50 minutes to about 180 minutes; about 60 minutes to about 170 minutes; about 70 minutes to about 160 minutes; about 70 minutes to about 160 minutes; about 80 minutes to about 150 minutes; about 100 minutes to about 150 minutes; about 125 minutes to about 145 minutes; about 130 minutes to about 140 minutes; etc. A starting water flow percent may be between about 100% to about 50%; about 90% to about 50%; about 80% to about 60%; about 100% to about 90%; etc. An end water flow percent may be between about 0% to about 50%; about 5% to about 45%; about 10% to about 40%; about 15% to about 35%; about 20% to about 30%; about 20% to about 25%; etc. This period of positive flow may be followed by a period of flow reversal as described above. In this embodiment, water flow may be reversed that the fluid inlet valve becomes a fluid outlet valve, such that the water flow percent represents a flow of liquid out of the elongate trough. For example, reversed water flow may occur at between about 0% to about 50%; about 5% to about 45%; about 10% to about 40%; about 15% to about 35%; about 20% to about 35%; about 25% to about 35% about 28% to about 33% of max flow; etc. The period of water flow reversal may be between about 5 minutes to about 100 minutes; about 15% minutes to about 90 minutes; about 25 minutes to about 80 minutes; about 30 minutes to about 80 minutes; about 40 minutes to about 80 minutes; about 50 minutes to about 80 minutes; about 60 minutes to about 80 minutes; about 65 minutes to about 75 minutes; about 70 minutes to about 80 minutes; etc. In some embodiments, as shown in FIGS. 23A-23B, the annealing period may be characterized by a period of about 0% flow such that no liquid is coming into or out of the elongate trough. In other embodiments, the annealing period may be characterized by low water flow, for example 1% to about 10%; about 5% to about 15%; about 5% to about 10%; etc.

Figure 25B:
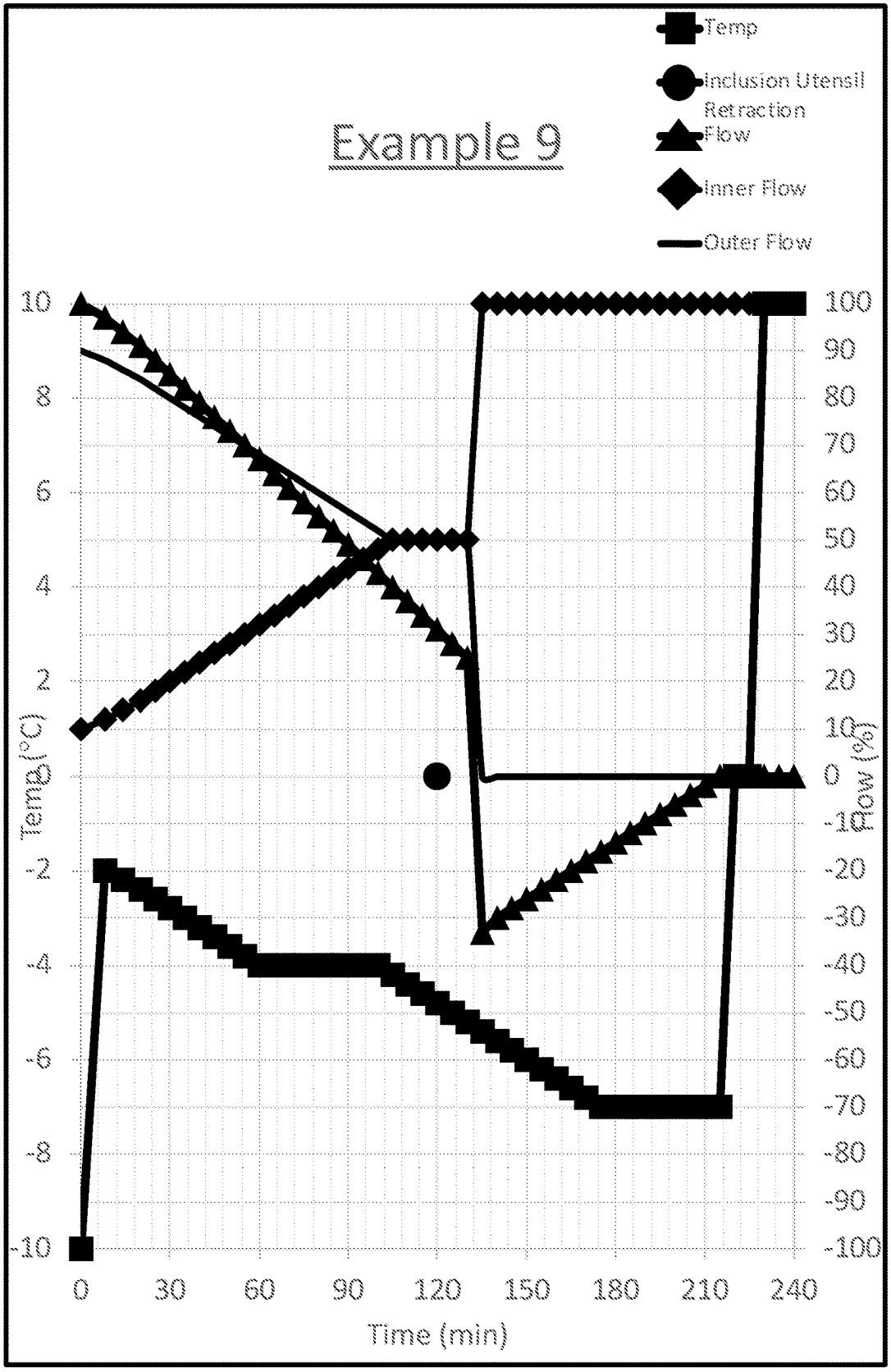

FIGS. 25A-25B show a method of making clear ice similar to a combination of the methods shown in FIGS. 23A-23B and FIGS. 24A-24B. In this embodiment, during the water flow reversal period, end plateau, and annealing phases, the water flow from the inlet valves has switch almost exclusively (i.e., 100%) to inner region flow from the inner region inlet valves. In other embodiments, water flow may switch almost exclusively (i.e., 100%) to outer region flow from the outer region inlet valves. Further, as shown in FIGS. 25A-25B, the intersection period, in which about 50% of water flow is from the inner region inlet valves and about 50% from the outer region inlet valves, has a time window of about 5 minutes to about 60 minutes; about 10 minutes to about 55 minutes; about 15 minutes to about 50 minutes; about 15 minutes to about 45 minutes; about 20 minutes to about 40 minutes; about 25 minutes to about 35 minutes; about 28 minutes to about 32 minutes; etc.

The methods of the preferred embodiment and variations thereof can be embodied and/or implemented at least in part as a machine configured to receive a computer-readable medium storing computer-readable instructions. The instructions are preferably executed by computer-executable components preferably integrated with the system and one or more portions of the processor on a computing device in communication with various components of the device for producing clear ice, such as but not limited to its various valves. The computer-readable medium can be stored on any suitable computer-readable media such as RAMs, ROMs, flash memory, EEPROMs, optical devices (e.g., CD or DVD), hard drives, floppy drives, or any suitable device. The computer-executable component is preferably a general or application-specific processor, but any suitable dedicated hardware or hardware/firmware combination can alternatively or additionally execute the instructions.

As used in the description and claims, the singular form "a", "an" and "the" include both singular and plural references unless the context clearly dictates otherwise. For example, the term "trough" may include, and is contemplated to include, a plurality of troughs. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

EXAMPLES

Example 10—Ice Formation as a Function of Cross-Sectional Shape of the Elongate Trough As described above, the cross-sectional shape of the elongate trough can have an impact on both the clarity of clear ice formed as well as the time required of a freezing operation of the device to generate a particular volume of clear ice in many embodiments. Because heat flow through ice is directly proportional to $1/W^2$ (wherein W is the distance to the center of the flume at a given height), the time required for the formation of a certain volume of ice can be approximated by the following Formula 1:

$$t = \frac{L_v W^2}{2K\Delta T} \quad \text{(Formula 1)}$$

Wherein Lv is the Latent Heat of Fusion of the liquid (e.g., water), K is the thermal conductivity of ice, and ΔT is the temperature differential experienced across the medium in which heat is flowing.

FIG. 26 shows the difference in time required to grow an ingot of ice having a height of 85.0 mm in various elongate troughs, all having a semicircular base flume surface wall with a 3-inch diameter but with varying slopes of the side flume walls. Because they have an identical base flume surface wall, no difference is noted in the rate of ice formation until is growth expands onto the side flume surface walls. By the end of the ice formation process, the example with the greatest slope of its walls (an 8.5° angle) yields the slowest time for forming the last 5 mm increments of ice height, an additional 228 seconds over the example having vertical walls.

Example 11—Cracking Avoidance During Ice Formation—Stress Model I

In applying too great of a temperature differential across a length of a solid material, cracks can form in ice, which negatively affects the visual clarity of ice. For example, if one ramps the freezing temperature down too quickly, the newly frozen ice will form cracks as it suddenly freezes. Ramping the temperature down, however, can be quite valuable during a freezing operation of various ice makers, including embodiments of the device of FIG. 1 as described herein, in order to overcome the inherent insulating properties of the accumulating ice. In many embodiments, ramping down the temperature of the surface for ice generation such as a flume surface wall of the device described herein can be necessary to generate a sizable ingot of ice in a freezing operation having a duration of twelve hours or less.

Therefore, for the generation of a high-quality clear ice product, this stress must be avoided during the ice formation process. The stress (a) experienced by ice can be calculated by the following Formula 2:

$$\sigma = \alpha E \Delta T \quad \text{(Formula 2)}$$

Wherein $\alpha$ is the coefficient of thermal expansion for ice ($5.0\times10^{-5}$° C.$^{-1}$), E is Young's modulus, and $\Delta T$ is the temperature differential experienced across the medium in which heat is flowing. Empirically, it is known that ice can withstand about 1 MPa of stress under this calculation before cracking.

However, as long as the conditions are not so stressful as to crack the ice, the ice naturally "relaxes" over time and reduces its experienced stress (this process is also known as creep, where solids materials near their melting point undergo physical deformations; this reduces the likelihood of cracking). The time $t_\lambda$, required to relax a proportion of stress $\lambda$ (the relaxation factor) from a material can be calculated by the following Formula 3:

$$t_\lambda = \frac{(\lambda^{1-n} - 1)\sigma(0)^{1-n}}{(n-1)A_o E e^{-Q/RT}} \quad \text{(Formula 3)}$$

Wherein n is a first material constant for ice (a value of 3, unitless), $A_0$ is a second material constant for ice ($1.36\times10^9$ MPa$^{-3}$ s$^{-1}$), $\sigma$ is the starting stress of the material in MPa, E is Young's Modulus, Q is the activation energy (78,000 Jmol$^{-1}$K$^{-1}$), R is the universal gas constant, and T is the absolute temperature. Ice accumulation and relaxation can occur simultaneously as long as the experienced conditions do not apply a stress greater than 1 MPa at any point during the cycle. Therefore, the temperature of a cold surface for the generation of ice, such as a flume surface wall, can be ramped down as long as its schedule allows for sufficient relaxation against the gaining stress.

FIG. 27 depicts one embodiment of such a temperature schedule for a linear accumulation of ice in one dimension that is orthogonal to a cold surface that additionally takes into account the insulating properties of ice (see Example 1 and various discussions herein). The starting conditions and time were experimentally determined as to reasonably approach the 1 MPa maximum stress, but each subsequent temperature step and duration thereat were calculated by the above formulae such that sufficient relaxation could occur at a pace that allowed the total stress to remain just under about 1 MPa. This thereby can maximize the rate of ice accumulation while preserving a clarity unblemished with cracks. By this model, about 5.5 cm of clear ice can be generated in 198 minutes without cracking.

Example 12—Cracking Avoidance During Ice Formation—Stress Model II

Because the accumulation of clear ice within an elongate trough of the device as described herein generally occurs in a multidirectional manner (e.g., FIG. 2), a second stress model was generated by applying the principles of above Example 2 to the dimensions of one embodiment of an elongate trough and approximating the surface area of heat transfer with that of a pipe (ignoring the end caps). This cylindrical approximation requires the use of a log mean cross sectional area (see Formula 4) within Fourier's Law of Heat Exchange (see Formula 5) because of the changing radius as accumulates and its effects on surface area available for heat exchange.

$$A_{lm} = \frac{A_{outer} - A_{inner}}{\ln\left(\frac{A_{outer}}{A_{inner}}\right)} \quad \text{(Formula 4)}$$

Wherein $A_{outer}$ is the surface area of the outer cylindrical surface and $A_{inner}$ is the surface area of the inner cylindrical surface. The surface area of a cylindrical shape can be calculated by $A=2\pi rL$ wherein r is the radius of the cylinder and L is the length of the cylinder.

$$\dot{Q} = kA\left(\frac{\Delta T}{\Delta r}\right) \quad \text{(Formula 5)}$$

Wherein k is the thermal conductivity of the material, A is $A_{1m}$, $\Delta T$ is the change in temperature across the system, and $\Delta r$ is the change in radius for the cylinder.

FIG. 28 presents an example temperature ramp schedule for ice formation that allows for sufficient relaxation in order to maintain the total stress on the ice under 1 MPa. In this embodiment, the elongate trough was 72 inches (about 1829 mm) long, a height of 3.5 inches (about 88.9 mm), a semicircular bottom having a radius of 1.5 inches (about 38.1 mm) and wherein the side walls had a slope of 2° off vertical (e.g., FIG. 3C). The model was run out to about 40 mm of accumulated ice thickness wherein the elongate trough would reach approximately maximum ice formation within its defined volume. As depicted, the presented temperature schedule can produce the approximately 40 mm of ice needed to fill the exemplary elongate trough in about 2 hours without cracking.

What is claimed is:

1. A device for making clear ice comprising:

at least one housing comprising at least two flume surface walls that define two or more elongate troughs;

at least one fluid intake disposed to provide a flow of fluid into the two or more elongate troughs;

at least one drain disposed to drain fluid from the two or more elongate troughs;

wherein at least a portion of the at least two flume surface walls is in thermal communication with a cooling source;

wherein the at least one fluid intake and the at least one drain are configured to provide a substantially constant flow of fluid to the two or more elongate troughs during a freezing operation of the device;

wherein the fluid intake comprises a fluid intake manifold that defines a single intake manifold cavity that is fluidly connected to the two or more elongate troughs through a fluid entry portal corresponding to each elongate trough; and wherein at least one of the fluid entry portals comprises a porous flow straightener.

2. The device of claim 1, wherein the cooling source is selected from the group consisting of: an internal cooling cavity defined by the housing, an evaporator, a cold plate, and a condenser.

3. The device for making clear ice of claim 1, wherein the at least two flume surface walls comprise a first side wall, a second side wall, and a base wall defining at least one elongate trough such that a cross-section of the at least one elongate trough has a tapered U-shape defined by at least one of the first side wall and the second side wall having an interior angle greater than or equal to about 0 degrees and less than or equal to about 15 degrees from upright, and wherein the base wall is semicircular.

4. The device for making clear ice of claim 1, wherein the at least two flume surface walls comprise a first side wall, a second side wall, and a base wall defining at least one elongate trough such that a cross-section of the at least one elongate trough has a tapered bracket shape defined by at least one of the first side wall and the second side wall having an interior angle greater than or equal to about 0 degrees and less than or equal to about 15 degrees from upright to a flat base flume surface wall.

5. The device for making clear ice of claim 1, wherein at least one of the two or more elongate troughs has a total depth divided into an ice-forming zone and a fluid overflow zone, and wherein a surface area of the flume surface wall at least coextensive with the fluid overflow zone comprises a thermally insulating material.

6. The device for making clear ice of claim 1, wherein the fluid intake manifold further comprises an intake flow divider insert having a porosity of about 10% open area to about 50% open area within the intake manifold cavity;

wherein the intake manifold cavity is shaped as a rectangular prism;

wherein the intake flow divider insert is coupled to opposite corners of the intake manifold cavity, thereby dividing the intake manifold cavity into a first and second triangular prism, wherein at least one fluid inlet pipe is in fluid communication to the first triangular prism, and wherein the corresponding fluid entry portals are in fluid communication to the second triangular prism.

7. The device for making clear ice of claim 1, wherein the drain comprises a drain manifold that defines a single drain manifold cavity that is fluidly connected to the two or more elongate troughs through a fluid exit portal corresponding to each elongate trough.

8. The device for making clear ice of claim 7, wherein the drain manifold further comprises a drain flow divider insert having a porosity of about 10% open area to about 50% open area within the drain manifold cavity;

wherein the drain manifold cavity is shaped as a rectangular prism;

wherein the drain flow divider insert forms an arcuate shape and is coupled to adjacent corners of the drain manifold cavity, thereby dividing the drain manifold cavity into a first and second portion wherein at least one drainage pipe is in fluid communication to the first portion, and wherein the corresponding fluid exit portals are in fluid communication to the second portion.

9. The device for making clear ice of claim 7, wherein at least one of the fluid exit portals comprises a porous flow straightener.

10. The device for making clear ice of claim 1, wherein the substantially constant flow of fluid is provided at a velocity of at least about 0.09 m/s through the two or more elongate troughs.

11. The device for making clear ice of claim 1, further comprising at least one lid configured to enclose at least one of the two or more elongate troughs when removably coupled to the housing.

12. The device for making clear ice of claim 1, further comprising one or more retractable inclusion holders configured to be disposed within a cavity defined by at least one of the two or more elongate troughs.

13. A method for manufacturing clear ice comprising:

providing a device for making clear ice comprising:

a housing comprising at least two flume surface walls that define at least one elongate trough;

at least one fluid intake disposed to provide a flow of fluid into the at least one elongate trough;

at least one drain disposed to drain fluid from the at least one elongate trough;

wherein at least a portion of the at least two flume surface walls is in thermal communication with a cooling source;

wherein the at least one fluid intake and the at least one drain are configured to provide a substantially constant flow of fluid to the at least one elongate trough during a freezing operation of the device;

wherein the fluid intake comprises a fluid intake manifold that defines a single intake manifold cavity that is fluidly connected to the at least one elongate trough through a fluid entry portal; and wherein the fluid entry portal comprises a porous flow straightener; and providing a substantially constant flow of fluid down the at least one elongate trough via the fluid intake and the drain; and cooling the at least two flume surface walls to a temperature of less than or equal to about 0 degrees Celsius.

14. The method of claim 13, wherein the cooling source is selected from the group consisting of: an internal cooling cavity defined by the housing, an evaporator, a cold plate, and a condenser.

15. The method of claim 13, wherein the device further comprises:

at least one or more retractable inclusion holders configured to be disposed within at least one elongate trough; and the method further comprises:

securing an item with at least one inclusion holder such that the item is positioned within a cavity defined by the at least one elongate trough; and retracting the one or more retractable inclusion holders after a sufficient accumulation of ice within the elongate trough such that the item remains at least partially embedded in the accumulation of ice upon retraction of the one or more inclusion holders.

16. The method of claim 13, wherein the substantially constant flow of fluid down the at least one elongate trough has a velocity of at least about 0.09 m/s through the at least one elongate trough.

17. A device for making clear ice comprising:

at least one housing comprising at least two flume surface walls that define at least one elongate trough;

at least one fluid intake disposed to provide a flow of fluid into the at least one elongate trough;

at least one drain disposed to drain fluid from the at least one elongate trough wherein at least a portion of the at least two flume surface walls is in thermal communication with a cooling source;

wherein the at least one fluid intake and the at least one drain are configured to provide a substantially constant flow of fluid to the at least one elongate trough during a freezing operation of the device;

wherein the drain comprises a drain manifold that defines a single drain manifold cavity that is fluidly connected to the at least one elongate trough through a fluid exit portal of the at least one elongate trough;

wherein the drain manifold further comprises a drain flow divider that is porous and forms an arcuate shape and is coupled to adjacent corners of the drain manifold cavity, thereby dividing the drain manifold cavity into a first and second portion.

18. The device for making clear ice of claim 17, wherein at least one drainage pipe is in fluid communication to the first portion, and wherein the fluid exit portals is in fluid communication to the second portion.

19. A device for making clear ice comprising:

at least one housing comprising at least two flume surface walls that define at least one elongate trough;

at least one fluid intake disposed to provide a flow of fluid into the at least one elongate trough;

at least one drain disposed to drain fluid from the at least one elongate trough;

wherein at least a portion of the at least two flume surface walls is in thermal communication with a cooling source;

wherein the at least one fluid intake and the at least one drain are configured to provide a substantially constant flow of fluid to the at least one elongate trough during a freezing operation of the device;

wherein the fluid intake comprises a fluid intake manifold that defines a single intake manifold cavity that is fluidly connected to the at least one elongate trough through a fluid entry portal of the at least one elongate trough;

wherein the fluid intake manifold further comprises a porous intake flow divider within the intake manifold cavity.

20. The device for making clear ice of claim 19, wherein the porous intake flow divider is coupled to opposite corners of the intake manifold cavity, thereby dividing the intake manifold cavity into a first and second triangular prism, and wherein at least one fluid inlet pipe is in fluid communication to the first triangular prism, and wherein the corresponding fluid entry portals are in fluid communication to the second triangular prism.

* * * * *